US007815079B2

(12) United States Patent
Saveliev et al.

(10) Patent No.: US 7,815,079 B2
(45) Date of Patent: Oct. 19, 2010

(54) RAPID COMESTIBLE FLUID DISPENSING APPARATUS AND METHOD

(75) Inventors: Michael Saveliev, Huntington Beach, CA (US); Steven T. Jersey, Laguna Niguel, CA (US); Thomas Gagliano, Hersbruck (DE)

(73) Assignee: SHURflo, LLC, Cypress, CA (US)

( * ) Notice: Subject to any disclaimer, the term of this patent is extended or adjusted under 35 U.S.C. 154(b) by 0 days.

(21) Appl. No.: 12/433,818

(22) Filed: Apr. 30, 2009

(65) Prior Publication Data

US 2009/0242590 A1 Oct. 1, 2009

Related U.S. Application Data

(63) Continuation of application No. 10/788,042, filed on Feb. 24, 2004, now abandoned, which is a continuation-in-part of application No. 10/208,661, filed on Jul. 30, 2002, now Pat. No. 6,695,168, which is a continuation of application No. 09/713,660, filed on Nov. 15, 2000, now Pat. No. 6,443,335, which is a continuation-in-part of application No. 09/437,673, filed on Nov. 10, 1999, now Pat. No. 6,354,341.

(51) Int. Cl.
*B67D 3/00* (2006.01)

(52) U.S. Cl. ..... 222/509; 222/518; 222/504; 222/547; 222/559; 222/564; 222/566; 222/571; 251/122; 141/392

(58) Field of Classification Search ..... 222/509, 222/518, 547, 564, 505, 507, 504, 510, 511, 222/513, 514, 526, 537, 599, 566, 571; 251/122; 141/392

See application file for complete search history.

(56) References Cited

U.S. PATENT DOCUMENTS 2,754,839 A * 7/1956 Brugge et al. ..... 137/454.2
2,788,925 A * 4/1957 Ward ..... 222/402.2
5,137,187 A * 8/1992 Nichols et al. ..... 222/504
5,228,604 A * 7/1993 Zanini et al. ..... 222/504

* cited by examiner

*Primary Examiner*—J. Casimer Jacyna
(74) *Attorney, Agent, or Firm*—Greenberg Traurig LLP

(57) ABSTRACT

Some embodiments of the present invention provide a comestible fluid dispensing apparatus including a nozzle defining an interior space and having a fluid inlet through which fluid is received within the interior space and a fluid outlet through which fluid exits the interior space and a substantially conical valve movable relative to the nozzle between different positions with respect to the nozzle and shaped to reduce turbulence and/or provide improved dispensing control.

19 Claims, 25 Drawing Sheets

RAPID COMESTIBLE FLUID DISPENSING APPARATUS AND METHOD

RELATED APPLICATIONS

This application is a continuation of patent application Ser. No. 10/788,042, filed Feb. 24, 2004 now abandoned which is a continuation-in-part of patent application Ser. No. 10/208,661, filed Jul. 30, 2002, now U.S. Pat. No. 6,695,168, issued Feb. 24, 2004, which is a continuation of patent application Ser. No. 09/713,660, filed Nov. 15, 2000, now U.S. Pat. No. 6,443,335, issued Sep. 3, 2002, which is a continuation-in-part of patent application Ser. No. 09/437,673 filed Nov. 10, 1999, now U.S. Pat. No. 6,354,341, issued Mar. 12, 2002.

FIELD OF THE INVENTION

This invention relates generally to fluid dispensers and more particularly, to comestible fluids dispensers and to cooling, sterilizing, measurement, and pressure control devices therefore.

BACKGROUND

Despite significant advancements in fluid dispensing devices and systems, many problems that have existed for decades related to such devices and systems remain unsolved. These problems exist in many different fluid dispensing applications, but have a particularly significant impact upon fluid dispensing devices and systems in the food and beverage industry as will be described below. Comestible fluid dispensers in this industry can be found for dispensing a wide variety of carbonated and non-carbonated pre-mixed and post-mixed drinks, including for example beer, soda, water, coffee, tea, and the like. Fluid dispensers in this industry are also commonly used for dispensing non-drink fluids such as condiments, food ingredients, etc. The term "comestible fluid" as used herein and in the appended claims refers to any type of food or drink intended to be consumed and which is found in a flowable form.

A majority of the long-standing problems in the comestible fluid dispensing art are found in dispensing applications for carbonated beverages. First, because the fluid being poured is carbonated and is therefore sensitive to pressure drops, conventional carbonated comestible fluid dispensers are generally slow, requiring several seconds to fill even an average size cup or glass. Second, when flow speeds are increased, the dispensed beverage often has an undesirably large foam head (which can overflow, spill, or otherwise create a mess) and is often flat due to the fast dispense. Some existing devices use hydrostatic pressure to push comestible fluid out of a holding tank located above the dispensing nozzle. One such device is disclosed in U.S. Pat. No. 5,603,363 issued to Nelson. Unfortunately, these devices do not provide for pressure control at the nozzle, and (at least partly for this reason) are limited in their ability to prevent foaming and loss of carbonation in the case of carbonated comestible fluids. The working potential of rack pressure in such devices is largely wasted in favor of hydrostatic pressure. By not maintaining rack pressure to the nozzles in these devices, carbonated comestible fluid inevitably loses its carbonation over time while waiting for subsequent dispenses. Also, like other existing beer dispensers, such devices cool and/or keep the comestible fluid cool by the relatively inefficient practice of cooling a reservoir or supply of comestible fluid.

Another problem of conventional comestible fluid beverage dispensers is related to the temperature at which the fluid is kept prior to dispense and at which the fluid is served. Some beverages are typically served cold but without ice, and therefore must be cooled or refrigerated prior to dispense. This requirement presents significant design limitations upon dispensers for dispensing such beverages. By way of example only, beer is usually served cold and must therefore be refrigerated or cooled prior to dispense. Conventional practice is to cool the beer in a refrigerated and insulated storage area. The process of refrigerating a beer storage area sometimes for an indefinite period of time prior to beer dispense is fairly inefficient and expensive. Such refrigeration also does not provide for quick temperature control or temperature change of the comestible fluid to be dispensed. Specifically, because the comestible fluid in storage is typically found in relatively large quantities, quick temperature change and adjustment by a user is not possible. Also, conventional refrigeration systems are not well suited for responsive control of comestible fluid temperature by automatic or manual control of the refrigeration system.

Unlike numerous other comestible fluids which do not necessarily need to be cooled (e.g., soft drinks, tea, lemonade, etc., which can be mixed with ice in a vessel after dispense) or at least do not require a cooling device or system for fluid lines running between a refrigerated fluid source and a nozzle, tap, or dispensing gun, beer is ideally kept cool up to the point of dispense. Therefore, many conventional dispensers are not suitable for dispensing beer. For example, beer located within fluid lines between a refrigerated fluid source and a nozzle, tap, or dispensing gun can become warm between dispenses. Warm beer in such fluid lines must be served warm, be mixed with cold beer following the warm beer in the fluid lines, or be flushed and discarded. These options are unacceptable as they call either for product waste or for serving product in a state that is less than desirable. In addition, because many comestible fluids are relatively quickly perishable, holding such fluids uncooled (such as in fluid lines running from a refrigerated fluid source to a nozzle, tap, or dispensing gun) for a length of time can cause the fluid to spoil, even fouling part or all of the dispensing system and requiring system flushing and cleaning.

Because many comestible fluids should be kept cool up to the point of dispense, the apparatus or elements necessary to achieve such cooling have significantly restricted conventional dispenser designs. Therefore, dispensers for highly perishable fluids such as beer are therefore typically non-movable taps connected via insulated or refrigerated lines to a refrigerated fluid source, while dispensers for less perishable fluids (and especially those that can be cooled by ice after dispense) can be hand-held and movable, connected to a source of refrigerated or non-refrigerated fluid by an unrefrigerated and uninsulated fluid line if desired.

A comestible fluid dispenser design issue related to the above problems is the ability to clean and sterilize the dispenser as needed. Like the problems described above, improperly cleaned dispenser systems can affect comestible fluid taste and smell and can even cause fresh comestible fluid to turn bad. Many potential dispenser system designs cannot be used due to the inability to properly clean and sterilize one or more internal areas of the dispenser system. Particularly where dispenser system designs call for the use of small components or for components having internal areas that are small, difficult to access, or cannot readily be cleaned by flushing, the advantages such designs could offer are compromised by cleaning issues.

The problems described above all have a significant impact upon dispensed comestible fluid quality and taste, but also have an impact upon an important issue in most dispenser applications: speed. Whether due to the inability to use well known devices for increasing fluid flow, due to the fact that carbonated fluids demand particular care in their manner of dispense, or due to dispenser design restrictions resulting from perishable fluids, conventional comestible fluid dispensers are invariably slow and inefficient.

SUMMARY

Some embodiments of the invention provide a nozzle assembly including a housing, an internal chamber, a valve rod, a first valve, and a second valve. The internal chamber can include a first end, a second, an inlet, and an outlet. The inlet can be in fluid communication with a fluid line. The outlet can be positioned at the second end of the internal chamber. The internal chamber can include a diffuser and a substantially straight portion, wherein the substantially straight portion can be positioned downstream of the diffuser. A cross section of the substantially straight portion can be equal to the largest cross section of the diffuser.

The first valve can include a first end and a second end. The first valve can be coupled to the valve rod. The second valve can include a first end and a second end. The first end of the second valve can be coupled to the second end of the first valve. The second valve can include a larger cross section than the largest cross section of the first valve. The second valve can be at least partly enclosed within the substantially straight portion and can include at least one open position and a closed position.

DETAILED DESCRIPTION

Figure 1:
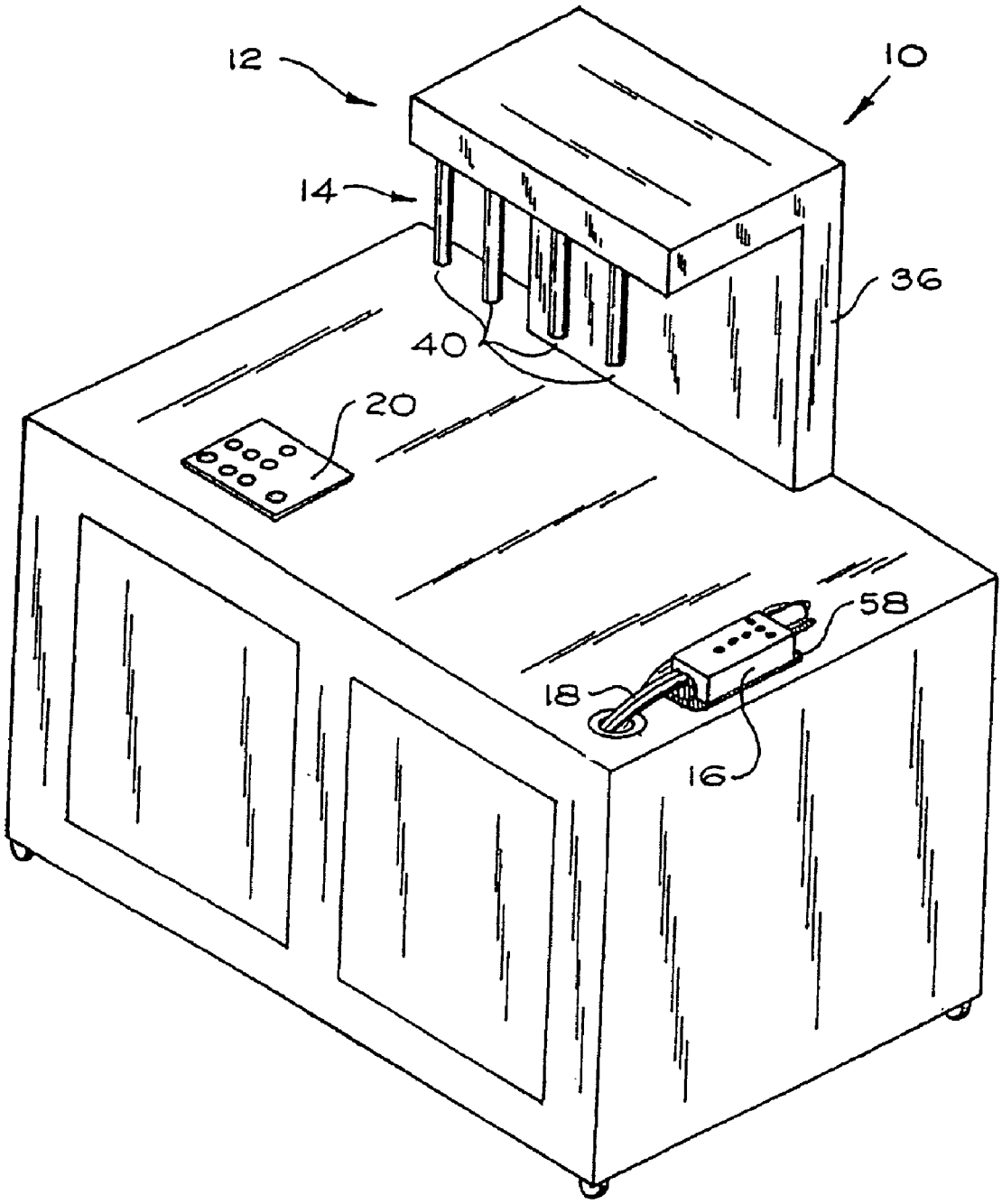
FIG. 1 is a perspective view of a vending cart having a set of rack nozzle assemblies, a dispensing gun, and associated elements according to a first preferred embodiment of the present invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

The present invention finds application in virtually any environment in which comestible fluid is dispensed. By way of example only, the figures of the present application illustrate the present invention employed in a mobile vending stand (indicated generally at 10). With reference first to FIG. 1, the vending stand 10 is preferably a self-contained unit, and can be powered by a generator or by a power source via an electrical cord (not shown). The vending stand shown has a dispensing rack 12 from which extend a number of dispensing nozzles 14 for dispense of different comestible fluids. Also, the illustrated vending stand 10 has a comestible fluid dispensing gun 16 capable of selectively dispensing one of multiple comestible fluids supplied thereto by fluid hoses 18. For user control of stand and dispensing operations, the vending stand 10 preferably has controls 20 (most preferably in the form of a control panel as shown) in a user-accessible location.

Figure 2:
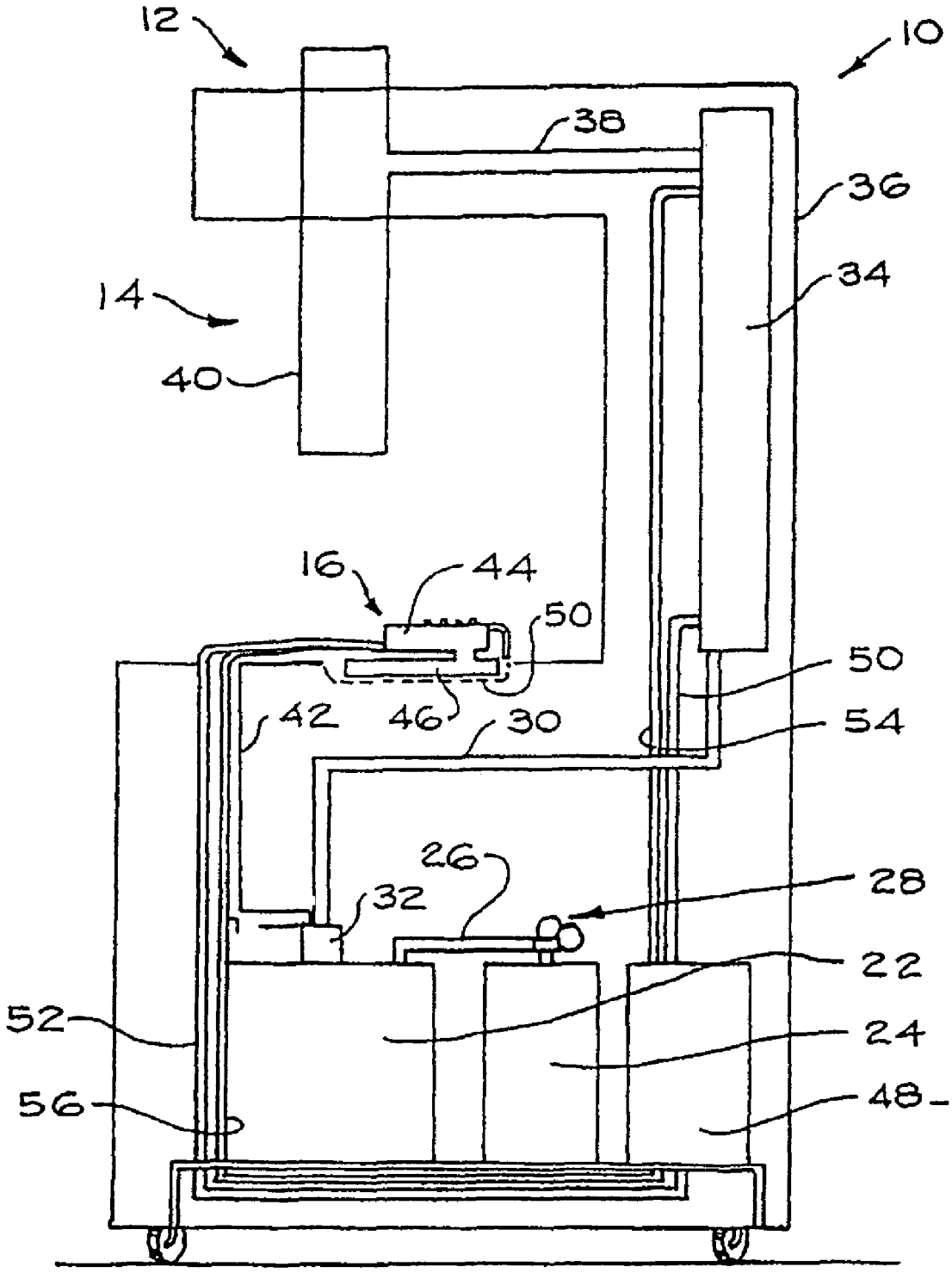
FIG. 2 is an elevational cross section view in of the vending cart shown in FIG. 1, showing connections and elements located within the vending cart.

As shown in FIG. 2, the vending stand 10 houses a supply of beers preferably in the form of kegs 22. The following description is with reference to only one keg 22 and associated pressurizing and fluid delivery elements (such as fluid lines, pressure regulators, nozzles, and other dispensing equipment), but applies to the other kegs 22 and their associated dispensing equipment that are not visible in the view of FIG. 2. Also, the following description of the invention is presented only by way of example with reference to different embodiments of an apparatus for dispensing beer. It should be noted, however, that the present invention is not defined by the type of comestible fluid being dispensed or the vessel in which such fluid is stored or dispensed from. The present invention can be used to dispense virtually any other type of comestible fluid as noted in the Background of the Invention above. Other comestible fluids often not found in kegs, but are commonly transported and stored in many other types of fluid vessels. The present invention is equally applicable and encompasses dispensing operations of such other comestible fluids in different fluid vessels.

As is well known to those skilled in the art, beer is stored pressurized, and is dispensed from conventional kegs by a pressure source or fluid pressurizing device such as a tank of carbon dioxide or beer gas (a mixture of carbon dioxide and nitrogen gas) coupled to the keg. The pressure source or fluid pressurizing device exerts pressure upon the beer in the keg to push the beer out of the keg via a beer tap. It should be noted that throughout the specification and claims herein, when one element is said to be "coupled" to another, this does not necessarily mean that one element is fastened, secured, or otherwise attached to another element. Instead, the term "coupled" means that one element is either connected directly or indirectly to another element or is in mechanical or electrical communication with another element. To regulate the pressure of beer in the keg and the pressure of beer in the system, a pressure regulator is coupled to the pressure source in a conventional manner and preferably measures the pressure levels within the pressure source and the keg, and also preferably permits a user to change the pressure released to the keg. One comestible fluid pressurizer in the preferred embodiment of the present invention shown in FIG. 2 is a tank of carbon dioxide 24 coupled in a conventional manner to the keg 22 via a pressure line 26. A conventional pressure regulator 28 is attached to the tank 24 for measuring tank and keg pressure as described above. A fluid delivery line 30 is coupled to the keg 22 via a tap 32 also in a conventional manner and runs to downstream dispensing equipment as will be discussed below.

The tank 24, pressure line 26, regulator 28, keg 22, tap 32, delivery line 30, their operation, and connection devices for connecting these elements (not shown) are well known to those skilled in the art and are not therefore described in greater detail herein. However, it should be noted that alternative embodiments of the present invention can employ conventional fluid storage arrangements and comestible fluid pressurizing devices that are significantly different than the keg and tank arrangement disclosed herein while still falling within the scope of the present invention. For example, although not preferred in beer dispensing devices, certain comestible fluid storage devices rely upon the hydrostatic pressure of fluid to provide sufficient fluid pressure for downstream dispensing equipment. In such cases, the comestible fluid need not be pressurized at all, and can be located at a higher elevation than the downstream dispensing equipment to establish the needed dispensing pressure. As another example, other systems employ fluid pumps to pressurize the fluid being dispensed. Depending at least in part upon the storage pressure of the fluid to be dispensed, the fluid storage devices can be in the form of kegs, tanks, bags, and the like. Each such alternative fluid pressurizing arrangement and storage device functions like the illustrated embodiment to supply fluid under pressure from a storage vessel to downstream dispensing equipment (and may or may not have a conventional device for adjusting the pressure exerted to move the fluid from the storage device). These alternative pressurizing arrangements and storage devices are well known to those skilled in the art and fall within the spirit and scope of the present invention.

With continued reference to FIG. 2, the delivery line 30 runs from the keg 22 to a rack heat exchanger 34. The rack heat exchanger 34 is preferably a plate-type heat exchanger supplied with refrigerant as will be described in more detail below. The rack heat exchanger 34 is preferably located in a housing 36 defining a rear portion of the dispensing rack 12, and is mounted therein in a conventional manner. The rack heat exchanger 34 has conventional ports and fittings for connecting beer input and output lines from each of the kegs 22 in the vending stand 10 and for connecting input and output refrigerant lines to the rack heat exchanger 34.

Extending from the rack heat exchanger 34 is a series of beer output lines 38 (one corresponding to each keg 22), only one of which is visible in FIG. 2. Each output line 38 runs to a nozzle assembly 40 that is operable by a user to open and close for dispensing beer as will be described in more detail below.

In the preferred embodiment of the present invention illustrated in FIGS. 1 and 2, a beer dispensing gun 16 is shown also connected to the kegs 22. Normally, either a dispensing gun 16 or a nozzle assembly 40 (not both) would be supplied with beer from a keg 22. Although both could be connected to the same keg 22 via the tap 32 as shown in FIG. 2, such an arrangement is presented for purposes of illustration and simplicity only. The dispensing gun 16 is supplied with beer from the kegs 22 by fluid lines 42, only one of which is visible in FIG. 2. More specifically, the dispensing gun 16 preferably has a plate-type heat exchanger 44 to which the fluid lines 42 run and are connected in a conventional manner via fluid input ports. A fluid output port (described in more detail below) connects the heat exchanger 44 to a nozzle assembly 46 of the beer gun 16. The heat exchanger 44 also has conventional ports and fittings for connecting input and output refrigerant lines to the rack heat exchanger 34.

The vending stand 10 shown in the figures also has a refrigeration system (shown generally at 48 and described in more detail below) for cooling the interior of the vending stand 10 and for cooling refrigerant for the heat exchangers 34, 44. To supply the heat exchangers 34, 44 with cool refrigerant, conventional refrigerant supply lines 50, 52 run from the refrigeration system 48 to the heat exchangers 34, 44, respectively, and are connected to the refrigeration system 48 and the heat exchangers 34, 44 via fittings and ports as is well known to those skilled in the art. Similarly, conventional refrigerant return lines 54, 56 run from the heat exchangers 34, 44, respectively, and are connected to the refrigeration system 48 and the heat exchangers 34, 44 via conventional fittings and ports.

To keep the kegs 22 and connected comestible fluid and refrigerant lines 30, 42, 50, 52, 54, 56 cool, the interior area of the vending stand 10 is preferably insulated in a conventional manner. With respect to the fluid lines 42 running outside of the vending stand 10 to the dispensing gun 16, these lines are preferably kept inside the vending stand 10 when the dispensing gun 16 is not being used. Specifically, the fluid lines 42 can be attached to a reel device or any other conventional line takeup device (not shown) to draw the fluid lines 42 inside the vending stand 10 when the dispensing gun 16 is returned to a holder 58 on the vending stand 10. Such devices and their operation are well known to those skilled in the art and are therefore not described further herein.

Figure 3:
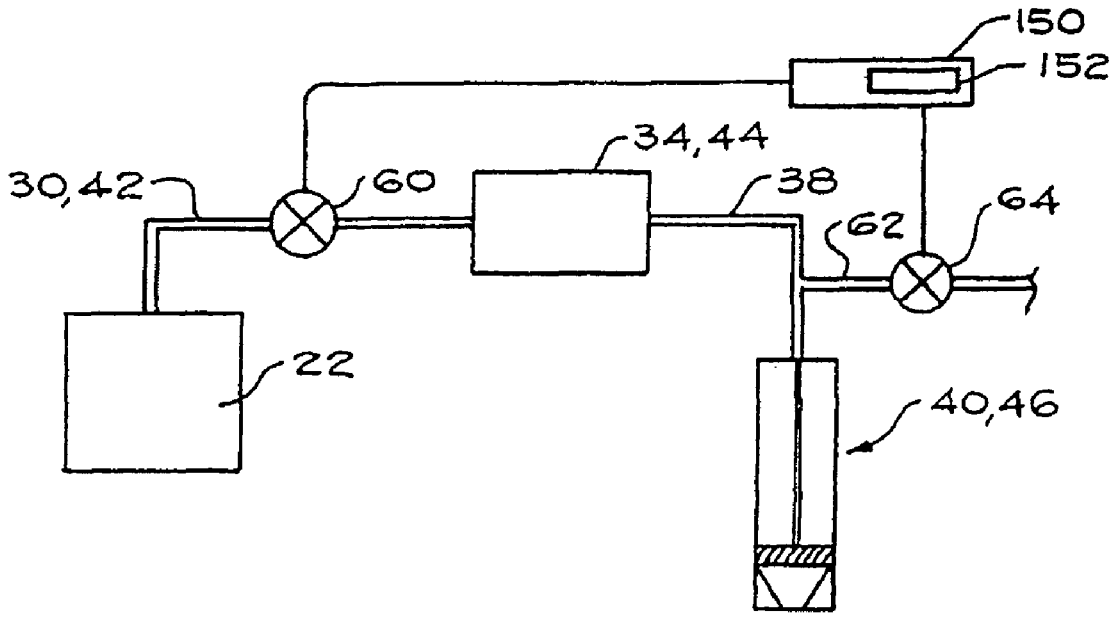
FIG. 3 is a comestible fluid schematic according to a preferred embodiment of the present invention.

With reference to FIG. 3, the flow of beer through the present invention is now described in greater detail. As used herein and in the appended claims, the term "fluid line" refers collectively to those areas through which fluid passes from the source of fluid (e.g., kegs 22) to the dispensing outlets 70, 130. A "fluid line" can refer to the entire path followed by fluid through the system or can refer to a portion of that path.

As described above, a delivery line 30 runs from each keg 22 to the rack heat exchanger 34 and is connected to fluid input lines on the rack heat exchanger 34 in a conventional manner. The delivery line 30 is preferably fitted with a valve 60 for at least selectively restricting but most preferably selectively closing the delivery line 30. For the sake of simplicity, the valve 60 is preferably a conventional pinch valve, but can instead be a diaphragm valve or any other valve preferably capable of quickly closing and opening the delivery line 30. The valve 60 can be fitted over the delivery line 30 as is conventional in many pinch valves, or can instead be spliced into the delivery line 30 as desired.

As mentioned above, a fluid output line 38 runs from the rack heat exchanger 34 to each nozzle assembly 40. Most preferably, the output line 38 and the connected nozzle assembly 40 are an extension of the rack heat exchanger 34 at its fluid output port (not shown). A purge line 62 preferably extends from the output line 38 or from nozzle assembly 40 as shown in FIG. 3, and is connected to the output line or nozzle assembly in a conventional manner. The purge line 62 is preferably fitted with a purge valve 64 for selectively closing the purge line 62. The purge valve 64 is preferably also a pinch valve, but can instead be any other valve type as described above with reference to the valve 60 on the delivery line 30. As will now be described in more detail, the nozzle assembly 40 is supplied with beer from the heat exchanger 44 and is actuatable to open and close for selectively dispensing beer.

Figure 4:
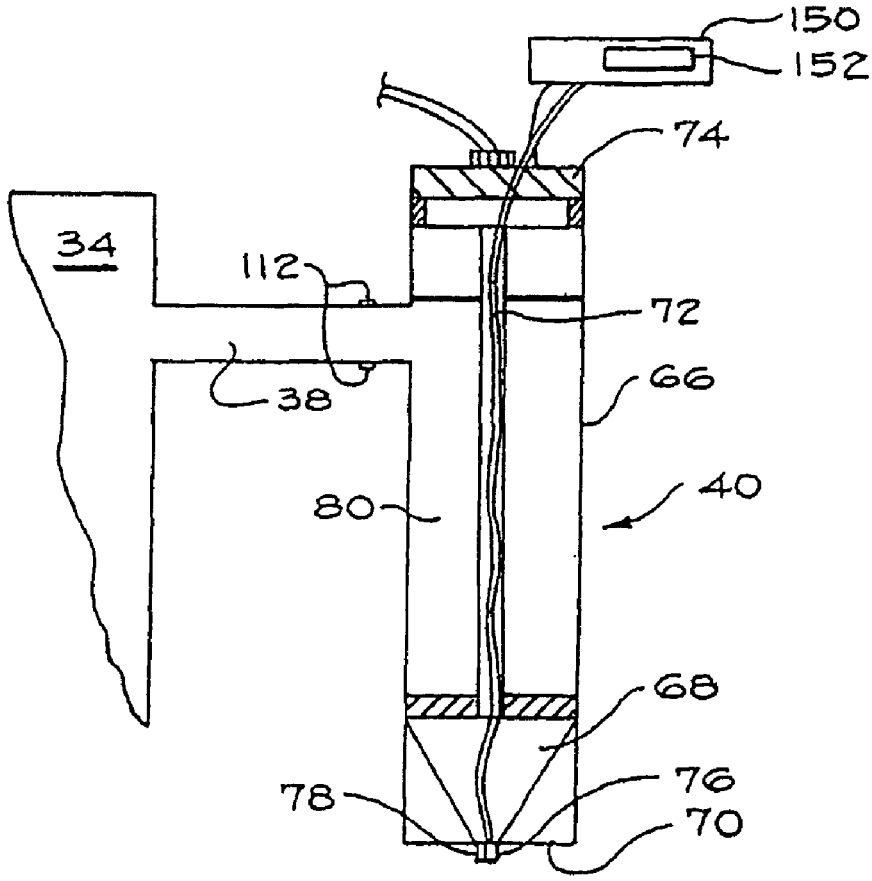
FIG. 4 is an elevational cross section view of a rack nozzle assembly shown in FIGS. 1 and 2.

The nozzle assembly 40 (see FIG. 4) includes a housing 66, a valve 68 movable to open and close a dispensing outlet 70, and a fluid holding chamber or reservoir 80 defined at least in part by the housing 66 and more preferably at least in part by the housing 66 and the valve 68. The housing 66 is preferably elongated as shown in the figures. For reasons that will be described below, the housing 66, valve 68, and dispensing outlet 70 are preferably shaped to permit the valve 68 to move in telescoping relationship a distance within the housing 66. In the preferred embodiment shown in the figures, the housing 66, valve 68, and dispensing outlet 70 have a round cross-sectional shape, thereby defining a tubular internal area of the housing 66. The valve 68 is preferably a plunger-type valve as shown in FIG. 4, where the valve 68 provides a seal against the inner wall or walls (depending upon the particular housing 66 shape) of the housing 66 through a range of positions until an open position is reached. Although one open position is possible in such a valve, the valve 66 is more preferably movable through a range of open positions also, thereby providing for different sizes for the dispensing outlet 70 and a corresponding range of flow speeds from the dispensing outlet 70. To actuate the valve 68, a valve rod 72 is attached at one end to the valve 68 and extends through the housing 66 to an actuator 74 preferably attached to the housing 66. The actuator 74 is preferably controllable by a user or system controller 150 in a conventional manner to position the valve 68 in a range of different positions in the housing 66. This range of positions includes at least one open position in which the dispensing outlet 70 is open to dispense beer and a range of closed positions defined along a length of the housing 66 in which the dispensing outlet 70 is closed to prevent the dispense of beer. One having ordinary skill in the art will appreciate that the entire housing 66 of the nozzle assembly 40 need not necessarily be elongated or tubular in shape. Where the preferred plunger-type valve 68 is employed (other nozzle elements described below being capable of performing the functions of a plunger-type valve 68 as discussed below), only the portion of the housing 66 that meets with the valve 68 to provide a fluid-tight seal through the range of closed valve positions should be elongated, tubular, or otherwise have a cavity therein with a substantially constant cross-sectional area along a length thereof.

The actuator 74 is preferably pneumatic, and is preferably supplied by conventional lines and conventional fittings with compressed air from an air compressor (not shown), compressed air tank (also not shown), or even from the tank 24 connected to and pressurizing the kegs 22. It will be appreciated by one having ordinary skill in the art that numerous other actuation devices and assemblies can be used to accomplish the same function of moving the valve 68 with respect to the housing 66 to open the dispensing outlet 70. For example, the actuator 74 need not be externally powered to both extended and retracted positions corresponding to open and closed positions of the nozzle valve 68. Instead, the actuator 74 can be externally powered in one direction (such as toward an extended position pushing the nozzle valve 68 open) and biased toward an opposite direction by the pressurized beer in the nozzle assembly 40 in a manner well known to those skilled in the art. As another example the pneumatic actuator 74 can be replaced by an electrical or hydraulic actuator or a mechanical actuator capable of moving the valve by gearing (e.g., a worm gear turning the valve rod 72 via gear teeth on the valve rod, a rack and pinion set, and the like), magnets, etc. In this regard, the valve 68 need not necessarily be attached to and be movable by a valve rod 72. Numerous other valve actuation elements and assemblies exist that are capable of moving the valve 68 to open and close the dispensing outlet. However, the actuation element or assembly in all such cases is preferably controllable over a range of positions to move the valve 68 to desired locations in the housing 66. Such other actuation assemblies and elements fall within the spirit and scope of the present invention.

In highly preferred embodiments of the present invention, a trigger sensor 76 and a shutoff sensor 78 are mounted at the tip of the nozzle housing 66 or (as shown in FIG. 4) at the tip of the valve 68. Both sensors 76, 78 are connected in a conventional manner to a system controller 150 for controlling the valves 60, 62, 76 to dispense beer from the nozzle assembly 40 and to stop beer dispense at a desired time. Preferably, the actuation sensor 76 is a mechanical trigger that is responsive to touch, while the trigger sensor 78 is an optical sensor responsive to the visual detection of beer or its immersion in beer. Of course, many other well known mechanical and electrical sensors can be used to send signals to the system controller 150 for opening and closing the valve 68 of the nozzle assembly 40. Such sensors include without limitation proximity sensors, motion sensors, temperature sensors, liquid sensors, and the like. However, the sensors used (and particularly, mechanical sensors such as the trigger sensor 76 in the preferred embodiment of the present invention) should be selected to operate in connection with a wide variety of beer receptacles and receptacle shapes. For example, where a selected trigger sensor operates by detecting a bottom surface of a beer receptacle, the sensor should be capable of detecting bottom surfaces of all types of beer receptacles, including without limitation surfaces that are flat, sloped, opaque, transparent, reflective, non-reflective, etc.

In a beer dispensing operation, a user places a vessel such as a glass or mug beneath the nozzle assembly 40 corresponding to the type of beer desired. The vessel is raised until the trigger sensor 76 is triggered (preferably by contact with the bottom of the vessel in the preferred case of a manual trigger sensor). Upon being triggered, the trigger sensor 76 sends a signal to the system controller 150 via an electrical connection thereto (e.g., up the valve rod 72, out of the actuator 74 or housing 66 and to the system controller 150, up the housing 66 and to the system controller 150, etc.) or transmits a wireless signal in a conventional manner to be received by the system controller 150. The system controller 150 responds by closing the valve 60 on the delivery line 30 from the keg 22. At this stage, the keg 22, delivery line 30, heat exchanger 34, output line 38, and nozzle assembly 40 contain beer under pressure near or equal to keg pressure. This pressure is generally too large for proper beer dispense from the nozzle assembly 40. As such, the pressure at the nozzle assembly 40 is preferably reduced to a desirable amount based upon the desired dispense characteristics (e.g., the amount of beer head desired) and the beer type being dispensed. Pressure at the nozzle assembly 40 can be reduced in several ways.

For example, the system controller 150 can send or transmit a signal to the purge valve 64 to open the same for releasing beer out of the purge line 62. Valve controllers responsive to such signals are well known to those skilled in the art and are not therefore described further herein. The purge valve 64 is preferably open for a sufficient time to permit enough beer to exit to lower the pressure in the nozzle assembly 40. The amount of purge valve open time required depends at least in part upon the amount of pressure drop desired, the type of beer dispensed, and the dimensions of the purge line 62 and purge valve 64. Preferably, the system controller 150 is pre-programmed with times required for desired pressure drops for different beer types. The user therefore enters the type of beer being dispensed via the controls 20, at which time the system controller 150 references the amount of time needed to drop pressure in the nozzle assembly 40 to a sufficiently low level for proper beer dispense. After the pressure in the nozzle assembly 40 has dropped sufficiently, the system controller 150 sends or transmits a signal to the purge valve 64 to close and sends a signal to the actuator 74 to open the nozzle valve 68.

As another example, pressure in the nozzle assembly 40 can be reduced by enlarging some portion of the area within which the beer is contained. Although such enlargement can be performed, e.g., by expanding the fluid line or a portion of the heat exchanger 34 (i.e., moving a wall or surface defining a portion of the fluid line or heat exchanger 34), it is most preferred to enlarge the fluid holding chamber 80. Accordingly, the valve 68 is movable to increase the size of the fluid holding chamber 80 in the housing 66 of the nozzle assembly 40. The valve preferably defines a surface or wall of the fluid holding chamber. As discussed above, the valve 68 is preferably movable through a range of closed positions in the nozzle assembly 40, and more preferably is in telescoping relationship within the housing 66. When the system controller 150 receives the trigger signal from the trigger sensor 76, the system controller 150 sends or transmits a signal to the actuator to move the valve toward the dispensing outlet 70. This movement increases the volume of the fluid holding chamber 80 in the nozzle assembly 40, thereby lowering the pressure in the nozzle assembly 40. By the time the valve 68 reaches the dispensing outlet 70 and opens to dispense the beer, the pressure within the nozzle assembly has lowered to a desired dispensing pressure.

Still other conventional pressure-reducing devices and assemblies can be used to lower the pre-dispense pressure in the nozzle assembly 40. For example, one or more walls defining the fluid holding chamber 80 can be movable to expand the fluid holding chamber, such as by one or more telescoping walls laterally movable toward and away from the center of the fluid holding chamber 80 prior to movement of the nozzle valve 68, a flexible wall of the fluid holding chamber 80 (such as an annular flexible wall) deformable to increase the volume of the fluid holding chamber 80, etc. A wall of the latter type can be formed, for example, in a bulb shape and be normally constricted by a band, cable, or other tightening device and be loosened prior to dispense to increase the volume of the fluid holding chamber 80. Such other devices and assemblies are well known to those skilled in the art and fall within the spirit and scope of the present invention.

It should be noted that more than one pressure reducing device or assembly can be employed to lower the nozzle dispense pressure to the desired level. The nozzle assembly shown in FIGS. 3 and 4, for example, includes the purge line 62 and purge valve 64 assembly and also includes a telescoping nozzle valve 68. However, in practice only one such device or assembly is typically necessary. Therefore, where the most preferred telescoping nozzle assembly is employed as shown in FIGS. 3 and 4, the need for a purge line 62 and purge valve 64 is either reduced or eliminated. Also, where the purge line 62 and the purge valve 64 are employed as also shown in FIGS. 3 and 4, the need for a valve 68 having a range of closed positions is reduced or eliminated. In other words, the valve 68 can simply have an open and a closed position. Depending upon the speed at which the pressure reducing device or assembly operates and the dispense speed of the nozzle assembly, it is even possible to eliminate the valve 60 on the delivery line 30 running from the keg 22. Specifically, a lower pressure at or near the nozzle assembly 40 does not necessarily reduce fluid pressure upstream of the rack heat exchanger 34 (i.e., in the delivery line 30) due to the response lag normally experienced from a pressure drop at a distance from the nozzle assembly. A pressure drop that is sufficiently fast at the nozzle assembly 40 can permit a user to dispense beer at or near a desired dispense pressure in the nozzle assembly before higher pressure upstream of the heat exchanger 34 has time to be transmitted to the nozzle assembly 40, thereby eliminating the need to actuate the pinch valve 60 on the delivery line 30 or eliminating the need for the pinch valve altogether.

Pressure drop in the nozzle assembly 40 prior to dispense can be performed in a number of different manners as described above, including the preferred valve arrangement shown in the figures. Although such a plunger-type valve is preferred, other conventional valve types can instead be used (including without limitation pinch valves, diaphragm valves, ball valves, spool valves, and the like) where one or more of the earlier-described alternative pressure reduction devices are employed. The type of valve used in the nozzle assembly 40 of the present invention can affect the shape of the dispensing outlet 70. Rather than employ an annular dispensing outlet, the dispensing outlet 70 can take any shape desired.

At substantially the same time or soon after the system controller 150 sends a signal to the actuator 74 to open the nozzle valve 68, the system controller 150 also preferably activates the shutoff sensor 78 (if not already activated). Preferably, the shutoff sensor 78 is selected and adapted to detect the presence of fluid near or at the level of the nozzle valve 68 or the end of the nozzle housing 66. The shutoff sensor 78 can perform this function by detecting the proximity of the surface of the beer in the vessel, by detecting its immersion in beer in the vessel, by detecting a temperature change corresponding to removal of the beer from the sensor, and the like. Most preferably however, the shutoff sensor 78 optically detects its immersion in the beer in a manner well known in the fluid detection art.

The system controller 150 permits beer to be poured from the nozzle assembly 40 so long as the system controller 150 does not receive a signal from the shutoff sensor 78 indicating otherwise. The nozzles 14 of the preferred embodiment of the present invention are sub-surface fill nozzles, meaning that beer is injected into the already-dispensed beer in the vessel. Due to the preferred shape of the nozzle valve 68 shown in FIGS. 3 and 4, beer exits the dispensing outlet 70 radially in all directions within the vessel, thereby distributing the pressure of the beer better (to help reduce carbonation loss and foaming) than a straight flow dispense. It should be noted, however, that flow from the dispensing outlet does not need to be radial flow in all directions, and can instead be flow in a stream, fan, or in any other flow shape desired. In this regard, the dispensing outlet 70 can take any shape desired, including without limitation an annular opening as described above, a slit, an aperture having a round, oval, elongated, or any other shape, and the like. The shape of the dispensing outlet 70 is dependent at least in part upon the type of valve employed in the present invention. After an initial amount of beer has been poured into the vessel, the tip of the nozzle assembly 40 is preferably kept beneath the surface of the beer in the vessel. Additional beer dispensed into the vessel is therefore injected with less foaming and with less loss of carbonation. When the user is done dispensing beer into the vessel, the user drops the vessel from the nozzle assembly 40. The shutoff sensor 78 detects that it is no longer immersed in beer, and sends a signal in a conventional manner to the system controller 150. Upon receiving this signal, the system controller 150 sends a signal to the actuator 74 to return the nozzle valve 68 to a closed position, thereby sealing the dispensing outlet 70 and stopping the dispense of beer.

By virtue of the above nozzle assembly arrangement, pressure can be maintained throughout the system—from the kegs 22 to the nozzle valves 68. Most preferably, the equilibrium state of the system is pressure substantially equal to the storage pressure of beer in the kegs (or the "rack pressure"). Such pressure throughout the system prevents loss of carbonation in the system due to low or atmospheric pressures, prevents over-carbonation due to undesirably high pressures, enables faster beer dispense, and permits better dispense control. Several alternatives exist to the use of the trigger sensor 76 and the shutoff sensor 78 on the nozzle assembly for controlling beer dispense. For example, the nozzle assembly 40 can be operated directly by a user via the controls 20, in which case the user would preferably directly indicate the start and stop times for beer dispense. As another example where the size of the vessel into which beer is dispensed is known, this information can be entered by a user into the system controller 150 via the controls 20. In operation, the system is triggered to start dispensing beer by a trigger sensor such as the trigger sensor 76 discussed above, by a user-actuatable button on the controls 20, by one or more sensors located adjacent the nozzle assembly for detecting the presence of a vessel beneath the nozzle 14 in a manner well known to those skilled in the art, and the like. Where a desired amount of beer is to be dispensed, beer dispense can be stopped in a number of different ways, such as by a shutoff sensor like the shutoff sensor 78 described above, one or more sensors located adjacent to the nozzle assembly 40 for detecting the removal of the vessel from beneath the nozzle 14, by a conventional flowmeter located anywhere along the system from the keg 22 to the nozzle valve 68 (and more preferably at the dispensing outlet 70 or in the housing 66) for measuring the amount of flow past the flowmeter, or by a conventional pressure sensor also located anywhere along the system but more preferably located in the nozzle assembly 40 to measure the pressure of beer being dispensed. In both latter cases, dimensions of the nozzle assembly would be known and preferably programmed into the system controller 150 in a conventional manner. For example, if a flowmeter is used, the cross-sectional area of the nozzle 14 at the flowmeter would be known to calculate the amount of flow past the flowmeter. If a pressure sensor is used, the size of the dispensing outlet 70 when the nozzle valve 68 is open would be known to calculate the amount of flow through the dispensing outlet 70 per unit time. Using a conventional timer 152 preferably associated with the system controller 150, the system controller 150 can then send a signal to the actuator 74 to close the nozzle valve 68 after an amount of time has passed corresponding to the amount of fluid dispense desired (e.g., found by dividing the amount of fluid desired to be dispensed by the flow rate per unit time). Because the pressure and flow rate vary during dispensing operations, alternative embodiments employing a flowmeter or pressure sensor continually monitor beer flow or pressure, respectively, to update the flow rate in a conventional manner. When the desired amount of beer has been measured via the flowmeter or pressure sensor, the system controller 150 sends a signal to the actuator 74 to close the nozzle valve 68.

Devices and systems for calculating flow amount such as those just described are well known to those skilled in the art and fall within the spirit and scope of the present invention. It should be noted, however, that such devices and systems need not necessarily be used in conjunction with the nozzle valve 68 as just described, but can instead be used to control beer supply to the nozzle assembly 40. For example, such devices and systems can be used in connection with a valve such as valve 60 upstream of the rack heat exchanger 34 to control fluid supply to the nozzle assembly 40, which itself would preferably be timed to open and close with or close to the opening and closing times of the upstream valve. Whether the device or system calculates flow based upon valve open time (like the pressure sensor example described above) or measured flow speed with the cross-sectional flow area known (like the flowmeter example also described above), control of valves other than the nozzle valve 68 can be used to dispense a desired amount of beer from the nozzle assembly 40.

Yet another manner in which a desired amount of beer can be dispensed from the nozzle assembly 40 is by closing a valve such as valve 60 upstream of the nozzle assembly 40 and dispensing all fluid downstream of the closed valve 60. The valve 60 can be positioned a sufficient distance upstream of the nozzle assembly 40 so that the amount of beer from the valve 60 through the nozzle assembly 40 is a known set amount, such as 12 ounces, 20 ounces, and the like. By closing the valve 60 and dispensing the fluid downstream of the valve 60, a known amount of beer is dispensed from the nozzle assembly 40. If shorter fluid line distances between the valve 60 and the nozzle assembly 40 are desired, the fluid line can have one or more fluid chambers (not shown) with known capacities that are drained after the valve 60 is closed. Additionally, multiple valves 60 located in different positions upstream of the nozzle assembly 40 can be employed to each dispense a different (preferably standard beverage size) fluid amount from the nozzle assembly 40. The user and/or system controller 150 can therefore selectively close one of the valves corresponding to the desired dispense amount. To assist in draining the fluid line downstream of the valve 60 closed, the valve can have a conventional drain line or port associated therewith (e.g., on the valve 60 itself or immediately downstream of the valve 60) that opens when the valve 60 is closed and that closes when the valve is opened. Similarly, to assist in filling the fluid line downstream of the valve 60 when the nozzle valve 68 is closed and the valve 60 is open after dispense, a conventional vent valve or line can be located on the nozzle assembly 40 and can open while the fluid line is filling and close when the fluid line has been filled.

Although valve control upstream of the nozzle assembly 40 can be used to dispense a set amount of beer, such an arrangement is generally not preferred due to inherent pressure variations and pressure propagation times through the system resulting in lower dispense accuracy. However, pressure variations and pressure propagation times are significantly affected by the particular location of the valve(s) 60 and the type and size of heat exchanger 34 used. Therefore, the problems related to such valve control can be mitigated by using heat exchangers having low pressure effects on comestible fluid in the system or by locating the valve(s) 60 between the heat exchanger 34 and the nozzle assembly 60.

It should be noted that because the amount of beer dispensed from the nozzle assemblies 40 can be measured on a dispense by dispense basis via the flowmeter or the timed pressure sensor arrangements described above, the total amount of beer dispensed from any or all of the nozzle assemblies can be monitored in a conventional manner, such as by the system controller 150. Among other things, this is particularly useful to monitor beer waste, pilferage, and consumer preferences and demand.

Figure 5:
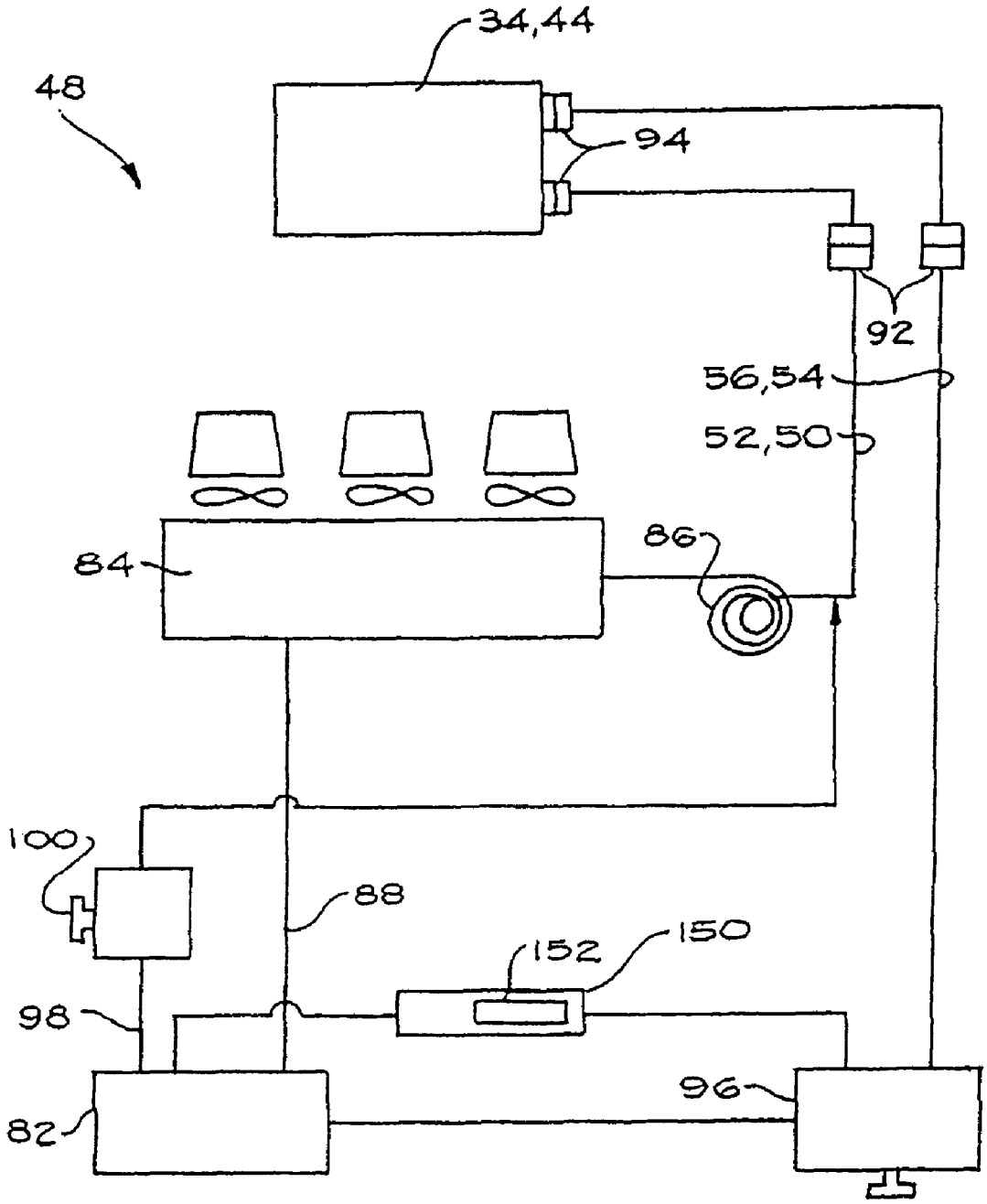
FIG. 5 is a refrigeration schematic according to a preferred embodiment of the present invention.
Figure 6:
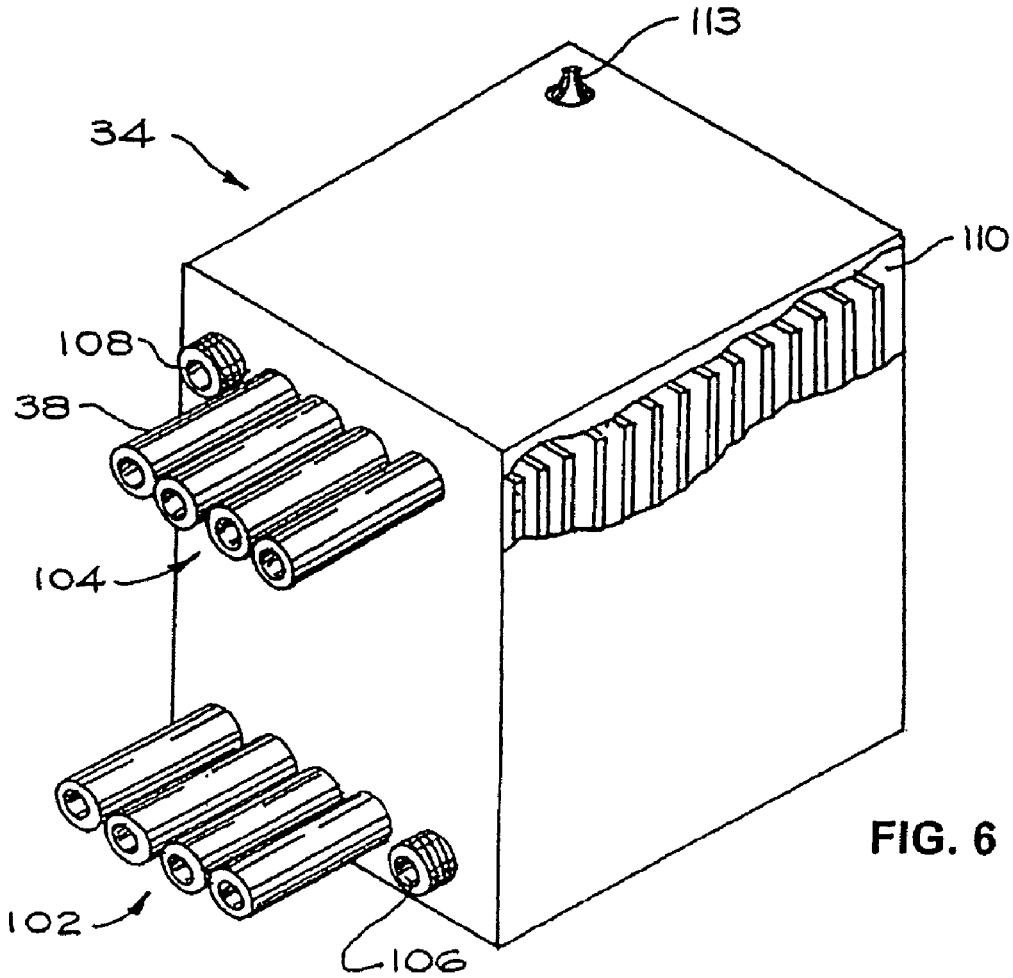
FIG. 6 is a perspective view, partially broken away, of the rack heat exchanger used in the vending stand shown in FIGS. 1 and 2.

FIGS. 5 and 6 illustrate the refrigeration system of the present invention. In contrast to conventional vending stands, the present invention does not require an insulated or refrigerated keg storage area. Eliminating the need for a keg storage area refrigeration system in lieu of the heat exchanger refrigeration system described below represents a significant cost and maintenance savings and results in a much more efficient refrigeration system. An insulated and refrigerated keg storage area is preferred particularly in applications where a keg is dispensed over the period of two or more days. However, in high-volume dispensing applications such as concession stands at sporting events and festivals, kegs are spent quickly enough to eliminate refrigeration after tapping to prevent spoilage. A refrigeration system for cooling the keg storage area in the vending stand 10 illustrated in the figures is not shown, but can be employed if desired. Such systems and their operation are well known to those skilled in the art and are not therefore described further herein.

With reference first to FIG. 5, which is a schematic representation of the refrigeration system 48 of the present invention, the four primary elements of a refrigeration system are shown: a compressor 82, a condenser 84, an expansion valve (in the illustrated preferred embodiment, a triple-feed wound capillary tube 86), and an evaporator (in the illustrated preferred embodiment, the rack heat exchanger 34 or the dispensing gun heat exchanger 44). Although many different working fluids can be used in the refrigeration system 48, such as Ammonia, R-12, or R-134a, or R-404a, the working fluid is preferably R-22.

In a vapor compressor refrigeration cycle such as that employed in the preferred embodiment of the present invention, the compressor 82 receives relatively low pressure and high temperature refrigerant gas and compresses the refrigerant gas to a relatively high pressure and high temperature refrigerant gas. This refrigerant gas is passed via gas line 88 to the condenser 84 for cooling to a relatively high pressure and low temperature refrigerant liquid. Although several different condenser types exist, the condenser 84 is preferably a conventional air-cooled condenser having at least one fan for blowing air over lines in the condenser to cool the refrigerant therein. After passing from the condenser 84, the relatively high pressure, low temperature refrigerant liquid is passed through the triple feed wound capillary tube 86 to lower the pressure of the refrigerant, thereby resulting in a relatively low pressure and low temperature refrigerant liquid. This refrigerant liquid is then passed to the heat exchanger 34, 44 where it absorbs heat from the beer being cooled. The resulting relatively high temperature and low pressure refrigerant gas is then passed to the compressor 82 (via a valve 96 as will be discussed below) for the next refrigeration cycle. Most preferably, the heat exchanger 34, 44 is connected to the rest of the refrigeration system 48 by conventional releasable fittings 92 (and most preferably, conventional threaded flair fittings) so that the unit being refrigerated by the refrigeration system 48 can be quickly and conveniently changed. Similarly, the refrigerant lines connected to the heat exchanger 34, 44 are preferably connected thereto by conventional releasable threaded flair fittings 94. It will be appreciated by one having ordinary skill in the art that such fittings can take any number of different forms. Such fittings, as well as the fittings and connection elements for connecting all elements of the refrigeration system 48 to their lines are well known to those skilled in the art and are not therefore described further herein.

Any of the lines connecting the elements of the refrigeration system 48 can be rigid. However, these lines are more preferably flexible for ease of connection and maintenance, and preferably are made of transparent material to enable flow characteristics and cleanliness observation. In particular, where the refrigerant supply and return lines 50, 52, 54, 56 run to and from the dispensing gun 16, these lines should be flexible to permit user movement of the dispensing gun 16. Such lines are well known in the refrigeration and air-conditioning art. For example, flexible automotive air conditioning hose can be used to connect the heat exchanger 44 to the remainder of the refrigeration system 48.

The refrigeration system 48 of the present invention can be used to control the temperature at which beer is dispensed from the dispensing gun 16 and from the nozzle assembly 40. It is highly desirable to control the amount of cooling of the heat exchanger 34, 44 in the present invention. As is well known in the art, the pressure of beer must be kept within a relatively narrow range for proper beer dispense, and this pressure is significantly affected by the temperature at which the beer is kept. Although it is desirable to keep the beer cool in the nozzle assembly 40, most preferably the beer temperature is controlled by control of the refrigeration system 48 as described below. By controlling the temperature of beer flowing through the system by refrigeration system control, the pressure changes called for by movement of the nozzle valve 68 as described above also can be better controlled, as well as the pressure of beer in the system (an important factor in measuring beer dispense as also described above). For example, if a lower equilibrium beer pressure is desired in the nozzle assembly 40 prior to moving the nozzle valve 68 to drop the beer pressure before beer dispense, the system controller 150 can control the refrigeration system (as described in more detail below) to increase cooling at the heat exchanger 34, thereby lowering beer pressure at the nozzle assembly 40. Such control is useful in other embodiments of the present invention described above for controlling beer pressure and temperature in the system.

To control the refrigeration system 48, a conventional evaporator pressure regulator (EPR) valve 96 is preferably located between the heat exchanger 34, 44 and the compressor 82. The EPR valve 96 is connected in the refrigerant return line 54, 56 in a conventional manner. The EPR valve 96 measures the pressure of refrigerant in the refrigerant return line 54, 56 (and the heat exchanger 34, 44) and responds by either constricting flow from the heat exchanger 34, 44 or further opening flow from the heat exchanger 34, 44. Either change alters the pressure upstream of the EPR valve 96 in a manner well known to those skilled in the art. Specifically, by adjusting the valve, the pressure within the heat exchanger 34, 44 can be increased or decreased. Increasing refrigerant pressure in the heat exchanger 34, 44 lowers the refrigerant's ability to absorb heat from the beer in the heat exchanger 34, 44, thereby lowering the cooling effect of the heat exchanger 34, 44 and increasing the temperature of beer passed therethrough. Conversely, decreasing refrigerant pressure in the heat exchanger 34, 44 increases the refrigerant's ability to absorb heat from the beer in the heat exchanger 34, 44, thereby increasing the cooling effect of the heat exchanger 34, 44 and lowering the temperature of beer passed therethrough. The pressure upstream of the EPR valve 96 can be precisely controlled by adjusting the EPR valve 96 to result in refrigerant of varying capacity to cool, thereby precisely controlling the temperature of beer dispensed and allowing the refrigeration system 48 to run continuously independently of loading placed thereupon. This is in contrast to conventional refrigeration systems for comestible fluid dispensers in that conventional refrigeration systems generally must cycle on and off when the loading on such systems becomes light. The EPR valve is preferably connected to and automatically adjustable in a conventional manner by the system controller 150, but can instead be manually adjusted by a user if desired. In this regard, a temperature sensor (not shown) is preferably located within or adjacent to the nozzle assembly 40, 46, the heat exchanger 34, 44, or the keg 22 to determine the temperature of beer in the system and to provide the system controller 150 with this information. The system controller 150 can then adjust the EPR valve 96 to change the beer temperature accordingly.

Another manner by which the refrigeration system 48 can be adjusted to control cooling of the heat exchanger 34, 44 is also shown in the schematic diagram of FIG. 5. Specifically, a bleed line 98 is preferably connected at the discharge end of the compressor 82 and at another end to the refrigerant supply line 50, 52 running from the capillary tube 86 to the heat exchanger 34, 44. The bleed line 98 is fitted with a conventional bypass regulator 100 which measures the pressure of refrigerant in the refrigerant supply line 50, 52 and which responds by either keeping the bleed line 98 shut or by opening an amount to bleed hot refrigerant from the compressor 82 to the refrigerant supply line 50, 52. The bleed line 98 and bypass regulator 100 are preferably connected to the compressor 82 and refrigerant supply line 50, 52 by conventional fittings. Hot refrigerant bled from the compressor 82 by the bypass regulator mixes with and warms cold refrigerant liquid in the refrigerant supply line 50, 52, thereby lowering the refrigerant's capacity to absorb heat from beer in the heat exchanger 34, 44 and raising the temperature of beer passing through the heat exchanger 34, 44. The amount of hot refrigerant gas mixed with the refrigerant in the refrigerant supply line 50, 52 can be precisely controlled by the bypass regulator to result in refrigerant of varying capacity to cool, thereby precisely controlling the temperature of beer dispensed and allowing the refrigeration system 48 to run continuously independently of loading placed thereupon. As mentioned above, this is in contrast to conventional refrigeration systems for comestible fluid dispensers in that conventional refrigeration systems generally must cycle on and off when the loading on such systems becomes light. The bypass regulator 100 is preferably connected to and automatically adjustable in a conventional manner by the system controller 150, but can instead be manually adjusted by a user if desired. In this regard, a temperature sensor (not shown) is preferably located within or adjacent to the nozzle assembly 40, 46, the heat exchanger 34, 44, or the keg 22 to determine the temperature of beer in the system and to provide the system controller 150 with this information. The system controller 150 can then adjust the bypass regulator 100 to change the beer temperature accordingly.

It should be noted that the EPR valve 96 and the bypass regulator 100 can take many different forms well known to those skilled in the art, each of which is effective to open or close the respective lines to change the pressure of refrigerant in the system or to inject hot refrigerant into a cold refrigerant line. These refrigerant system components act at least as valves and most preferably as regulators to open or close automatically in response to threshold pressures being reached in the refrigerant lines detected (thereby automatically keeping the refrigerant system 48 operating at a capacity sufficient to maintain a desired beer temperature). Although an EPR valve 96 and a bypass regulator 100 are included in the preferred embodiment of the present invention illustrated in the figures, one having ordinary skill in the art will recognize that system operation can be controlled by one of these devices or any number of these devices. Also, if either or both of these devices are simply valves rather than regulators, refrigeration system control is still possible by measuring the temperature and/or pressure of beer flowing through the heat exchangers 34, 44 as described above and by operating the valves 96, 100 via the system controller 150 in response to the measured temperature and/or pressure.

With reference to FIG. 6, the rack heat exchanger 34 of the preferred embodiment of the present invention can be seen in greater detail. The rack heat exchanger 34 is preferably a plate heat exchanger having at least one beer input port 102, one beer output port 104, one refrigerant input port 106, and one refrigerant output port 108 in a conventional housing. In the illustrated preferred embodiment, the rack heat exchanger is a plate heat exchanger having four separate flow paths through the heat exchanger 34 for four different beers. Accordingly, the illustrated rack heat exchanger 34 has four different beer input ports 102 and four different beer output ports 104, and has one refrigerant input port 106 and one refrigerant output port 108 for running refrigerant through all sections of the rack heat exchanger 34. It will be appreciated by one having ordinary skill in the art that the rack heat exchanger 34 can be divided into any number of separate sections (beer flow paths) corresponding to any number of desired beers run to the dispensing rack 12, and that more refrigerant input and output ports 106, 108 can be employed if desired. Indeed, the rack heat exchanger 34 can even have dedicated refrigerant input and output ports 106, 108 for each section of the rack heat exchanger 34. Alternatively, the dispensing rack can have a separate heat exchanger 34 with dedicated refrigerant input and output ports 106, 108 for each beer fed to the dispensing rack 12. Plate-type heat exchangers having multiple fluid passageways are well known to those skilled in the art and are not therefore described further herein. As described above, a delivery line 30 runs to each fluid input port from a respective keg 22 and is coupled thereto in a conventional manner with conventional fittings. Similarly, the refrigerant supply line 50 and the refrigerant return line 54 run to the refrigerant input and output ports 106, 108, respectively, and are coupled thereto in a conventional manner with conventional fittings. Each output port 108 of the rack heat exchanger 34 preferably extends to the nozzle housing 66.

Figure 6A:
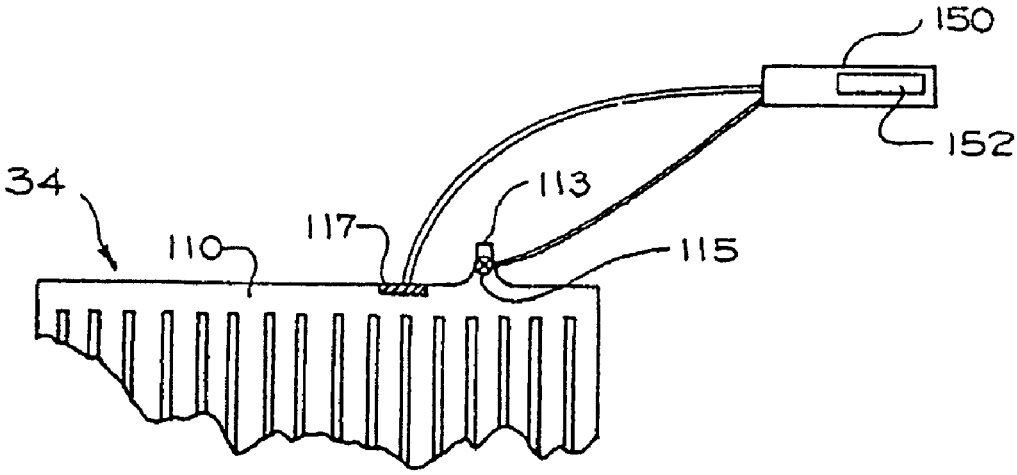
FIG. 6*a* is an elevational cross section view of the rack heat exchanger shown in FIG. 6.

A problem that can arise in using conventional plate-type heat exchangers for dispensing comestible fluid is that such heat exchangers typically have a head space therein. Head space is undesirable in comestible fluid systems because such areas are hard to clean (in some cases, they never become wet or immersed in the fluid being cooled), create pressure regulation problems in the system, and can harbor bacteria growth and possibly even spoil beer in the system. With reference to FIGS. 6 and 6*a*, the head space 110 is an area of the heat exchanger interior that is at a higher elevation than the beer output ports 104, and is not filled with fluid during normal system operation. FIGS. 6 and 6*a* show the plate-type heat exchanger of the present invention in greater detail. As is known to those skilled in the art, fluid to be cooled is kept separated from refrigerant by one or more plates within the heat exchanger, one side of each plate being exposed to or immersed in the refrigerant while the other side of each plate is exposed to or immersed in the fluid being cooled. To prevent the problems associated with head space mentioned above, the rack heat exchanger 54 preferably has a vent port 113 at the top of the rack heat exchanger 54. The vent port 113 has a vent valve 115 that can be actuated to open and close the vent port 113. The vent valve 115 can be any valve capable of opening and closing the vent port, but more preferably is a check valve only permitting air and gas exit from the rack heat exchanger 54. The rack heat exchanger 54 also preferably has a sensor 117 capable of detecting the presence of liquid at the top of the rack heat exchanger 54. The sensor 117 can one of many types, including without limitation an optical sensor for detecting the proximity of fluid in the head space of the rack heat exchanger 54, a liquid sensor responsive to immersion in liquid, a temperature sensor responsive to the temperature difference created by the presence or contact of liquid upon the sensor, a mechanical or electro-mechanical liquid level sensor, and the like. The vent port 113, vent valve 115, sensor 117, and their connection and operation are conventional in nature. Although the vent valve 115 can be manually opened and closed (also in a conventional manner), most preferably the vent valve 115 is controlled by the system controller 150 to which it and the sensor 117 are connected. However, it should be noted that the vent valve 115 and the sensor 117 can be part of a separately powered and self-contained electrical circuit that receives signals from the sensor 117 and that controls the vent valve 115 accordingly. Such circuits are well known to those skilled in the art and fall within the spirit and scope of the present invention.

In operation, the vent valve 115 is open to permit fluid exit from the rack heat exchanger 54. When the sensor 117 detects the presence of liquid at the top of the rack heat exchanger 54 (at a comestible fluid trigger level or a maximum fill level of the rack heat exchanger), the sensor 117 preferably sends or transmits one or more signals to the system controller 150, which in turn sends or transmits one or more signals to close the vent valve 115 and to prevent fluid from exiting the rack heat exchanger 54. Most preferably, the sensor 117 is selected or positioned so that the vent valve 115 will close just as the rack heat exchanger 54 becomes filled with beer. Depending upon the type of sensor 117 used, the sensor 117 can be positioned in the vent port 113 for detecting the initial entry of beer into the vent port 113, or can even be attached to or immediately beside the vent valve 115. By virtue of the venting arrangements just described, the system controller 150 can vent the space above the level of beer in the rack heat exchanger 54 at any desired time. This not only avoids above-described problems associated with head space, but it also permits easier cleaning. Specifically, when cleaning fluid is flushed through the system, the vent valve 115 and sensor 117 can be operated to ensure that the cleaning fluid contacts, flushes, and cleans all areas of the rack heat exchanger 54.

Many other venting assemblies and elements are well known to those skilled in the art and can be employed in place of the vent port 113, vent valve 115, and sensor 117 described above and illustrated in the figures. These other venting assemblies and elements fall within the spirit and scope of the present invention.

As an alternative to a venting assembly or device to address the problem of rack heat exchanger head space described above, the head space 110 can be filled or plugged with a block of material (not shown) having a shape matching the head space 110. Although many materials such as epoxy, plastic, and aluminum can be used, the block is preferably made of easily cleaned material such as brass, stainless steel, Teflon (® DuPont Corporation), or other food grade synthetic material, and preferably fully occupies all areas of the head space 110.

With combined reference to FIGS. 4 and 6, another important feature of the present invention relates to the maintenance of beer temperature in the nozzle assembly 40. As described above, the rack heat exchanger 54 of the present invention has a number of beer output ports 104 extending therefrom. Each nozzle assembly 40 has an input port 112 to which one of the beer output ports 104 connects in a conventional manner (preferably via conventional fittings). Each output port 104 is preferably made of a highly temperature conductive food grade material such as stainless steel. Most preferably, each input port 112 and the walls of the fluid holding chamber 80 in the nozzle assembly 40 are also made of highly temperature conductive food grade material.

The distance between the body of the rack heat exchanger 54 and the housing 66 of the nozzle assembly 40 is preferably as short as possible while still providing sufficient room for vessel placement and removal to and from the nozzle assembly 40. Preferably, this distance (in the preferred embodiment shown in the figures, the combined lengths of the beer output port 104 and the nozzle assembly input port 112 defining a fluid passage or fluid line between the body of the rack heat exchanger 54 and the nozzle assembly 40) is less than approximately 12 inches (30.5 cm). More preferably, this distance is less than 8 inches (20.3 cm). Most preferably however, this distance is between 1 and 6 inches (2.5-15.2 cm). The nozzle assembly 40 is therefore an extension of the heat exchanger.

The distance between the body of the rack heat exchanger 54 and the housing 66 of the nozzle assembly 40 is important for a particular feature of the present invention: maintaining the temperature of beer in the nozzle assembly 40 as near as possible to the temperature of beer exiting the rack heat exchanger 54. This function is also performed by the preferably thermally conductive material of the beer output port 104 and the nozzle assembly input port 112. Specifically, when beer flows through the nozzle assembly and is dispensed from the dispensing outlet 70, beer has an insufficient time to significantly change from its optimal drinking temperature controlled by the rack heat exchanger 54. When beer is not being dispensed from the nozzle assembly 40, it is most desirable to keep the beer at the optimal drinking temperature.

Prior art beer dispensers are either incapable of keeping beer in the nozzle sufficiently cold for an indefinite length of time or keeping this beer refrigerated in an efficient and inexpensive manner. However, in the present invention, the distance between the refrigerating element (i.e., the rack heat exchanger 54) and the fluid holding chamber 80 in the nozzle assembly 40 is preferably so short that fluid throughout the fluid holding chamber 80 is kept close to the temperature of beer at the rack heat exchanger 54 or exiting the rack heat exchanger 54 by convective recirculation. Specifically, beer in the body of the rack heat exchanger 34 or in the beer output port 104 of the rack heat exchanger 54 is normally the coldest from the rack heat exchanger to the dispensing outlet 70 of the nozzle assembly 40, while beer at the nozzle valve 48 is the warmest because it is farthest from a cold source. A temperature difference or gradient therefore exists between beer in the body of the rack heat exchanger 34 and beer at the terminal end of the nozzle assembly 40. By keeping the rack heat exchanger 34 close to the housing 66 of the nozzle assembly 40 as described above, cooled beer from around and within the beer output port 104 of the rack heat exchanger 34 moves by convection toward the fluid holding chamber 80. Because cold fluid tends to sink, the cold fluid entering the fluid holding chamber migrates to the lowest part of the fluid holding chamber 80—the location of the warmest beer in the nozzle assembly 40. The cold beer thereby mixes with and cools the warm beer. Because warm beer tends to rise, warm beer in the fluid holding chamber 80 rises therein to a location closer to the cold source (the rack heat exchanger 34). This convective recirculation fully effective to maintain beer in the nozzle assembly cold only for the relatively short distances between the rack heat exchanger 34 and the fluid holding chamber 80 described above. Although not required to generate the beer cooling just described, the preferred highly temperature conductive material of the beer output port 104, the nozzle assembly input port 112, and the walls of the fluid holding chamber 80 in the nozzle assembly 40 assist in distributing cold from the rack heat exchanger 34, down the beer output port 104 and nozzle assembly input port 112, and down the fluid holding chamber 80. Cold is therefore preferably distributed downstream of the rack heat exchanger 34 by convective recirculation and by conduction.

In the heat exchanger and nozzle assembly configuration described above and illustrated in the drawings, the rack heat exchanger 34 is capable of maintaining the temperature difference between beer in the rack heat exchanger 34 and beer in the fluid holding chamber to within 5 degrees Fahrenheit. Where exchanger-to-nozzle assembly distances are within the most preferred 1-6 inch (2.5-15.2 cm) range, this temperature difference can be maintained to within 2 degrees Fahrenheit. These temperature differences can be kept indefinitely in the present invention. Although prior art systems exist in which a more distant cold source run at a colder temperature is employed to cool downstream beer, such systems operate with mixed success at the expense of significant energy loss and inefficiency, overcooling beer, and creating large temperature gradients along the fluid path (in some cases even dropping the temperature of elements in the system below freezing)—results that render the preferred system temperature and pressure control of the present invention difficult or impossible.

As an alternative a mounted nozzle assembly such as nozzle assemblies 40 described above and illustrated in FIGS. 1-6, FIGS. 7 and 8 illustrate a portable nozzle assembly 46 in the form of a dispensing gun 16. With the exception of the following description, the dispensing gun 16 employs substantially the same components and connections and operates under substantially the same principles as the rack heat exchanger 34 and nozzle assemblies 40 described above.

The dispensing gun 16 has a gun heat exchanger 44 to which are connected the fluid lines 42 from the kegs 22. Like the rack heat exchanger 34, the gun heat exchanger 44 is preferably a plate heat exchanger having multiple beer input ports 114 and multiple beer output ports 116 corresponding to the different beers supplied to the dispensing gun 16, a refrigerant input port 118 and a refrigerant output port 120. The fluid lines 42 running from the kegs 22 to the dispensing gun 16 are each connected to a beer input port 114, while the refrigerant supply line 52 and the refrigerant return line 56 running between the refrigeration system 48 to the dispensing gun 16 are connected to the refrigerant input port 118 and the refrigerant output port 120, respectively. All of the connections to the gun heat exchanger 44 are conventional in nature and are preferably established by conventional fittings.

Like the rack heat exchanger 34, the gun heat exchanger 44 preferably has multiple fluid paths therethrough that are separate from one another and a refrigerant path that runs along each of the multiple fluid paths to the beers therein. Heat exchangers (and with reference to the illustrated preferred embodiment, plate heat exchangers) having multiple separate fluid compartments and paths are well known to those skilled in the art and are not therefore described further herein.

The gun heat exchanger 44 preferably has a multi-port beer output valve 122 for receiving beer from each of the beer output ports 116. The beer output ports 120 are preferably shaped as shown to run from the body of the gun heat exchanger 44 to the beer output valve 122 to which they are each connected in a conventional manner (such as by conventional fittings, brazing, and the like). Alternatively, the beer output ports 116 can be connected to the beer output valve 122 by relatively short fluid lines (not shown) connected in a conventional manner to the beer output ports 116 and to the beer output valve 122.

The beer output valve 122 is preferably electrically controllable to open one of the beer output ports 116 running from the gun heat exchanger 44 to the beer output valve 122.

Many different valve types capable of performing this function are well known to those skilled in the art. In the illustrated preferred embodiment, the beer output valve 122 is a conventional 4-input, 1-output rotary solenoid valve. The beer output valve 122 is preferably electrically connected to a control pad 124 preferably mounted on a face of the gun heat exchanger 44. Alternatively, the beer output valve 122 can be electrically connected to the controls 20 on the vending stand 10 via electrical wires (not shown) running along the fluid and refrigerant lines 42, 52, 56. In the preferred embodiment shown in the figures, the control pad 124 has buttons that can be pressed by a user to operate the beer output valve 122 in a conventional manner.

The nozzle assembly 46 of the dispensing gun 16 is substantially like the nozzle assemblies 40 of the dispensing rack 12 described above and operates in much the same manner. However, the housing 126 preferably has a dispense extension 128 extending from the dispensing outlet 130 thereof. The fluid exit port defined by the opening of the nozzle assembly from which beer exits the nozzle assembly is therefore moved a distance away from the dispensing outlet 130. When the nozzle valve 132 is moved toward and through the dispensing outlet 130 by the actuator 134 to dispense beer, beer flows through the dispensing outlet 130, into the dispense extension 128, and down into the vessel to be filled. The dispense extension 128 is used to help guide beer into the vessel, but is not a required element of the present invention. However, where the dispense extension 128, a trigger sensor 136, and a shutoff sensor 138 are used on the dispensing gun 16 (operated in the same manner as in the dispensing rack nozzle assembly 40 described above), the trigger sensor 136 and the shutoff sensor 138 are preferably mounted on the end of the dispense extension 128 as shown.

As an alternative to electronic or automatic control of the nozzle valve 132, it should be noted that the motion of the nozzle valve 132 can be manually controlled by a user if desired, For example, the user can manipulate a manual control such as a button on the dispensing gun 16 to mechanically open the nozzle valve 132. The nozzle valve can be biased shut by one or more springs, magnets, fluid pressure from the pressurized comestible fluid in the nozzle, etc. in a manner well known to those skilled in the art. By manipulating the manual control, the user preferably moves the nozzle valve 132 through its closed positions to lower pressure in the holding chamber 140, after which the nozzle valve 132 opens to dispense the beer at its lower pressure. As another example, the nozzle valve 132 can be actuated by a user manually as discussed above, after which time an actuator (of the type described earlier) controls how long the nozzle valve 132 remains open. It should also be noted that such manual control over nozzle valve 132 actuation can be applied to the nozzle valves 68 of the rack nozzle assemblies 40 in the same manner as just described for the dispensing gun 16.

In operation, a user grasps the dispensing gun 16 and moves the dispensing gun 16 over a vessel to be filled with beer. Preferably by operating the control pad 124 on the dispensing gun 16, the user changes the type of beer to be dispensed if desired. If the type of beer to be dispensed is changed, a signal is preferably sent from the control pad 124 directly to the beer output valve 122 (or from the control system in response to the control pad 124) to open the beer output port 116 corresponding to the beer selected for dispense. The dispensing gun 16 is then triggered either by user manipulation of a control on the control pad 124 or on the controls 20 of the vending stand, or most preferably by the trigger sensor 136 in the manner described above with regarding to the dispensing rack nozzle assemblies 40. At this time, the empty fluid holding chamber 140 is filled with the selected beer. Immediately thereafter or substantially simultaneous therewith, the nozzle valve 132 is preferably moved toward the dispensing outlet 130 to reduce the pressure in the holding chamber as described above.

Although not preferred, the fluid holding chamber 140 can be fitted with a vent port, valve, and sensor assembly operating the in the same manner as the vent port, valve, and sensor assembly 113, 115, 117 described above with reference to the rack heat exchanger 34. This assembly would preferably be located at the top of the fluid holding chamber 140 for venting the empty fluid holding chamber and to permit faster beer flow into the fluid holding chamber 140 from the beer output valve 122. Such an assembly could be manually controlled, but more preferably is electrically connected to the beer output valve 116, control pad 124, controls 20, or system controller 150 to open with the beer output valve 122 and to close after the fluid holding chamber is full or substantially full.

After the desired amount of beer has been dispensed into the vessel, the valve 132 preferably moves to close the dispensing outlet 130 and the beer output valve preferably moves to a closed position. Most preferably, the beer output valve 122 closes first to permit sufficient time for the fluid holding chamber 140 to empty. In this regard, the vent port, valve, and sensor assembly (not shown) mentioned above can be opened to assist in draining the fluid holding chamber 140. When the valve 132 is returned by the actuator 134 to close the dispensing outlet 130, the nozzle assembly 46 is ready for another dispensing cycle.

In the operation of the dispensing gun 16 as just described, the fluid holding chamber 140 is normally empty between beer dispenses. If such were not the case, beer held therein would be mixed with beer exiting from the beer output valve 122 in the next dispense. While this is not necessarily undesirable if the same beer is being dispensed in the next dispensing cycle, it is undesirable if a different beer is selected for the next dispensing cycle. Although not as desirable as the above-described operation, an alternative dispensing gun operation maintains beer within the fluid holding chamber 140 after each dispense by keeping the beer output valve open while the nozzle valve 132 is open and after the nozzle valve 132 is closed. Such dispensing gun operation is therefore much like the nozzle assembly operation of the dispensing rack nozzle assemblies 40 described above. The beer output valve 122 is preferably controlled by the system controller 150 to remain open through successive dispenses of the same beer. However, if another beer is selected for dispense via the control pad 124 or the vending stand controls 20, the fluid holding chamber 140 is purged of the beer therein before the next dispense. This purging can be performed by the system controller 150 via a user-operable control on the control pad 124 or vending stand controls 20 or automatically by the system controller 150 each time an instruction is received to actuate the beer output valve 122 to open a different beer output port 116. During a purging operation, the beer outlet valve 122 is closed and then the nozzle valve 132 is opened briefly to let the waste beer drain from the fluid holding chamber 140. Immediately thereafter, the actuator 134 preferably moves the nozzle valve 132 back to a closed position and the beer output valve 122 is actuated to open the beer output port 116 corresponding to the beer to be dispensed. Alternatively, the nozzle housing 126 can be provided with a conventional vent port and vent valve (not shown) which are preferably controlled by the system controller 150 to open to drain the beer in the fluid holding chamber 140 prior to opening the beer output valve 122. Whether drained by opening the nozzle valve 132 or by opening a vent valve in the nozzle housing 126, it is also possible to purge the fluid holding chamber 140 under pressure from the new beer selected for dispense by briefly opening the nozzle valve 132 or the vent valve while the beer output valve 122 is open.

Figure 7:
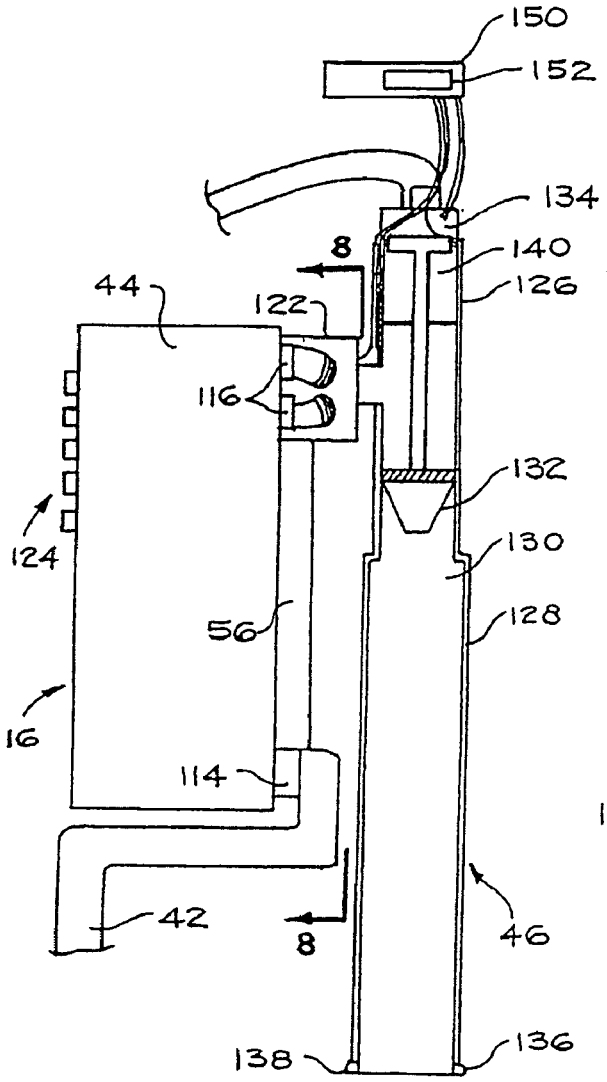
FIG. 7 is a side elevational cross section view of the dispensing gun shown in FIG. 1.
Figure 8:
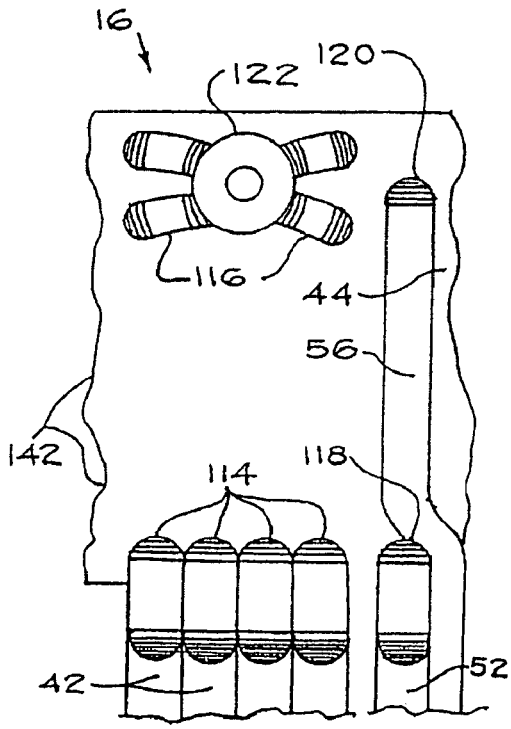
FIG. 8 is front elevational cross section view of the dispensing gun shown in FIG. 7, taken along lines 8-8 of FIG. 7.

In the most highly preferred embodiments of the dispensing gun 16 the beer output valve 122 is located immediately downstream of the heat exchanger as shown in FIGS. 7 and 8. Such a design minimizes the waste of beer from purging the dispensing gun 16 between dispenses of different beer types when the holding chamber 140 is filled with beer between dispenses. However, it is possible (though not preferred) to located the beer output valve 122 in another location between the keg 22 and the nozzle assembly 46. For example, a multi-input port, single output port valve can instead be located upstream of the gun heat exchanger 44. Preferably, all four fluid lines 42 would be connected in a conventional manner to input ports of the valve, which itself would be connected in a conventional manner to a beer input port of the gun heat exchanger 44. The valve would be controllable in substantially the same manner as the beer output valve 122 of the preferred dispensing gun embodiment described above. The advantage provided by this design is that the gun heat exchanger 44 only needs to have one beer fluid path therethrough because only one beer is admitted into the gun heat exchanger 44 at a time. This results in a simpler, less expensive, and easier to clean gun heat exchanger 44. However, the disadvantage of this design is that draining or purging the gun heat exchanger 44 between dispenses of different beers is more difficult. Where draining is not possible to empty the gun heat exchanger 44 and the nozzle assembly 46, the beer can be purged by flowing the newly-selected beer through the dispensing gun 16 or by pushing the beer through the heat exchanger 44 by compressed air or gas (e.g., supplied from the tank 24) via a pneumatic fitting on the gun heat exchanger 44. Although each purge does waste an amount of beer, the combined beer capacity in the gun heat exchanger 44 and the nozzle assembly 46 is relatively small.

The advantages provided by the dispensing gun 16 of the preferred embodiment described above and illustrated in the figures are much the same as those of the of the nozzle assembly 40 and heat exchanger 34 of the dispensing rack 12. For example, the pressure reduction control of beer within the holding chamber 140 of the nozzle assembly 46 prior to opening the dispensing outlet 130 provides fast flow rate with minimal foaming and carbonation loss. As another example, the close proximity of the nozzle assembly 46 to the gun heat exchanger 44 provides the same convective recirculation cooling effect as that of the dispensing rack nozzle assemblies described earlier, thereby keeping beer to a controlled cool temperature up to the dispensing outlet 130. It should be noted that the more compact nature of the dispensing gun 16 (when compared to the nozzle assemblies 40 of the dispensing rack 12) preferably provides for a shorter distance between the body of the gun heat exchanger 44 and the housing 126 of the nozzle assembly 46. This distance is preferably between 1-6 inches (2.5-15.2 cm), but more preferably is between approximately 1-3 inches (2.5-7.6 cm). By virtue of the shorter distances, the maximum temperature difference between the beer in the fluid holding chamber 140 and beer at the gun heat exchanger 44 is less than about 10 degrees Fahrenheit, and more preferably is less than about 5 degrees Fahrenheit. Still shorter heat exchanger-to-nozzle assembly distances are possible to result in narrower temperature differences when the size of the components in the dispensing gun 16 are smaller. Most preferably, the nozzle assembly of the dispensing gun 16 is substantially the same size as the nozzle assembly 40 in the dispensing rack 40. However, if desired, smaller nozzle assemblies and smaller heat exchangers can be used in the dispensing gun 16 at the expense of cooling rate and/or flow rate. It should also be noted that the refrigeration system control and operation discussed above with reference to FIG. 5 applies equally to cooling operations of the gun heat exchanger 44.

The relative orientation of the gun heat exchanger 44 and the nozzle assembly 46 as shown in FIGS. 7 and 8 are not required to practice the present invention. The arrangement illustrated, with the gun heat exchanger 44 alongside the nozzle assembly 46, with hand grip forms 142 on the sides of the gun heat exchanger 44, etc. is presented only as one of many different relative orientations of the gun heat exchanger 44 with respect to the nozzle assembly 46. One having ordinary skill in the art will recognize that many other relative orientations are possible, such as the nozzle assembly 46 being oriented at an angle (e.g., 90 degrees) with respect to its position shown in FIG. 7 and with beer exiting from the beer output valve 122 to the nozzle assembly 46 via an elbow pipe. This and other dispensing gun arrangements fall within the spirit and scope of the present invention.

In addition to these advantages provided by the dispensing gun 16, an equally significant advantage is the fact that the dispensing gun 16 is hand-held and portable. Although dispensing guns are known in the art for dispensing various comestible fluids, their use for many different applications has been very limited. A primary limitation is due to the tact that comestible fluids in prior art dispensing gun lines will become warm after a period of time between dispenses. With no way to cool this comestible fluid before it is dispensed, the vendor must either waste the warmed fluid or attempt to serve it to a customer. In short, dispensing guns for many comestible fluids are not acceptable due to the chance of fluid warming in the lines between dispenses. This is particularly the case for comestible fluids such as beer that are generally not served over ice. The dispensing gun 16 of the present invention addresses this problem by providing a cooling device (the gun heat exchanger 44) at the dispensing gun 16. Therefore, even if comestible fluid becomes warm in the fluid lines 42, the same fluid exits the dispensing gun 16 at a desired and controllable cold temperature. For applications in which a large amount of time can pass between comestible fluid dispenses, the fluid lines 42 are preferably drawn into and stored within a refrigerated storage as described above. The only limitation on use of the dispensing gun 16 to dispense comestible fluids is therefore the spoil rate of the comestible fluid in its storage vessel (keg 22).

The dispensing gun 16 described above and illustrated in the figures is a multiple-beer dispensing gun. It should be noted, however, that the dispensing gun 16 can be adapted to dispense only one beer. Specifically, the beer gun 16 can have one beer input port 114 to which one fluid line 42 running to a keg 22 is coupled in a conventional manner. Such a dispensing gun 16 would therefore preferably have one beer output port 116 running directly to the nozzle assembly 46, and would not therefore need to have the beer output valve 122 and associated wiring employed in the dispensing gun 16 described above. The dispensing gun 16 would operate in substantially the same manner as a heat exchanger 34 and nozzle assembly 40 of the dispensing rack 12, with the exception of only one fluid line, one beer input port, and one beer output port associated with the heat exchanger. Preferably however, the dispensing gun 16 would at least have a manual dispense button (not shown) for manually triggering the actuator 134 to open the dispense outlet 130. The dispensing gun of the preferred illustrated embodiment is capable of selectively dispensing any of four beers supplied thereto.

However, following the same principles of the present invention described above, any number of beers can be supplied to a dispensing gun 16 for controlled dispensed therefrom (of course, calling for different numbers of ports and different valve types depending upon the number of beers supplied to the dispensing gun 16). The alternative embodiments of the elements and operation described above with reference to the rack heat exchanger 34 and the nozzle assemblies 40 of the dispensing rack 12 apply equally as alternative embodiments of the dispensing gun 16.

Conversely, the dispensing rack 14 described above can be modified to operate in a manner similar to the multi-fluid input, single output design of the dispensing gun 16. Specifically, rather than have a dedicated nozzle assembly 40 for each beer output port 104 as described above and illustrated in the figures, the dispensing rack 14 can have a beer outlet valve to which the beer outlet ports 104 are connected in a manner similar to the beer outlet valve 122 of the dispensing gun 16. The nozzle assembly 40 would preferably be similar and would operate in a similar manner to the nozzle assembly 46 of the dispensing gun 16 illustrated in FIG. 7. However, the controls for such a system would preferably be located at the vending stand controls 20 rather than on the rack heat exchanger 34. The alternative embodiments of the elements and operation described above with reference to the dispensing gun 16 apply equally as alternative embodiments of the rack heat exchanger 34 and nozzle assembly 40.

Figure 9:
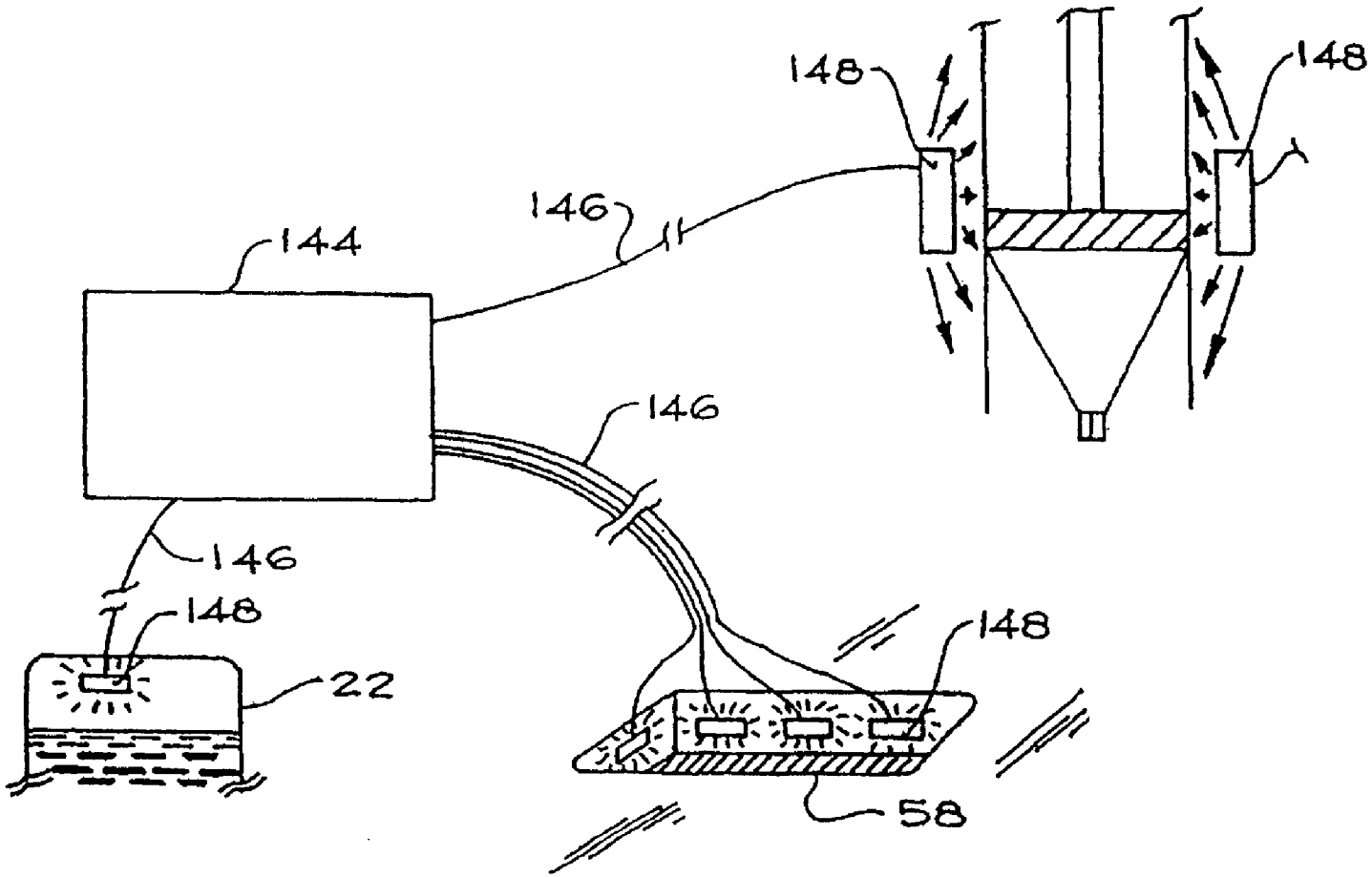
FIG. 9 is a schematic view of a sterilizing system according to a preferred embodiment of the present invention.
Figure 10:
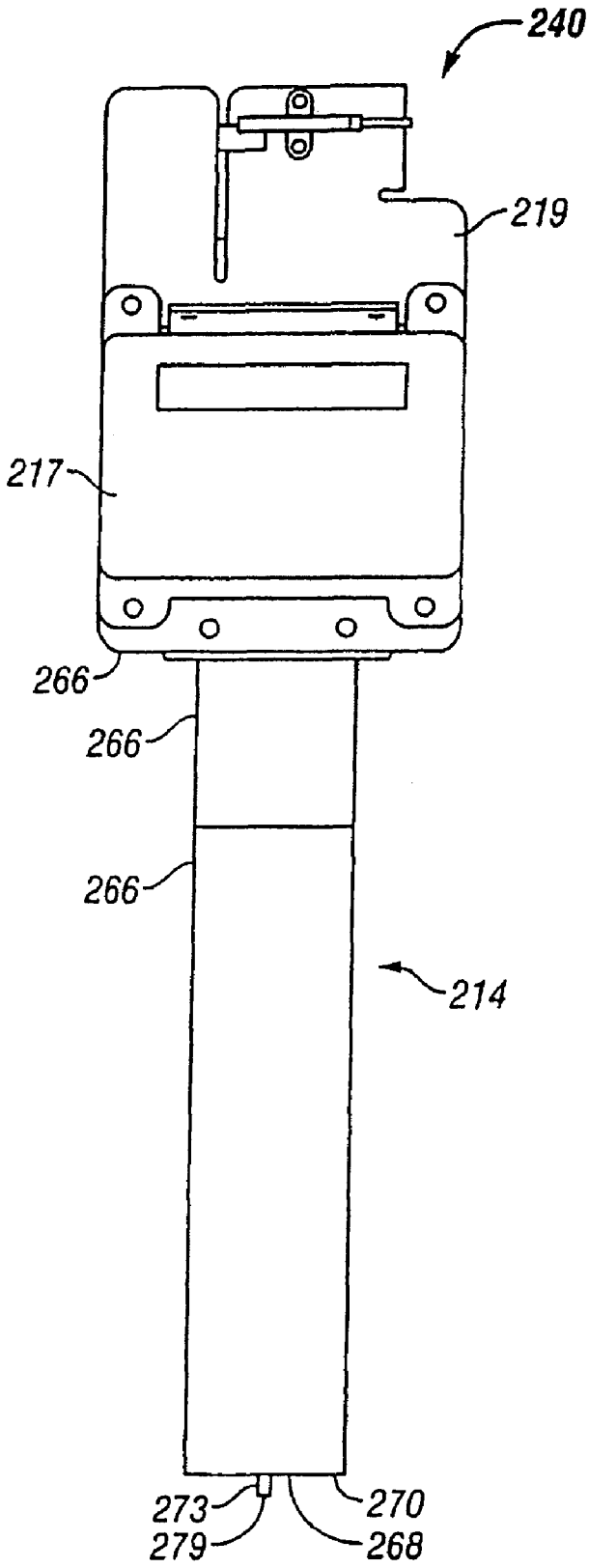
FIG. 10 is an front elevational view of a rack nozzle assembly according to another preferred embodiment of the present invention.

As mentioned above, a significant problem in existing comestible fluid dispensers is the difficulty in keeping the fluid dispenser clean. Many comestible fluids (including beer) are particularly susceptible to bacterial and other microbiological growth. Therefore, those areas of the fluid dispensers that come into contact with comestible fluid at any time during dispenser operation should be thoroughly and frequently cleaned. However, even thorough and frequent cleaning is occasionally inadequate to prevent comestible fluid spoilage and contamination. Particularly in those preferred embodiments of the present invention that rely upon subsurface filling of comestible fluid, it is highly desirable to provide a manner by which surfaces exposed to air are constantly or very frequently sterilized. An apparatus for performing this function is illustrated in FIG. 9. This apparatus relies upon ultraviolet light to sterilize surfaces of the dispensing system in the present invention, and includes an ultraviolet light generator 144 powered in a conventional manner and connected to different areas of the dispensing system. By way of example only, the ultraviolet light generator 144 of FIG. 9 is shown connected to a nozzle assembly 40 in the dispensing rack 12 and to the top of the rack heat exchanger 34.

Conventional ultraviolet light sterilizing devices have been limited in their application due in large part to space requirements of such devices. However, this problem is addressed in the present invention by the use of conventional fiber optic lines 146 transmitting ultraviolet light from the ultraviolet light generator 144 to the surfaces to be sterilized. Ultraviolet light generators and fiber-optic lines are well known to those skilled in the art, as well as the manner in which fiber-optic lines can be connected to a light source for transmitting light to a location remote from the light source. Accordingly, at least one fiber-optic line 146 is connected in a conventional manner to the ultraviolet light generator 144, and is secured in place in a conventional manner on or adjacent to the surface upon which the ultraviolet light is to be shed. In a preferred embodiment of the present invention, two fiber-optic lines 146 run from the ultraviolet light generator 144 (which can be located within the vending stand 10 or in any other location as desired) to locations beside the housing 66 of the nozzle assembly 40 in the dispensing rack 12. The fiber-optic lines 146 preferably terminate at distribution lenses 148 that distribute ultraviolet light from the fiber-optic lines 146 to the exterior surface of the housing 66. Distribution lenses 148 and their relationship to fiber-optic lines to distribute light emitted from fiber-optic lines is well known to those skilled in the art and is not therefore described further herein. Most preferably, a number of fiber-optic lines 146 run from the ultraviolet light generator 144 to distribution lenses 148 positioned and secured in a conventional about the outer surface of the housing 66. The number of fiber-optic lines 146 and distribution lenses 148 positioned about the housing 66 is determined by the amount of surface desired to be sterilized, but preferably is enough to shed ultraviolet light upon the entire outside surface of the housing 66.

As also shown in FIG. 9, a series of fiber-optic lines 146 preferably run to distribution lenses 148 mounted in a conventional manner within the holder 58 for the dispensing gun 16. Although it is possible to run fiber-optic lines to the dispensing gun 16 itself, more preferably the fiber-optic lines 146 run to the dispensing gun holder 58. Like the distribution lenses 148 about the nozzle assembly 40, the distribution lenses 148 shown on the holder 58 of the dispensing gun 16 receive ultraviolet light from the fiber-optic lines 146 and disperse the ultraviolet light received. In this manner, the fiber-optic lines 146 shed ultraviolet light upon the surfaces of the dispensing gun 16 (and most preferably, the exterior surfaces of the nozzle housing 66).

Fiber-optic lines can be run to numerous other locations in the dispensing system to sterilize surfaces in those locations. As shown in FIG. 9, fiber-optic lines can be run to one or more distribution lenses located at the top of the kegs 22 to sterilize interior surfaces defining head spaces therein. Fiber-optic lines can also or instead run to distribution lenses mounted in locations around the nozzle housing 126 and the dispense extension 128 of the dispensing gun 16, to locations around the dispensing outlets 70, 130 to sterilize the interior ends of the nozzle housings 66, 126, to locations within or at the end of the dispense extension 128 of the dispensing gun 16 to sterilize the interior surfaces thereof, etc. Any place where a head space forms in the dispensing systems of the present invention (and those of the prior art as well) are locations where fiber-optic lines can be run to shed sterilizing ultraviolet light upon head space surfaces.

It should be noted that although distribution lenses 148 are preferred to distribute the ultraviolet light from the fiber-optic lines 146 to a surface to be sterilized, distribution lenses are not required to practice the present invention. Ultraviolet light can instead be transmitted directly from the fiber-optic line 146 to the surface to be sterilized. In such a case, the amount of surface area exposed to the ultraviolet light can be significantly smaller than if a lens 148 is used, but may be particularly desirable for sterilizing surfaces in relatively small spaces. Also, fiber-optic lines 146 represent only one of a number of different ultraviolet light transmitters that can be used in the present invention. For example, the fiber-optic lines 146 can be replaced by light pipes if desired. As is well known to those skilled in the art, light pipes have the ability to receive light and to distribute light radially outwardly along the length thereof. This light distribution pattern is particularly useful in shedding sterilizing ultraviolet light upon a number of surfaces in manners not possible by fiber optic lines. For example, the fiber-optic lines 146 running to the housings 66, 126 of the nozzle assemblies 40, 46 can be replaced by conventional light pipes which are wrapped around the nozzle assemblies 40, 46 or which run alongside the nozzle assemblies 40, 46. Light pipes can be run to any of the locations previously described with reference to the fiber-optic lines, and can even be run through the fluid lines of the system to sterilize inside surfaces thereof; if desired.

The number and locations of the fiber-optic lines 146 and the distribution lenses 148 shown in FIG. 9 are arbitrary and are shown by way of example only. It will be appreciated by one having ordinary skill in the art that any number of fiber-optic lines, distribution lenses, light pipes, or other ultraviolet light transmitting devices can be used in any desired location within or outside of the comestible fluid dispensing apparatus.

To further facilitate easy and thorough cleaning of the present invention, all components of the fluid system are preferably made of a food grade metal such as stainless steel or brass, with the exception of seals, fittings, and valve components made from food grade plastic or other synthetic material as necessary. In highly preferred embodiments of the present invention, the exterior surfaces of the nozzle housings 36, 126 and the dispense extension 128 are coated with Teflon® (DuPont Corporation) to facilitate better cleaning. If desired, other surfaces of the apparatus that are susceptible to bacteria or other microbiological growth can also be Teflon®-coated, such as the inside surfaces of the nozzle housings 36, 126 and the dispense extension 126, the surfaces of the nozzle valves 68, 132, and the like.

Another embodiment of the nozzle assembly according to the present invention is illustrated in FIGS. 10-16. The nozzle assembly (indicated generally at 240) employs much of the same structure and has many of the same operational features as the nozzle assemblies 40, 140 described above and illustrated in FIGS. 1-9. Accordingly, the following description of nozzle assembly 240 focuses primarily upon those elements and features of the nozzle assembly 240 that are different from the embodiments of the present invention described above. Reference should be made to the above description for additional information regarding the elements, operation, and possible alternatives to the elements and operation of the nozzle assembly 240 not discussed below. Elements and features of the nozzle assembly 240 corresponding to the earlier-described nozzle assemblies 40, 140 are designated hereinafter in the 200 series of reference numbers.

Figure 16:
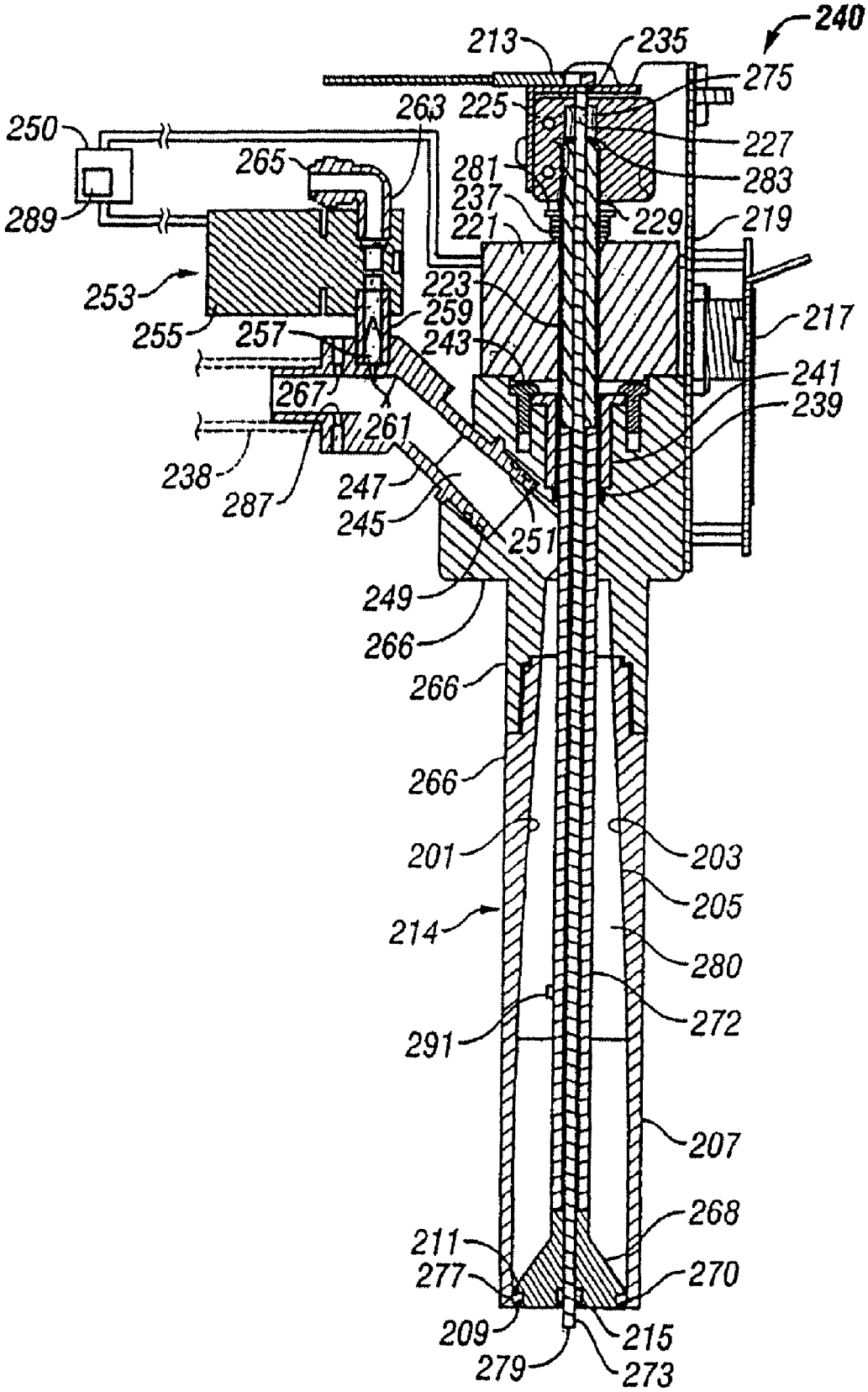
FIG. 16 is a left side elevational view, in cross section, of the rack nozzle assembly shown in FIGS. 10-15, taken along lines 16-16 of FIG. 13.

Some preferred embodiments of the present invention include a nozzle assembly 240 having a housing 266 with internal walls 201 through which fluid flows to the dispensing outlet 270. The housing 266 at least partially defines a nozzle 214 through which fluid to be dispensed passes. At least a portion of the nozzle 214 is preferably generally tubular in shape. A number of different manners exist for reducing the velocity of fluid in the nozzle assembly 240 prior to dispense (for increased control over fluid dispense). In the nozzle assembly 240, velocity of fluid passing through the housing 266 is reduced by the shape of the internal walls 201 as best seen in FIG. 16. Specifically, the internal walls 201 preferably define an increasing cross sectional area of the internal chamber 280 with increased proximity to the dispensing outlet 270 of the nozzle assembly 240 along at least a portion of the length of the internal chamber 280. In other words, fluid flowing through the nozzle 214 from one end of the internal chamber 280 to another passes through at least one portion of the chamber 280 having an increasing cross sectional area. The velocity of fluid traveling to the dispensing outlet 270 therefore decreases prior to dispense.

The portion of the internal chamber 280 having an increasing cross sectional area as just described is a diffuser 205 of the nozzle assembly 240. The diffuser 205 has an increasing cross sectional area between an entrance and an exit of the diffuser. The cross sectional area of the diffuser entrance is therefore smaller than the cross sectional area of the diffuser exit. The diffuser 205 is preferably tubular in shape, can define any portion or all of the internal chamber 280, and can be located at any point along the length of the internal chamber 280 and nozzle 214. Because the internal chamber 280 and nozzle 214 can have virtually any shape, the term "length" and related terms (such as "long", "longitudinal", "along", etc.) as used herein are defined by the fluid flow path through the internal chamber 280 to the dispensing outlet 270. "Length" and its related terms therefore do not imply that the internal chamber 280 or diffuser 205 must be straight as illustrated in FIG. 16. The length of the internal chamber 280 can be the same size, larger, or smaller than the cross sectional width of the internal chamber 280 depending at least partially upon the chamber shape 280. In this regard, the internal chamber 280 need not necessarily even have an axis, be symmetrical in any manner, or be elongated as shown in FIG. 16. Similarly, the diffuser 205 can take virtually any shape limited only by its increasing cross sectional area described above. By way of example only, the diffuser 205 can take any longitudinal shape (from an elongated shape to a relatively short shape), can have walls diverging at any angle (from rapidly diverging or stepped walls to walls that diverge very gradually), and the like.

In the highly preferred embodiment shown in FIGS. 10-16, the diffuser 205 is generally frusto-conical and elongated in shape with internal walls 203 that diverge toward the dispensing outlet 270. Preferably, the internal walls 203 of the diffuser 205 are relatively straight and diverge gradually as shown in FIG. 16. However, subject to the limitation that the diffuser walls 203 define an increasing internal chamber cross sectional area, the diffuser walls 203 can take any shape desired, including without limitation stepped walls, bowed or curved walls (possible with convex, concave, or a combination of convex and concave walls), faceted walls, and the like. The diffuser 205 therefore does not need to define a linearly or gradually increasing internal chamber cross sectional area. Instead, the cross sectional area in the diffuser 205 can increase non-linearly, in a graduated or staged manner, or in any other manner desired. In some highly preferred embodiments of the present invention such as that shown in FIGS. 10-16, at least a portion of the walls 203 of the diffuser 205 are disposed at an angle with respect to the axis of the diffuser 205 (for diffusers having a longitudinal axis) of between 1 and 30 degrees.

The cross sectional shape of the diffuser 205 can be any shape desired, including without limitation round, square, rectangular, oval, and the like. In addition, the diffuser 205 need not necessarily have a symmetrical cross sectional shape (whether about a plane or an axis), and can have a cross sectional shape that varies in any manner along the length of the diffuser 205. However, some highly preferred embodiments of the present invention have a diffuser 205 with a generally round cross sectional shape along the length of the diffuser 205.

As mentioned above, the diffuser 205 can define all or part of the internal chamber 280 and can be located at any point therealong. In some highly preferred embodiments such as the embodiment shown in FIGS. 10-16, the diffuser 205 is located a distance upstream of the dispensing outlet 270. Locating the diffuser 203 in this manner provides improved fluid flow and dispensing results. Most preferably, the portion of the internal chamber 280 between the diffuser 203 and the dispensing outlet 270 has a substantially constant cross sectional area. This downstream portion 207 of the internal chamber 280 preferably abuts or is immediately adjacent to the diffuser 203. Although the downstream portion 207 of the internal chamber 280 can take any shape and can have a varying shape along its length in the same manner as described above with reference to the diffuser 205, the downstream portion 207 is preferably round along its length from the diffuser 203 to the dispensing outlet 270. Also, the downstream portion 207 of the internal chamber 280 is preferably relatively elongated, but can instead take any length desired.

The diffuser 205 can run any length or all of the internal chamber 280. Preferably however, the diffuser 205 is at least half the length of the internal chamber 280. More preferably, the diffuser 205 is least two-thirds the length of the internal chamber 280. Most preferably, the diffuser 205 is about two-thirds the length of the internal chamber 280. In those highly preferred embodiments of the present invention having a downstream internal chamber portion 207 with a substantially constant cross sectional area as described above, the diffuser 205 is at least the same length as the downstream portion 207. More preferably, the diffuser 205 is at least twice as long as the downstream portion 207. Most preferably, the diffuser 205 is about twice as long as the downstream portion 207.

The housing 266 of the nozzle assembly 240 (including the diffuser 205, the internal chamber 280, and the downstream portion 207) can be a single integral element or can be assembled from any number of parts connected together in any conventional manner such as by threaded connections, press fitting, welding, brazing, by one or more conventional fasteners, and the like. In one highly preferred embodiment illustrated in FIGS. 10-16, most of that portion of the nozzle assembly 240 having the internal chamber 280 is removable by a threaded and gasketed connection with the remainder of the nozzle assembly 240.

The valve 268 of the preferred embodiment illustrated in FIGS. 10-15 can take any of the forms described above with reference to the nozzle assemblies 40, 140 of the earlier-described embodiments. For example, the valve 268 can be a plunger valve that seals against internal walls 201 of the internal chamber 280 and that provides such a seal over some length of the valve's movement prior to opening. Alternatively, the valve 268 can be a pinch valve, diaphragm valve, ball valve, rotary valve, spool valve, and the like. Such valve types and their operation, movement, and actuation are well known to those skilled in the art and are not therefore described further herein.

Most preferably however, the valve 268 is a plug-type valve movable in telescoping relationship in the nozzle 215 between open and closed positions without a significant range of sealed positions. The desirable fluid velocity reduction prior to fluid dispense from the dispensing outlet 270 (described in detail above) is generated by the diffuser 205 in the internal chamber 280. If desired, manipulation of pressure can be performed in any of the manners described above. For example, fluid pressure in the internal chamber 280 can be reduced by temporarily opening one or more purge valves in fluid communication with the internal chamber 280 prior to or during fluid dispense from the dispensing outlet 270, by employing a valve 268 having a range of closed positions and that therefore increases the size of the internal chamber 280 as it is opened, and/or by any of the other manners discussed with reference to the earlier-described embodiments of the present invention. Where a valve having a range of closed positions is used, the valve can telescope within the nozzle 215 in much the same manner as the valves 68, 168 of the earlier-described nozzle assembly embodiments, and more preferably telescopes within a tubular portion of the nozzle 215.

In the illustrated preferred embodiment, the valve 268 has a generally inverted cone shape that seals the dispensing outlet at a periphery of the valve 268. Although any other valve shape can be used (including without limitation a substantially flat plate, a spherical member, a cylindrical plug, and the like), the inverted cone shape provides exceptional fluid dispensing results. The valve 268 need not be symmetrical in any manner. However, the valve shape in some preferred embodiments of the present invention is substantially symmetrical about at least one plane passing longitudinally through the center of the valve 268, and more preferably about two or more different planes passing through the center of the valve 268. Most preferably (as is the case with the inverted cone shape described above and illustrated in FIG. 16), the valve shape is substantially symmetrical about an axis passing longitudinally through the center of the valve 268.

Valve symmetry about a plane, multiple planes, or an axis as just described helps to center the valve 268 and valve rod 272 in the internal chamber 280 by opposing fluid pressures and flow on opposite sides of the valve 268. This valuable function provides improved control and predictability over fluid exiting the dispensing outlet 270 (in some highly preferred embodiments, fluid exits uniformly or nearly uniformly around the valve 268 or on opposing sides of the valve 268), helps to guide movement of the valve 268 as it opens, and provides for more reliable and controllable valve closure. In some embodiments of the present invention such as where different internal chamber shapes and orientations produce non-uniform flow to the valve 268, valve symmetry will not generate these results and is therefore a less important design consideration.

In some embodiments of the present invention (not shown), the valve 268 is maintained in a desired position in the internal chamber 280 by one or more conventional valve rod guiding elements such as one or more arms, bosses, spokes, and the like extending into the internal chamber 280 from the housing 266 and guiding the valve rod 272 to which the valve 268 is connected. These guiding elements can be used to center the valve or to maintain the valve in any other position in the internal chamber 280.

In those highly preferred embodiments where an inverted generally cone-shaped valve 268 is employed, the fluid-contacting sides of the valve 268 can be relatively straight, but more preferably are at least slightly bowed outward (convex into the fluid and fluid flow past the valve 268). Outwardly-bowed valve sides contribute to superior flow control and dispense for a number of different fluid types such as relatively light beer or other relatively light comestible fluids. In other preferred embodiments, the fluid-contacting sides of the valve 268 can be at least slightly bowed inward (concave away from the fluid and fluid flow pas the valve 268). Inwardly-bowed valve sides contribute to superior flow control and dispense for a number of different fluid types such as relatively heavy beer or other relatively heavy comestible fluids.

Although not required to practice the present invention, the valve 268 and/or dispensing outlet 270 is preferably fitted with a gasket 209 for an improved seal when the valve 268 is closed. The gasket 209 is preferably an O-ring made of any suitable resilient elastomeric material such as rubber or urethane. In some highly preferred embodiments, the gasket 209 is located on the valve 268, and is retained thereon by being received within a groove 211 in the valve 268. In alternative embodiments, the gasket 209 can be retained upon the valve 268 by one or more clips on the valve 268, by being glued or press-fit upon the valve 268, or in any other conventional manner.

Most preferably, the gasket 209 is capable of deforming under fluid pressure to generate an improved fluid-tight seal between the valve 268 and the internal walls of the dispensing outlet 270. Specifically, when the valve 268 is closed, the gasket 209 is preferably pressed into the seam defined between the valve 268 and the internal walls of the dispensing outlet 270 by pressure from the fluid in the internal chamber 280. Accordingly, in some preferred embodiments, the gasket 209 is preferably movable with respect to the valve 268 and dispensing outlet 270 rather than being rigidly secured to either element. For example, where the gasket 209 is located in a groove 211 in the valve 268 or in an internal wall of the dispensing outlet 270, the gasket 209 is preferably received therein with a clearance or looser fit to permit movement of the gasket 209 with respect to the valve 268 and dispensing outlet 270.

In some highly preferred embodiments where the gasket 209 is received or seated within one or more elements (e.g., a groove, clips, etc.) in the valve 268 or dispensing outlet 270, the gasket 209 is preferably at least partially unseated by the fluid pressure and deforms to the shape of the interface between the valve 268 and dispensing outlet 270 as described above. When the fluid pressure upon the gasket 209 is released, such as when the valve 268 is opened, the gasket 209 preferably returns to its seated position on the valve 268 or dispensing outlet 270 by virtue of its resilient elastomeric material.

Although the end of the dispensing outlet 270 can be defined by a straight tubular end of the internal chamber walls 201, the end of the walls 201 (at the dispensing outlet 270) more preferably is internally chamfered to present outwardly-diverging walls of the dispensing outlet 270. The chamfered terminal portion 277 of the dispensing outlet 270 is preferably no greater than a 0.25 inches (measured parallel to the valve path of motion), and assists in sealing the valve 268. Specifically, the gasket 209 preferably seats against the chamfered terminal portion 277 or passes the chamfered terminal portion 277 upon valve closure to help generate a more reliable and reproducible fluid-tight seal. In addition; the chamfered terminal portion 277 helps to produce a smooth and controlled exiting flow from the dispensing outlet 270.

It should be noted that instead of or in addition to a gasket 209 located on the valve 268, a gasket 209 can be located on the interior walls of the dispensing outlet 270, and can be retained thereon in any of the manners described above with reference to the gasket 209 on the valve 268.

As mentioned above, the valve 268 is preferably a plug-type valve, and can be replaced by a number of different valve types, each of which is conventional in nature and operation, can be actuated in a number of different conventional manners, and falls within the spirit and scope of the present invention. In the highly preferred embodiment illustrated in FIGS. 11-16, the valve 268 is actuated between its opened and closed positions by a valve rod 272 passed through the internal chamber 280. The valve rod 272 can be solid, but more preferably is hollow as best shown in FIG. 16.

Where one or more sensors are attached to the valve 268 for triggering the valve 268 to open or close, sensor wiring can extend from the valve 268, through the hollow valve rod 272 and to a location outside of the internal chamber 280. Alternatively (and as shown in FIGS. 10-16), a sensor rod 273 can extend through the valve rod 272 to a location outside of the internal chamber 280 and can be used as a trigger element in a number of different conventional manners. Specifically, the sensor rod 273 can be movable within the valve rod 272 to respond to pressure on an end 279 thereof extending from the valve 268. When pressure upon the sensor rod 273 is exerted, such as from contact with the bottom of a glass, pitcher, or other container, the sensor rod 273 can move to trip a conventional sensor 213 mounted on the nozzle assembly 240. In such case, the sensor rod 273 preferably moves under opposing bias force exerted by one or more biasing elements such as springs or a pair of opposing magnets attached to the sensor rod 273 and a frame or body of the nozzle assembly 240, and the like. Most preferably, a conventional coil spring 275 is attached to or otherwise mounted upon an end of the sensor rod 273 opposite the valve 268 to bias the sensor rod 273 back to its initial position after removal of the glass, pitcher, or other container.

The sensor rod 273 can take a number of other forms capable of detecting the presence of a glass, pitcher, or other container, some of which do not require movement of the sensor rod 273 and are therefore preferably not biased toward a position as described above. For example, the sensor rod 273 can be or include a pressure transducer triggered by contact with the container, an optical sensor for detecting the proximity of the container, and the like. Such other sensor rod types fall within the spirit and scope of the present invention, are well known to those skilled in the art, and are not therefore described further herein.

The sensor rod 273 can be accompanied by one or more other sensors on the valve 268 and/or on the dispensing outlet 270 or housing 266. These sensors and their manner of connection are discussed in greater detail with regard to the nozzle assemblies 40, 140 described above. In some preferred embodiments, the aperture through the valve rod 272 is sufficiently large to receive the sensor rod 273 and wiring for one or more sensors on the valve 268.

In those embodiments where a sensor rod 273 and/or sensor wiring is passed through the valve rod 272, the nozzle assembly 240 preferably has one or more conventional gaskets 215 sealing the sensor rod 273 and wiring from fluid leakage up the valve rod 272. These gaskets 215 are preferably elastomeric O-rings, but can instead be any other type of conventional gasket or sealing material capable of performing this function. In other embodiments of the present invention not employing a sensor rod 273 or sensor wiring through the valve rod 272 (e.g., instead having sensors mounted upon the dispensing outlet 270 with wiring passed up the side of the housing 266), such gaskets 215 are not used.

To open and close the valve 268 for a fluid dispensing operation, the sensor rod 273 preferably contacts the container into which the fluid is to be dispensed, thereby generating movement of the sensor rod 273, triggering of the sensor 213, and opening of the valve 268 in a manner to be discussed in more detail below. Where the sensor rod 273 is or has another type of sensor, the sensor rod 273 can detect the container in other manners such as by pressure, by optical detection, etc.

In some preferred embodiments, the sensor rod 273 can also or instead cause the valve 268 to close. For example, when pressure upon the sensor rod 273 is lost, the sensor rod 273 can spring back to its original position, thereby triggering the sensor 213 and causing the valve 268 to close. Where the sensor rod 273 is or has another type of sensor, the sensor rod 273 can detect loss of contact with the container in other manners such as by loss of pressure upon a pressure transducer, by losing optical detection of the container, etc.

In the above-described examples where the sensor rod 273 causes the valve 268 to close, the valve 268 is open only for so long as the sensor rod 273 is in contact with or is near the container surface. Although capable of causing the valve 268 to close in this manner, more preferred embodiments of the present invention employ other manners to close the valve 268. In some highly preferred embodiments such as that shown in FIGS. 10-16, the valve 268 is opened for a set time controlled by a system controller 250 (shown schematically in FIG. 16) or timer, after which time the valve 268 is automatically shut. This time can be pre-set or pre-programmed with a timer 289 associated with the controller 250, and in some preferred embodiments can be selected by a user via controls 220 (not shown in FIGS. 10-16) for different amounts of dispense in a manner well known to those skilled in the art. In some highly preferred embodiments, the timer 289 can be used in conjunction with a pressure sensor for improved dispense control. Specifically, a pressure sensor 291 can be mounted in a conventional manner in the internal chamber 280 or in a location upstream of the internal chamber 280. The fluid pressure measured by the pressure sensor 291 is preferably transmitted to the controller 250 and is used by the controller 250 to determine how long the valve 268 should be kept open for a desired amount of fluid dispense. As discussed in more detail with reference to the earlier-described nozzle assemblies 40, 140, because the size of the dispensing outlet 270 and the fluid pressure measured by the pressure sensor 291 is known, the controller 250 can control the amount of fluid dispensed from the dispensing outlet 270 by controlling the length of time the valve 268 is open. Such controllers and controller operation are well known to those skilled in the art and are not therefore described further herein.

In other embodiments of the present invention where the sensor rod 273 has an optical sensor, a signal can be sent from the sensor rod 273 to close the valve 268 when the sensor rod 273 is removed from dispensed fluid in the container and such a condition is detected by the optical sensor.

Still other manners of triggering closure of the valve 268 are possible and are discussed above with reference to the earlier-described nozzle assemblies 40, 140. These alternative nozzle assemblies may or may not have a sensor rod 273, and can instead have one or more sensors of any type as also described earlier. For example, one sensor can be triggered to open the valve 268 while another sensor of the same or different type can be triggered to close the valve 268. One or both sensors can be mounted upon the valve 268 or upon the end of the dispensing outlet 270. As another example, one sensor is used to trigger opening and closing of the valve 268, and can be one of a number of different types (including without limitation a pressure transducer for contact with a surface of the container to be filled and which maintains the valve 268 open only for so long as such contact is maintained, an optical sensor which sends a signal to open the valve 268 only when a container surface is detected within a desired range of the sensor, and the like) mounted upon the valve 268 or dispensing outlet 270. As described earlier, this sensor is not necessarily on a sensor rod 273, and can rely only upon transmission of signals (e.g., wiring up the nozzle assembly body 266) rather than upon any mechanical movement to control operation of the valve 268.

The highly preferred nozzle assembly embodiment shown in FIGS. 10-16 also includes a nozzle assembly frame 219 upon which various components of the nozzle assembly 240 can be mounted and relatively positioned. The frame 219 is preferably a plate having portions bent or otherwise shaped to permit mounting of the nozzle assembly components thereto, although a substantially flat plate is possible depending upon component shape and size. Also, the frame 219 can instead be defined by any number of beams, rods, bars, plates, or other structural elements connected together and to the nozzle components for the same purpose. Components of the nozzle assembly 240 are preferably mounted to the frame 219 by conventional threaded fasteners, but can instead be mounted thereto in any other conventional manner such as by welding, brazing, adhesive, clamps, interconnecting shapes on facing frame and component surfaces, and the like. It should be noted that the nozzle assembly 240 need not necessarily have a frame 219, and can instead be assembled by connecting the various nozzle assembly components directly to one another. However, a frame 219 is preferred because it permits easy assembly, service, and maintenance of the nozzle assembly 240.

The nozzle assembly 240 illustrated in FIGS. 10-16 provides another example of where the nozzle assembly controls 220 (not shown) can be located. In this embodiment, the controls 220 are located upon a controls mount 217 on the nozzle assembly 240 as a possible alternative to mounting upon a panel of a vending stand similar to that of the vending stand 10 described above or upon a dispensing gun of which the nozzle assembly 240 is a part such as the dispensing gun 16 also described above.

In the illustrated preferred embodiment, the controls 220 can be attached to the controls mount 217 on the nozzle assembly 240 in any conventional manner, such as by clips, rivets, hook and loop fastener material, adhesive, conventional threaded fasteners, etc. The controls mount 217 can be attached directly to one or more components of the nozzle assembly 240, but is more preferably connected to or integral with the nozzle assembly frame 219. In order to protect the controls 220 from heat and vibration, the controls mount 217 can be located a distance from the rest of the nozzle assembly 240 by one or more mounts, standoffs, supports, and the like on the controls mount 217 and/or on the nozzle assembly frame 219. If desired, a portion of the controls mount 217 can be adapted for receiving or for mounting a display thereon, such as by a window in the controls mount 217 through which a display device mounted behind the controls mount 217 can be viewed as best shown in FIGS. 10-12, 14 and 16.

The valve 268 can be moved between its opened and closed positions in any of the manners described above, such as by a pneumatic or hydraulic actuator, by an electro-magnetic solenoid, by a rack and pinion assembly driven in any conventional manner, and the like. However, the actuator in some highly preferred embodiments such as the one shown in FIGS. 10-16 is a conventional stepper motor 221 to which the valve rod 272 is connected. The stepper motor 221 is preferably connected to the housing 266 and/or to the nozzle assembly frame 219 by one or more conventional threaded fasteners not shown, but can be connected thereto in any other manner desired or can even be integral with the housing 266 and/or nozzle assembly frame 219.

Regardless of the type of actuator or driving device employed to move the valve rod 272 and valve 268, the valve rod 272 preferably extends through the housing 266 for connection to the actuator or driving device. Accordingly, a fluid-tight seal between the valve rod 272 and the housing 266 is desirable, and can be provided by a washer, gasket (such as an O-ring), sealing compound, or other conventional fluid-sealing element or material. Most preferably, the valve rod 272 and housing 266 interface is sealed with an O-ring gasket 239 (see FIG. 16) around the valve rod 272. Because it is desirable to locate this gasket 239 as closely as possible to the internal chamber 280 (in order to minimize the amount of space exposed to fluid from the internal chamber 280), a gasket retainer 241 can be received around the valve rod 272 and can hold the gasket 239 in place. The gasket retainer 241 is preferably a tubular element with a lip held in place with one or more conventional fasteners 243 which can assist to preload the gasket 239 if desired. However, any number of other elements can be used to hold the gasket 239 in place, each one of which falls within the spirit and scope of the present invention.

In the illustrated preferred embodiment, the valve rod 272 has a threaded portion 223 extending past the nozzle assembly housing 266 and which engages with a worm gear, nut, or other threaded element (not shown) of the stepper motor 221 to move the valve rod 272 in a manner well known to those skilled in the art. Although the valve rod 272 can rotate in some embodiments, more preferably the valve rod 272 is secured against rotation in a manner described in more detail below. The stepper motor 221 (or any other type of motor or conventional driving device engaged with the threaded portion 223 of the valve rod 272 for positioning the valve rod 272) is capable of quickly and accurately positioning the valve rod 272 in different axial positions to open and close the valve 268. In some highly preferred embodiments, the stepper motor 221 is connected to and controlled by the system controller 250 to accommodate valve maintenance, such as to open fully under user command to permit replacement of the gasket 209. Also in some highly preferred embodiments, the stepper motor 221 can also or instead be controlled to function with an active system design, such as for self monitoring and adjusting for temperature changes of the nozzle assembly 240 and/or fluid in the internal chamber 280.

As an alternative to a non-rotating valve rod 272 engaged with a stepper motor 221, the threaded valve rod 272 can instead be rotatably driven in any manner, such as by one or more gears driven by a motor, by a belt or chain similarly driven, by a motor mounted directly on the end of the valve rod 272, and the like. In such an arrangement, the valve rod 272 is axially moved and positioned by being threaded into any part of the nozzle assembly 240, such as a threaded collar, nut, flange, boss, or aperture on the housing 266 or frame 219.

The stepper motor 221 is only one of a number of different actuators capable of driving the valve 268 between its opened and closed positions. One having ordinary skill in the art will appreciate that a number of other actuation devices can be used for moving and positioning the valve 268, some of which do not require a threaded portion 223 of the valve rod 272. By way of example only, the valve rod 272 can be driven by one or more rollers gripping the valve rod 272 and controllably rotated to axially move and position the valve rod 272, can have gear teeth that mesh with a spur, pinion, or other type of gear driven by a motor to move and position the valve rod 272, can have one or more magnets thereon which react to one or more controllable electromagnets mounted adjacent to the valve rod 272 (or vice versa) for pushing and/or pulling the valve rod 272 into open and closed positions, and the like. In addition, any of the other valve driving devices discussed with reference to the earlier-described nozzle assemblies 40, 140 can be used as desired.

The valve rod 272 can be manufactured from a single piece of material or can be assembled in parts by threaded, press or interference-fit, brazed, or welded connections, by conventional fasteners, or in any other conventional manner.

Although not required to practice the present invention, the nozzle assembly 240 preferably also includes a mounting body 225 located at the end 227 of the valve rod 272 opposite the valve 268. The mounting body 225 can be secured at this location by being mounted upon the nozzle assembly frame 219 in any manner described above. Preferably, the mounting body 225 has an aperture 229 therein within which the end 227 of the valve rod 272 is received. This aperture 229 is preferably long enough to receive the end 227 of the valve rod 272 in both its extended and retracted positions, and can help to guide the valve rod 272 in its movement between these positions.

For those embodiments of the present invention in which the valve rod 272 is not to turn as it is extended and retracted (as described above), the mounting body 225 also preferably functions to prevent rotation of the valve rod 272. This can be performed in a number of different manners, such as by employing an aperture 229 and valve rod end 227 having faceted, elongated, or other cross-sectional shapes not permitting rotation of the valve rod end 227 in the aperture 229, by providing one or more flats, recesses, or apertures in the valve rod end 227 into or through which a pin, post, setscrew or other threaded fastener extending through the mounting body 225 is received, and the like. In the illustrated preferred embodiment shown in FIGS. 10-16 for example, two setscrews 231 extend through threaded apertures 233 in the mounting body 225 and into flats (not visible) on opposite sides of the valve rod end 227. The flats are sufficiently long along the valve rod end 227 so that the valve rod 272 can axially shift with respect to the setscrews 231 but cannot turn with respect thereto. Regardless of the type of element(s) used to prevent rotation of the valve rod 272, the element(s) preferably are sufficiently engaged with the valve rod end 227 to prevent its rotation but not to prevent its axial translation for valve opening and closing movement.

Figure 11:
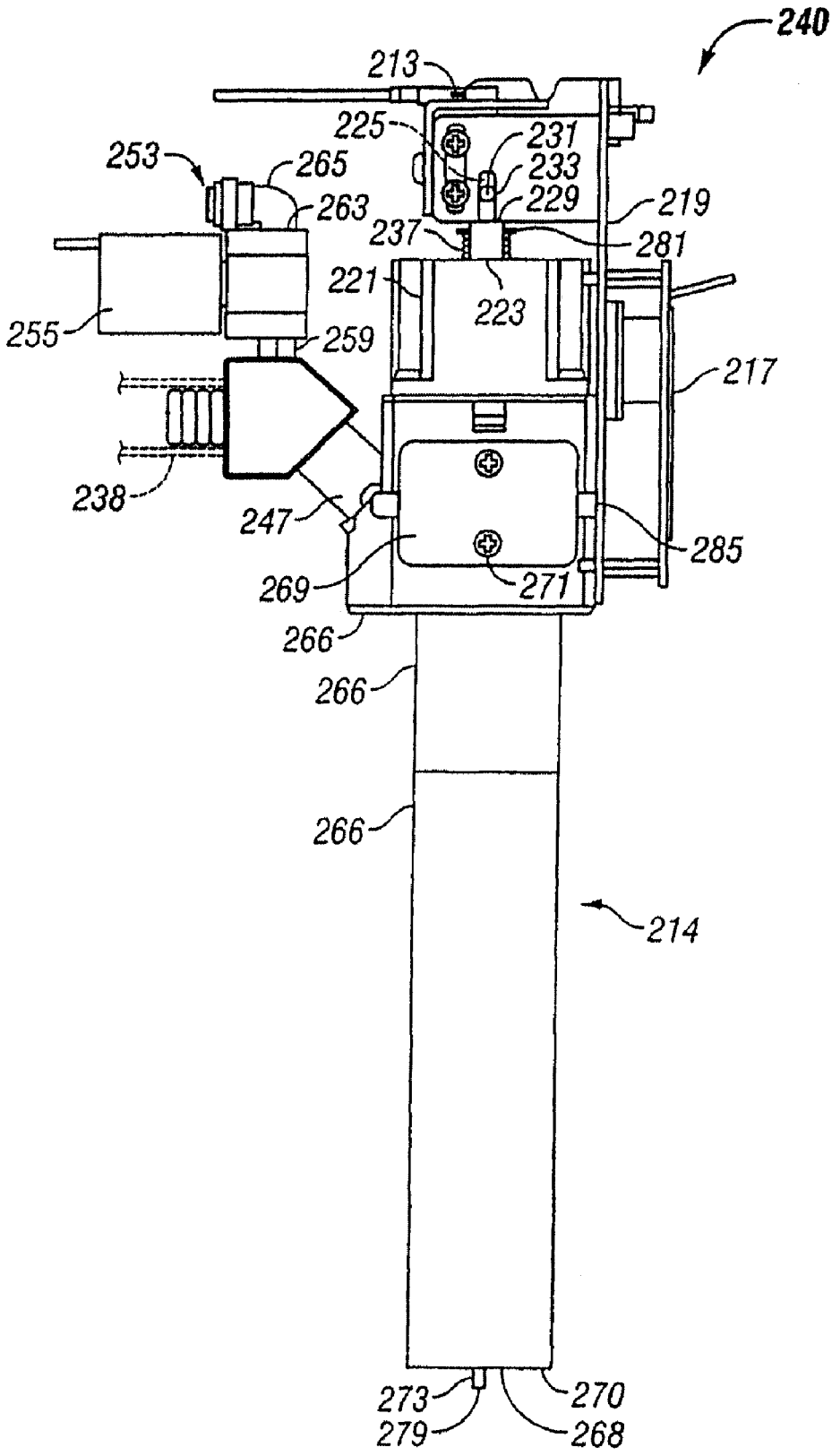
FIG. 11 is a left side elevational view of the rack nozzle assembly shown in FIG. 10.
Figure 12:
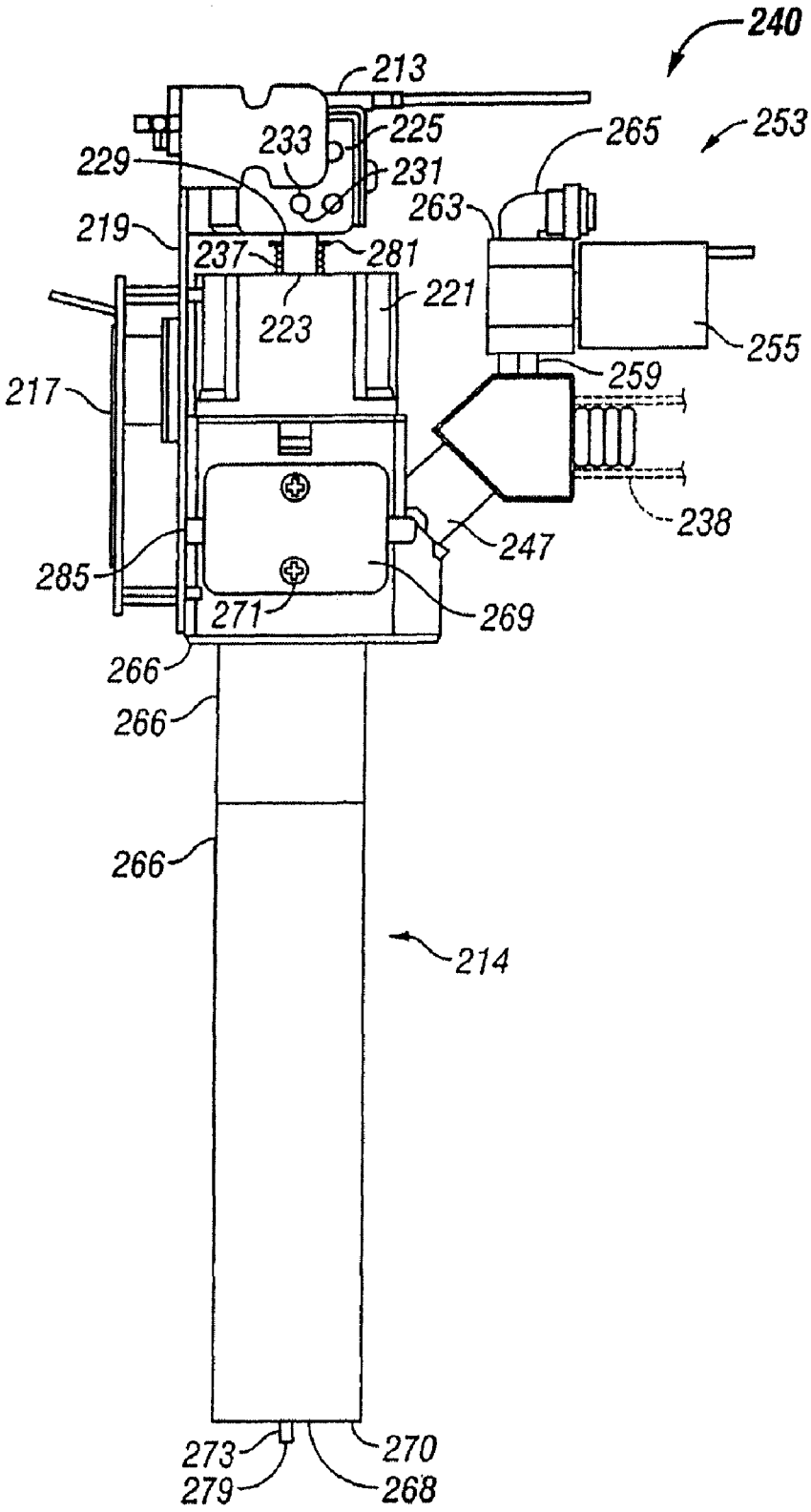
FIG. 12 is a right side elevational view of the rack nozzle assembly shown in FIGS. 10 and 11.
Figure 13:
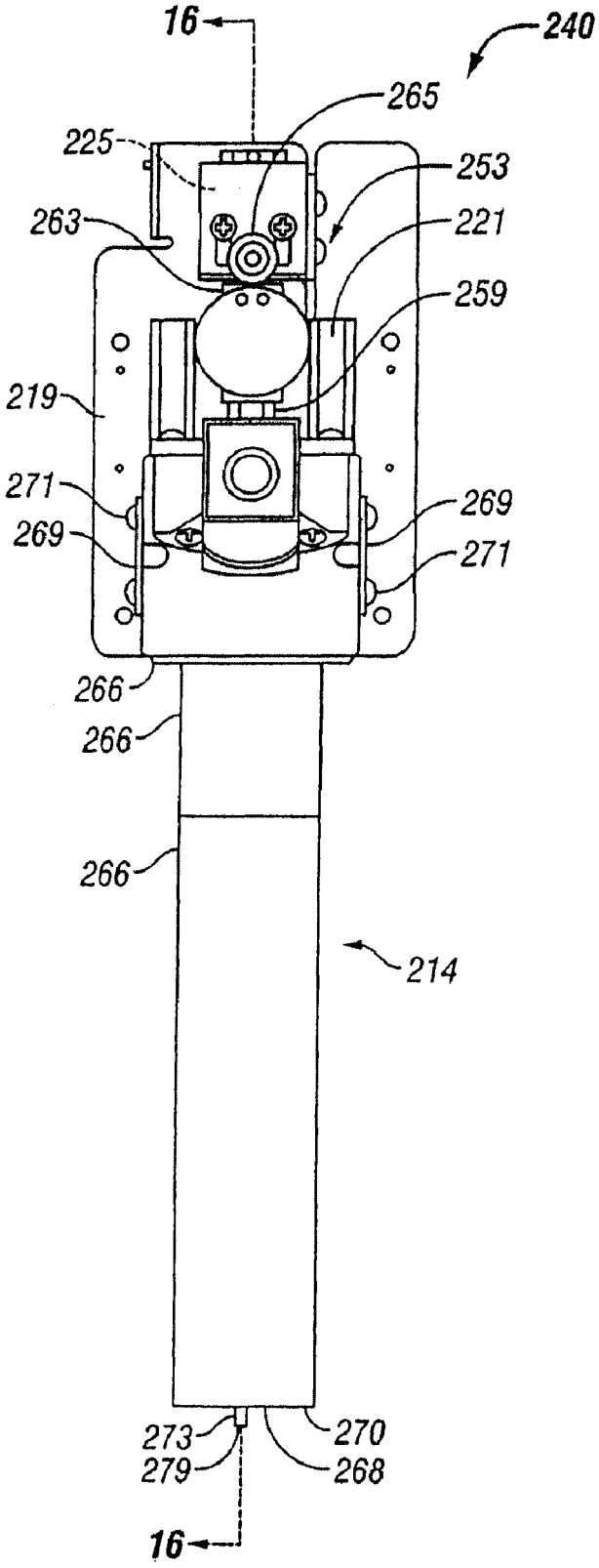
FIG. 13 a rear elevational view of the rack nozzle assembly shown in FIGS. 10-12.
Figure 14:
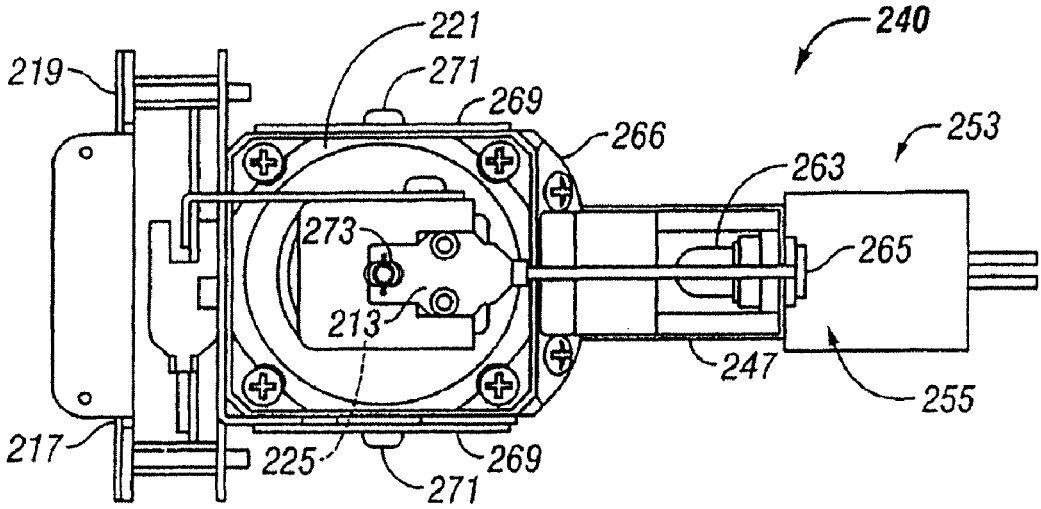
FIG. 14 is a top view of the rack nozzle assembly shown in FIGS. 10-13.
Figure 15:
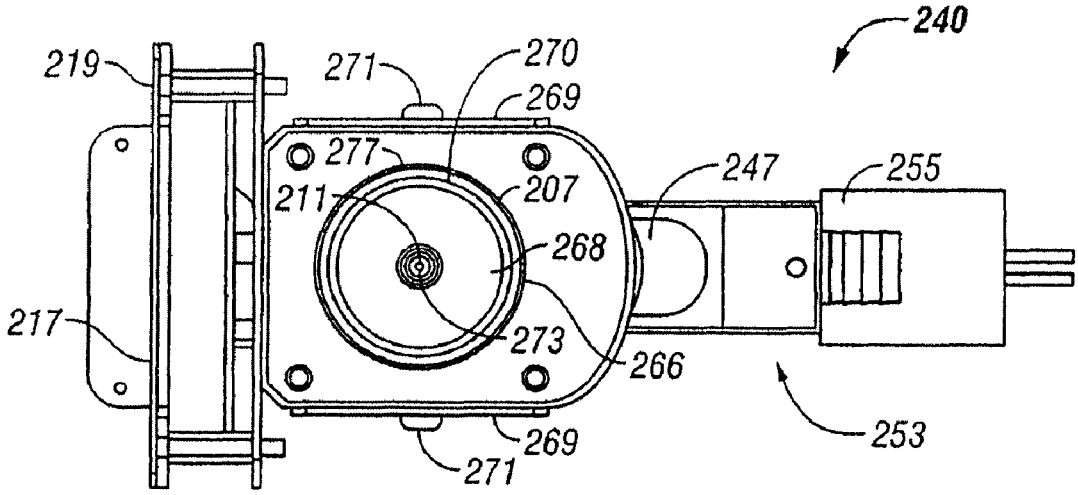
FIG. 15 is a bottom view of the rack nozzle assembly shown in FIGS. 10-14.

The mounting body 225 can also or instead perform a sensor rod biasing function. As described in more detail above, the sensor rod 273 in some preferred embodiments is biased outward to an extended position past the valve 268 so that the sensor rod 273 can return to its original position after being triggered against a container surface. A convenient manner of biasing the sensor rod 273 is best shown in FIGS. 11, 12, and 16. A sensor rod spring 275 can be attached to the end 235 of the sensor rod 273 opposite the valve 268, such as by abutting a collar, pin, rib, or C-clip 283 on the sensor rod end 235. This sensor rod spring 275 can also be received within an end of the aperture 229 in the mounting body 225 or otherwise can be secured to the mounting body 225 or frame 219 in any conventional manner. The sensor rod spring 275 is preferably a coil spring received around the end 235 of the sensor rod 273, but can instead be any other type of spring (e.g., torsional spring, leaf spring, and the like) or biasing element capable of exerting a biasing force upon the sensor rod 273 as described above.

As mentioned above, when the sensor rod 273 in some preferred embodiments is triggered, it moves in the valve rod 272 and trips a conventional sensor 213 connected to the stepper motor 221 either directly or by a controller 250. When tripped, the sensor 213 sends one or more signals to operate the stepper motor 221 to open the valve 268 and to dispense fluid. The sensor 213 can be any conventional type preferably capable of being mechanically tripped by motion of the sensor rod 273. The sensor 213 can be mounted in any conventional manner to the nozzle assembly frame 219 (as shown in the figures) or to the mounting body 225 adjacent to the sensor rod end 235, which preferably extends through a reduced diameter portion of the mounting body aperture 229.

It may be desirable in some applications to reduce vibration of the valve rod 272. To this end, a valve rod spring 237 can be connected to and can exert biasing force upon the valve rod 272. Although biasing force in a valve opening or a valve closing direction can assist in reducing valve rod vibration, the valve rod spring 237 preferably biases the valve rod 272 to its retracted (closed) position. Therefore, as best shown in FIGS. 11, 12, and 16, the valve rod spring 237 is preferably a compression spring connected to and between the valve rod 272 and the stepper motor 221 or nozzle assembly frame 219. Alternatively, the valve rod spring 237 can be an extension spring connected to and between the valve rod 272 and the mounting body 225 or nozzle assembly frame 219. The valve rod spring 237 is preferably a coil spring received around the valve rod 272, but can instead be any other spring type desired (leaf, torsional, etc.).

The valve rod spring 237 can be connected to the valve rod 272 in a number of conventional manners, such as by having an end welded thereto, by having a portion passing around the valve rod 272, by being clipped to a collar or sleeve on the valve rod 281 as shown in the figures, and the like. Similarly, the valve rod spring 237 can be connected to the stepper motor 221, nozzle assembly frame 219, or mounting body 225 in any conventional manner.

The valve rod spring 237 is preferably connected to exert a biasing force assisting the stepper motor 221 to close the valve 268. The pressure of fluid within the internal chamber 280 provides assistance for the stepper motor 221 to open the valve 268.

Another feature of the present invention is related to the introduction and flow of fluid into the diffuser 205. The manner in which fluid is introduced into the diffuser 205 can be an important factor in dispensing control and quality and typically increases in importance at higher fluid pressures and flow rates and for certain types of fluids. For example, the angle at which fluid enters the diffuser 205 can significantly affect nozzle assembly dispensing performance. For carbonated beverages (and especially for beer), breakout of carbonation can occur in the movement of fluid flow from the beer output line 238 to the diffuser 205 in the nozzle housing 266. In order to avoid undesirable fluid flow characteristics resulting from the introduction of fluid into the diffuser 205, the present invention can employ a fluid entry portion or line 245 that is oriented at an angle less than 90 degrees with respect to the axis of the diffuser 205. Preferably, the fluid entry line 245 is oriented at an angle of less than 60 degrees with respect to the axis of the diffuser 205 (flow into the diffuser being parallel to the diffuser axis and in a direction toward the dispensing outlet 270 at 0 degrees). More preferably, the fluid entry line 245 is less than 45 degrees with respect to the axis of the diffuser 205. Most preferably, the fluid entry line 245 is about 45 degrees with respect to the axis of the diffuser 205. The preferred fluid entry line angles just described result in improved flow control and dispensing quality while reducing the chances for carbonation breakout, and are therefore a valuable optional feature of the present invention.

The fluid entry line 245 can be defined at least partially by a separate element as best shown in FIG. 16, in which case the fluid entry line 245 can include a fluid entry fitting 247 received within a port 249 in the nozzle assembly housing 266. The fluid entry fitting 247 can be sealed in a fluid-tight manner to the port 249 by one or more gaskets 251 (as illustrated), seals, sealing compound, and the like. As part of the fluid entry line 245, the port 249 is also preferably oriented relative to the axis of the diffuser 205 as described above. In other embodiments of the present invention, the fluid entry fitting 247 connects to the port 249 and extends substantially the entire distance to the diffuser 205. To assist in fluid flow control upon entry of fluid into the diffuser 205, at least part of the fluid entry fitting 247 and/or the port 249 preferably has a cross sectional area of increasing diameter toward the diffuser 205 (see the fluid entry fitting 247 in FIG. 16). Also, in some embodiments the fluid entry fitting 247 is integral with the nozzle assembly housing 266 and port 249.

Some preferred embodiments of the present invention employ an improved priming and purge valve assembly 253 for increased control over nozzle assembly priming and purging operations. The purge valve assembly 253 preferably includes a solenoid valve 255 and a check valve 257 connected between the solenoid valve 255 and the fluid line running to the diffuser 205. The check valve 257 can be located within a nipple 259 connecting the solenoid valve 255 to the fluid line running to the diffuser 205, and is more preferably connected the solenoid valve 255 and the fluid entry fitting 247 described above. Fluid communication with the fluid line (and more preferably the fluid entry fitting 247) is preferably via an orifice 261 therein as shown in FIG. 16.

The solenoid valve 255 is conventional in construction and operation, and preferably has a discharge port 263 through which purged fluid exits the system. The solenoid valve 255 functions as a priming valve for priming and purging the nozzle assembly 240. One having ordinary skill in the art will appreciate that a number of different valve types can be used for this priming valve, each one of which falls within the spirit and scope of the present invention. However, a valve such as a solenoid valve 255 is most preferred for rapid, repeatable, and electrically-controllable valve operation. Preferably, a drain tube (not shown) is connected to the discharge port 263 either directly or by a conventional fitting 265, and runs to a drain or discharge receptacle.

The priming and purge valve assembly 253 is preferably located at a point of highest elevation in the fluid dispensing system, thereby permitting any air and gas bubbles to move as close as possible to the priming and purge valve assembly 253 for priming and purging operations. In order to better facilitate removal of air and gas bubbles from the fluid line, the fluid line (e.g., fluid entry fitting 247) is preferably not widened and is instead kept relatively small, thereby increasing flow velocity and the capability of bubbles to be carried out by the priming and purge valve assembly 253. To purge or prime the system, the solenoid valve 255 is temporarily opened, thereby causing bubbles and fluid to pass through the orifice 261, through the check valve 257, and through the solenoid valve 255 to the discharge port 263 thereof. The check valve 257 preferably prevents backflow of fluid through the orifice 261 and into the fluid line. Most preferably, the check valve 257 is a duck bill valve, although other types of check valves can be used instead.

The orifice 261 is preferably significantly smaller than the diameter of the nipple 259 and the diameter of the fluid entry fitting 247, and therefore acts as a restriction upon flow to the priming and purge valve assembly 253. The orifice 261 therefore permits restricted priming of the system and results in fluid introduction into the nozzle assembly 240 with counter-pressure fill. In other words, the relatively small orifice 261 permits air and gas to escape from the system at a controlled rate even when fluid is introduced to the system at rack or another high pressure. The system is therefore primed at a controlled rate ("restricted priming") rather than at a very rapid and uncontrolled rate. Also, air and gas in sections of the system are compressed and exert a back pressure or "counter-pressure" against the incoming fluid, thereby also providing a controlled prime rather than a very rapid and uncontrolled prime. This back pressure is subsequently reduced as air and gas escapes from the priming and purge valve assembly 253. Where restricted priming or counter-pressure filling is not desired in alternate embodiments of the present invention, the orifice 261 can be larger. When a slower and even more controlled prime is desired, the fluid dispensing system can first be pressurized through the priming and purge valve assembly 253 or other system port(s). The pressure can then be reduced to allow priming to occur at desired rates.

In addition to removing bubbles from the fluid line running into the nozzle assembly 240 and in addition to removing air and gas from the fluid line during startup, the priming and purge valve assembly 253 can be used to move fluid within the dispensing system. For example, when fluid in a part of the dispensing system has not moved for a period of time and has become warm, the priming and purge valve assembly 253 can be used to move the fluid to a heat exchanger in the system for cooling the fluid.

The check valve 257 is normally smaller in size than the solenoid valve 255, and can be located immediately adjacent to the orifice 261 described above. This reduces the amount of fluid remaining between the check valve 257 and the orifice 261 after a purge or priming operation and reduces the volume between the check valve 257 and the orifice 261 (thereby reducing high pressure leak-back of fluid through the orifice 261 and into the fluid line running to the diffuser 205). Both results contribute significantly to sanitation of the nozzle assembly 240.

Another benefit of a check valve 257 located between the orifice 261 and the solenoid valve 255 is the ability of the check valve 257 to prevent pressure surges or spikes in the fluid line regardless of the source of such surges or spikes. Specifically, in the event that a pressure surge or spike is generated in the connected system or in the nozzle assembly 240, the check valve 257 provides an outlet for the pressure surge or spike. Such an outlet helps to reduce fluid blasting from the dispensing outlet 270 and helps to prevent breakout in the case of carbonated fluids. It should also be noted that the ability to prevent such pressure surges or spikes is significantly increased when the solenoid valve 255 is opened (e.g., during system purging or priming).

The priming and purge valve assembly 253 with its valves 257, 255 therefore not only enables system purging and priming, but also provides the benefits of a check valve as described above. Although any distance between the check valve 257 and the solenoid valve 255 is possible, it should be noted that this distance is preferably as short as possible. The larger the distance between these valves 257, 255, the greater the volume between the valves 257, 255. Because fluid pressure between the check valve 255 and the orifice 261 is typically larger than between the valves 257, 255 after a purge or priming operation, fluid can flow through the check valve 257 from the orifice 261 in some embodiments of the present invention. Such flow will eventually fill the space between the valves 257, 255 until pressure between the valves 257, 255 raises sufficiently to stop the flow. A shorter distance between the valves 257, 255 therefore results in less waste of fluid in the priming and purge valve assembly 253 and less sanitation-related issues caused by fluid therein.

In some highly preferred embodiments of the present invention, the priming and purge valve assembly 253 has one or more sensors that can be used to assist in or to automatically perform priming and purging operations and/or to indicate operational conditions of the assembly 240 to a user. With continued reference to FIG. 16, the nozzle assembly 240 can have a fluid sensor 267 mounted in a conventional manner in the fluid entry fitting 247 or any other location of the fluid line running to the diffuser 205. The fluid sensor 267 is preferably positioned at or near a high elevational position in the fluid entry fitting 247 above the nozzle 214 to detect when air or gas is in the fluid entry fitting 247 (a "non-hydraulic condition" as used herein and in the appended claims). Such a condition can occur when there is an air or gas pocket, bubble, or breakout in the line or when the system is dry. In either case, the fluid sensor 267 can send one or more signals to an indicator light or display to indicate this condition to a user. Preferably at any point, the user can actuate the solenoid valve 255 to prime or purge the fluid line.

If fluid temperature control by operation of the priming and purge valve assembly 253 is desired as described above, the priming and purge valve assembly 253 can be controlled in the same manner as also described above with reference to the fluid sensor 267 (and its use to indicate appropriate priming and purging times and/or to automatically perform such operations). Specifically, one or more temperature sensors 287 can be mounted anywhere in the fluid line from the fluid source 22 to the dispensing outlet 270 to directly or indirectly measure the temperature of adjacent fluid. In some highly preferred embodiments, a temperature sensor 287 is mounted in a conventional manner in the fluid entry fitting 247 as shown in FIG. 16. When a threshold temperature has been reached and is detected by the temperature sensor 287, the system can indicate a recommended user purge or automatically perform a purge in a manner as described above with reference to purging and priming responsive to the fluid sensor 267. It should be noted that although the temperature sensor 287 can be employed to detect when fluid has warmed to an unacceptable level (e.g., for cold fluids), one having ordinary skill in the art will appreciate that the temperature sensor 287 can instead be used to detect when fluid has cooled to an unacceptable level, such as for dispense of hot fluids.

In some embodiments, the solenoid valve 255 is opened only for so long as the user manipulates a control (e.g., holds a button down or continues to push or pull a lever on the controls 220, etc). In other embodiments, the solenoid valve 255 is kept open by a controller 250 and associated timer 289 for a pre-set or pre-programmed amount of time after the user manipulates the control or until the fluid sensor 267 no longer detects air or gas in the fluid line or until the temperature sensor 287 detects a drop in fluid temperature below a desired threshold temperature. In still other highly preferred embodiments, when the fluid sensor 267 detects air or gas in the fluid line or drop in fluid temperature below a threshold temperature, the fluid sensor 267 or temperature sensor 287 (respectively) transmit one or more signals to the solenoid valve 255 or to a controller 250 and associated timer 289 connected to the solenoid valve 255 to open the solenoid valve 255 for a pre-set or pre-programmed amount of time or to open the solenoid valve 255 until the fluid sensor 267 no longer detects air or gas in the fluid line or until the temperature sensor 287 detects a drop of fluid temperature below a desired level. These embodiments provide a more automatic purging and priming feature than those described earlier.

In addition to the temperature controlling features of the present invention described above, temperature of the nozzle assembly 240 can controlled by connecting one or more heat exchangers to the nozzle assembly 240. The heat exchangers can be of any conventional type capable of being connected to or otherwise mounted in heat-transfer contact with the nozzle assembly 240. By way of example only, the nozzle assembly 240 of the illustrated preferred embodiment can be fitted with or otherwise have attached thereto one or more heat pipes (not shown). The heat pipes can be permanently or removably secured against and/or to any component of the nozzle assembly 240. However, highly preferred embodiments of the present invention can employ heat pipes for cooling the housing 266, the stepper motor 221, or both the housing 266 and stepper motor 221. In other embodiments, plate type heat exchangers such as those discussed above with reference to the earlier-described nozzle assemblies 40, 140 can be connected to the nozzle assembly 240 in any conventional manner to cool the nozzle assembly 240. Alternatively or in addition, a heat exchanger connected to the nozzle assembly 240 and cooling fluid prior to entering the nozzle assembly 214 can be used as preferably employed in the earlier-described nozzle assemblies 40, 140.

If used, the heat exchangers can be attached to the nozzle assembly 240 in any number of well known manners, such as by conventional fasteners, welding, brazing, clamping, and the like. In the illustrated preferred embodiment, heat pipes are clamped to the housing 266 of the nozzle assembly 240 by plates 269 secured to the housing 266 with threaded fasteners 271. For an improved connection and for better heat transfer, the walls of the housing 266 can be provided with grooves 285 within which the heat pipes are received and clamped. As alternatives to grooves, heat pipes can be received within apertures passing through any portion of the nozzle assembly 240. One having ordinary skill in the art will appreciate that still other manners exist for securing heat pipes and other types of heat exchangers to the nozzle assembly 240, each of which falls within the spirit and scope of the present invention.

Another manner in which to control the temperature of the nozzle assembly 240 is to at least partially insulate the stepper motor 221 from the internal chamber 280. This can be accomplished by employing one or more thermally insulative pads, liners, mounts, standoffs, or other elements (not shown) between the stepper motor 221 and the housing 266 to which the stepper motor 221 is attached in the illustrated preferred embodiment. These insulative elements can be made from any thermally insulative material, including without limitation rubber, plastic, urethane, and refractory materials, and can be in any shape, size, and number. The insulative elements preferably prevent or reduce the transfer of heat often generated by many different types of stepper motors and other actuators during repeated or sustained operation.

The nozzle assembly 240 as shown in FIGS. 10-16 is adapted for connection to a dispensing rack in much the same manner as the rack nozzle 40 described above. However, like the rack nozzle 40, it should be noted that the nozzle assembly 240 can be employed as a hand-held dispensing gun with little modification. Specifically, the nozzle assembly 240 used in a dispensing gun preferably has smaller overall dimensions than when used in a dispensing rack. In addition, the nozzle assembly 240 used in a dispensing gun can be directly connected to a heat exchanger which preferably (but not necessarily) forms part of the dispensing gun in a similar manner to the dispensing gun nozzle assembly 140 described above. In general, the structural and operational differences between the rack-type nozzle assembly 40 and the dispensing gun nozzle assembly 140 described above are preferably similar to those between the rack-type nozzle assembly 240 and the same type of nozzle assembly employed in a dispensing gun.

In operation, and with reference again to the nozzle assembly 240 illustrated in FIGS. 10-16, a user preferably inserts the valve 268 and dispensing outlet 270 into a container. Upon contact and pressure of the sensor rod 273 against a surface of the container (preferably a bottom surface of the container), the sensor rod 273 is pushed and moved relative to the valve rod 272 until the sensor 213 is tripped by the sensor rod 273. Alternatively, a pressure, optical, or other type of sensor preferably detects the surface of the container and is tripped. The sensor 213 then preferably sends one or more signals to a system controller 250, which responds by actuating the stepper motor 221 (or other valve rod actuator) to move the valve rod 272 and to open the valve 268. In alternate embodiments, signals sent by the sensor 213 directly actuate the stepper motor 221 without the need for a controller 250.

Upon being opened, the valve 268 permits fluid to exit the dispensing outlet 270. Fluid is preferably supplied to the internal chamber at an angle of about 45 degrees, and travels through the internal chamber 280 to the dispensing outlet 270. Fluid passing through the internal chamber 280 toward the dispensing outlet 270 is preferably slowed in the diffuser 205, and is preferably diverted into an annular flow by the cone-shaped valve walls. Both aspects of the nozzle assembly 240 contribute to improved flow control and dispense. Dispensing preferably continues for a set amount of time determined by a timer of the system controller 250 or by another conventional timer device, after which one or more actuating signals are sent to the stepper motor 221 to move the valve rod 272 again and to close the valve 268. Alternatively, the stepper motor 221 can be actuated to close the valve 268 responsive to one or more signals from one or more sensors on the valve 268 and/or dispensing outlet 270 (e.g., optical sensors detecting loss of submersion in fluid, loss of proximity to container, and the like, pressure sensors detecting loss of contact with container, etc.). As the valve 268 is closed, the gasket 209 preferably presses against the chamfered edge of the dispensing outlet 270 and unseats from the groove 211 in the valve 268 by pressure from fluid in the internal chamber 280. When the valve 268 is finally closed, the gasket 209 preferably deforms and is squeezed between the dispensing outlet 270 and the valve 268 to provide a fluid-tight valve seal.

In the event of a dry start-up or when the system otherwise needs to be primed, the solenoid 255 of the priming and purge valve assembly 253 is preferably opened to permit air and/or gas to escape via the orifice 261 and check valve 257. The priming and purge valve assembly 253 is preferably controlled by a user manipulating the controls 220 (not shown), automatically by the fluid sensor 267 connected to the priming and purge valve assembly 253, or automatically by the temperature sensor 287 connected to the priming and purge valve assembly 253. Any one or more of these manners of valve assembly control can be included in the present invention. Priming or purging preferably ends by user manipulation of the controls 220, after a pre-set or pre-programmed period of time, or in response to signals sent by the fluid or temperature sensors 267, 287.

FIGS. 17, 17A, 18, 19A, and 19B illustrate another embodiment of the nozzle assembly similar in many ways to the illustrated embodiments of FIGS. 1-16 described above. Accordingly, with the exception of mutually inconsistent features and elements between the embodiment of FIGS. 17, 17A, 18, 19A, and 19B and the embodiments of FIGS. 1-16, reference is hereby made to the description above accompanying the embodiments of FIGS. 1-16 for a more complete description of the features and elements (and the alternatives to the features and elements) of the embodiment of FIGS. 17, 17A, 18, 19A, and 19B. Features and elements in the embodiment of FIGS. 17, 17A, 18, 19A, and 19B corresponding to features and elements in the embodiments of FIGS. 1-16 are numbered in the 300 and 400 series.

The nozzle assembly 340 illustrated in FIGS. 17, 17A, 18, 19A, and 19B includes a nozzle 314 having a first end 365, a second end 367, internal walls 301, and a reservoir or internal chamber 380 defined at least in part by the internal walls 301. In the illustrated embodiment, the nozzle 314 is generally tubular, and has a length measured along the axis A, which extends through the first and second ends 365, 367. As described in greater detail below, the nozzle assembly 340 is operable by a user to dispense a comestible fluid. While the following description makes reference to beer, it should be understood that the present invention can also dispense any other comestible fluid, including fruit drinks, sodas, tea, coffee, water, and the like.

Figure 17:
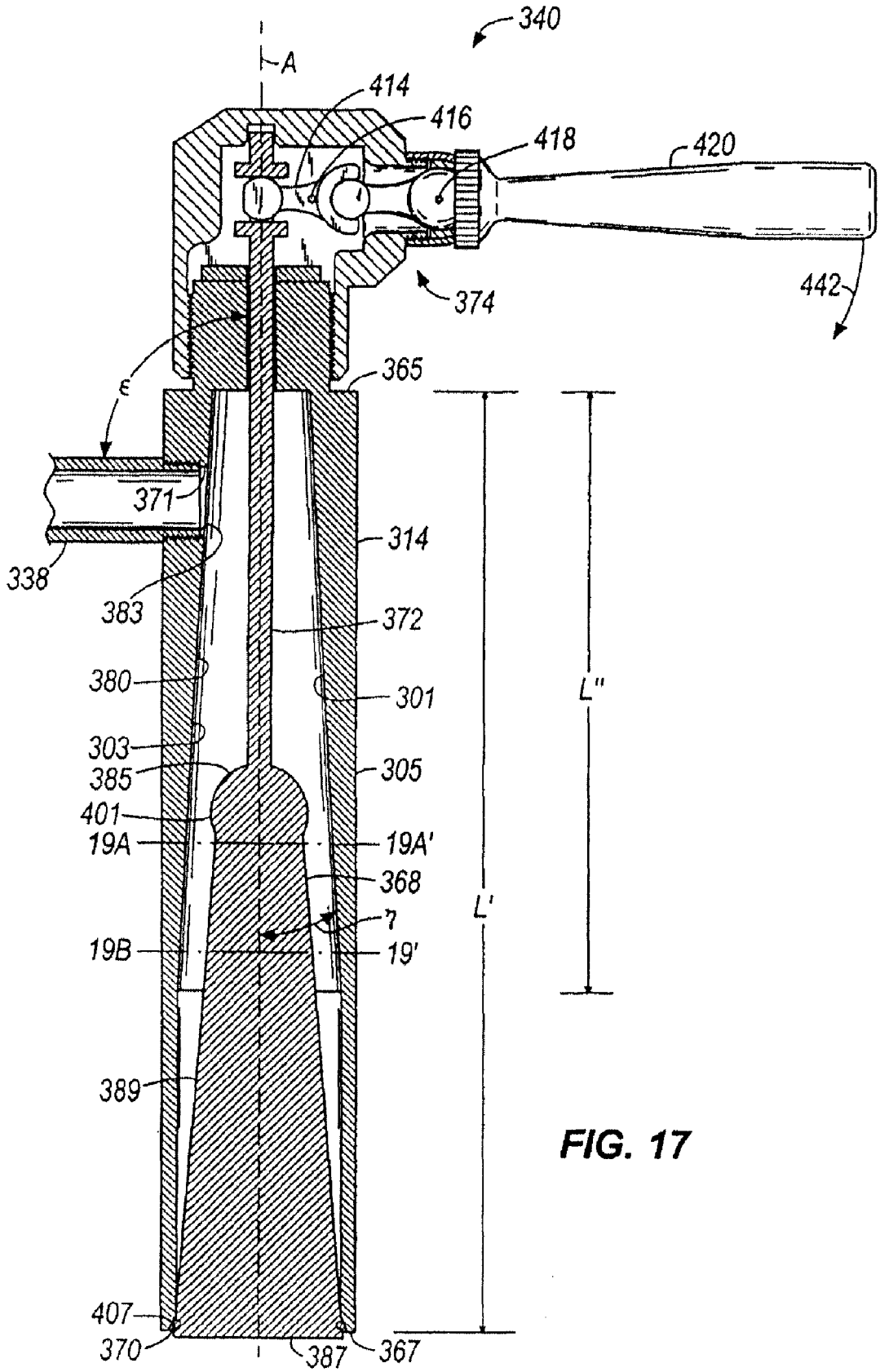
FIG. 17 is an elevational cross section view of a nozzle assembly associated with an second embodiment of the present invention, taken along a central axis of the nozzle assembly.
Figure 17A:
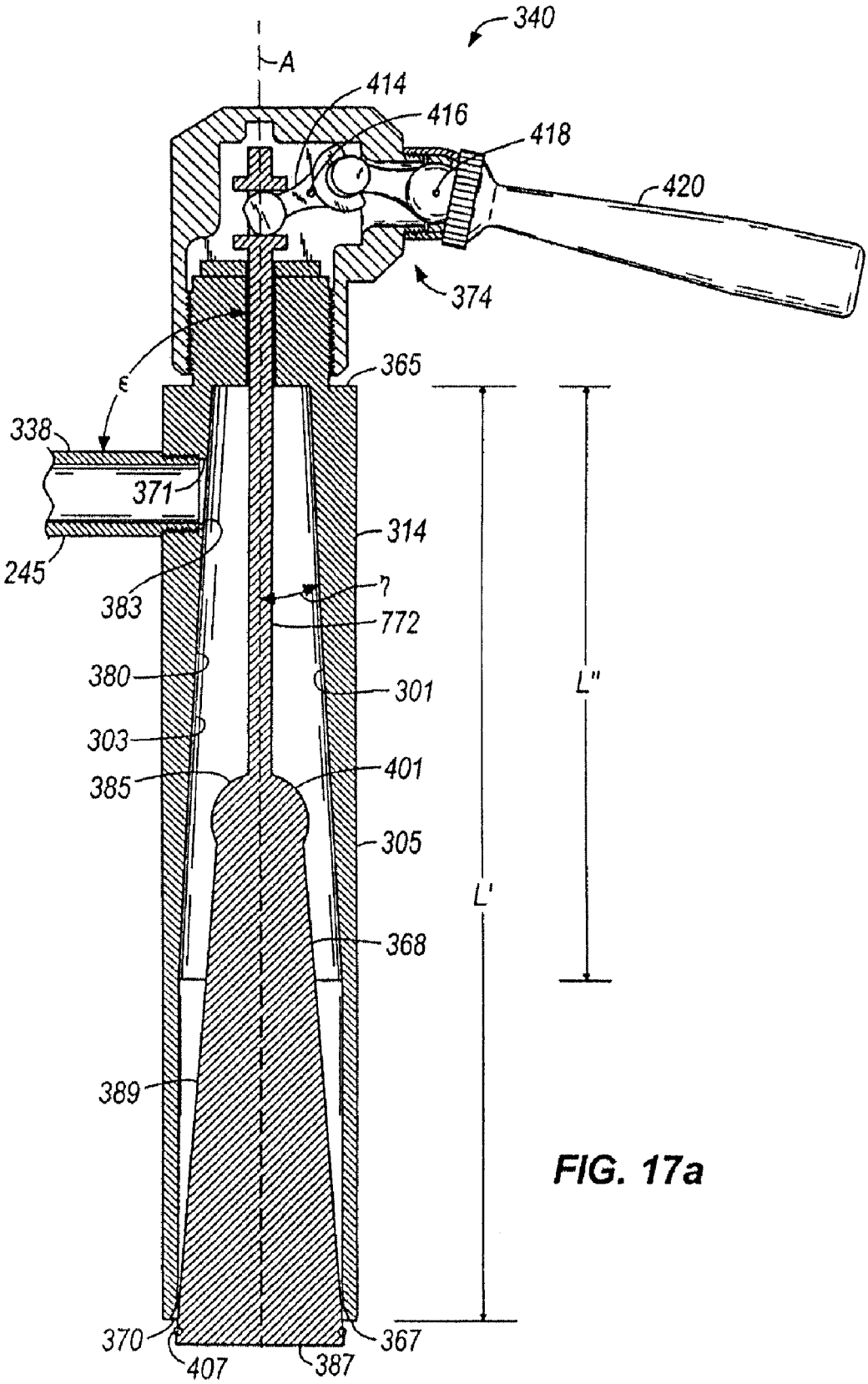
FIG. 17A is an elevational cross section view in of the nozzle assembly shown in FIG. 17, showing the nozzle assembly in an opened configuration.

An inlet 371 and a dispensing outlet 370 are located adjacent to the first and second ends 365, 367, respectively. In the illustrated embodiment, the inlet 371 extends through an internal wall 301 and communicates with the internal chamber 380 via a circular opening 383, although any opening shape can be employed depending at least in part upon the shape of the fluid entry line extending to the inlet 371. In other embodiments (not shown), the inlet 371 can be located at the first end 365, or alternatively, in any other location along the internal walls 301. With reference to FIGS. 17 and 17A, the dispensing outlet 370 of the illustrated embodiment is substantially circular, is defined by an open end of the nozzle 314, and is in fluid communication with the internal chamber 380. In other embodiments (not shown), the dispensing outlet 370 can have a shape that is square, rectangular, triangular, or oval, or can have any other shape desired, and can be located at any point in the internal walls 301 of the nozzle 314.

A fluid output line 338 extends between a fluid source (e.g., a beer keg) and the inlet 371, and conveys beer from the fluid source to the nozzle assembly 340. In some embodiments, the fluid output line 338 is oriented at an angle $\epsilon$ defined between the fluid output line 338 and a portion of the axis A located upstream from the opening 383. In some embodiments, the angle $\epsilon$ is equal to or less than 90 degrees. In other embodiments (not shown), the angle $\epsilon$ between the fluid output line 338 and the axis A can be less than 60 degrees. In still other embodiments, the angle $\epsilon$ can be less than less than 45 degrees.

To facilitate movement of a valve 368 and for reasons explained in greater detail below, the nozzle 314 can be elongated as shown in FIGS. 17 and 17A. This elongated configuration allows the valve 368 to move in telescoping relationship a distance within the nozzle 314 between opened and closed positions.

As shown in FIGS. 17 and 17A, at least a portion of the internal walls 301 is sloped or angled outwardly away from the axis A to define a diffuser 305 of the nozzle assembly 340. The internal walls 303 of the diffuser 305 are generally frustoconical and elongated in shape, and diverge outwardly from the axis A toward the dispensing outlet 370. In some embodiments, the internal walls 303 define an increasing cross sectional area of the internal chamber 380 with increased proximity to the dispensing outlet 370 along at least a portion of the length of the diffuser 305. In such embodiments, the cross sectional area of the upper end of the diffuser 305 is therefore smaller than the cross sectional area of the diffuser exit.

Because the internal chamber 380 and nozzle 314 can have virtually any shape, the term "length" and related terms (such as "long", "longitudinal", "along", etc.) as used herein are defined by the fluid flow path through the internal chamber 380 to the dispensing outlet 370. "Length" and its related terms therefore do not imply that the internal chamber 380 or diffuser 305 must be straight as illustrated in FIGS. 17 and 17A. The length of the internal chamber 380 can be the same size, larger, or smaller than the cross sectional width of the internal chamber 380 depending at least partially upon the shape of the internal chamber 380. In this regard, the internal chamber 380 need not necessarily even have an axis, be symmetrical in any manner, or be elongated as shown in FIGS. 17 and 17A. Similarly, the diffuser 305 can take virtually any shape limited only by its increasing cross sectional area toward the dispensing outlet 370. By way of example only, the diffuser 305 can take any longitudinal shape (from an elongated shape to a relatively short shape) and can have walls diverging in any manner (rapidly diverging walls, more gradually diverging walls, stepped walls, and the like).

The cross sectional shape of the diffuser 305 can be any shape desired, including without limitation round, square, rectangular, triangular, oval, and irregular shapes, and the like. In addition, the diffuser 305 need not necessarily have a symmetrical cross sectional shape (whether about a plane or an axis), and can have a cross sectional shape that is the same or varies in any manner along any portion or all of the length of the diffuser 305. However, in the illustrated embodiment, the diffuser 305 has a generally circular cross sectional shape along the length of the diffuser 305.

In the illustrated embodiment, the internal walls 303 of the diffuser 305 diverge gradually and at a substantially constant rate. However, the diffuser walls 303 can diverge at any other rate or combinations of rates as desired, all of which result in an increasing internal chamber cross sectional area of the diffuser 305.

In the some embodiments of the present invention, the internal walls 303 of the diffuser 305 diverge outwardly at an angle $\eta$ with respect to the axis A. In some embodiments, an angle $\eta$ no greater than 15 degrees provides good performance results. In other embodiments, the diffuser walls 303 can take any other shape desired, including bowed or curved walls, (possible combinations include convex, concave, or a combination of concave and convex walls), faceted walls, and the like. The diffuser 305 therefore does not need to define linearly or gradually increasing internal chamber or cross sectional area. Instead, the cross sectional area in the diffuser 305 can increase non-linearly, in a graduated or staged manner, or in any other manner desired.

The diffuser 305 can define all or part of the internal chamber 380, and can be located at any point along the length of the nozzle 314. In some embodiments, the diffuser 305 can extend along the entire length of the nozzle 314 from the first end 365 to the second end 367. In other embodiments, such as in the illustrated embodiment of FIGS. 17 and 17A, the diffuser 305 extends along an upper portion of the nozzle 314 (e.g., along the upper ⅔ of the nozzle 314).

In these embodiments, the portion of the nozzle 314 between the diffuser 305 and the dispensing outlet 370 can have a substantially constant cross sectional area. This downstream portion of the nozzle 314 can be immediately adjacent to the diffuser 305, or alternatively, the downstream portion can be spaced a distance from the diffuser 305 by another portion of the nozzle 314 having any constant or changing cross-sectional shape and/or size. Also, in these embodiments, the entire valve 368 can be housed in the nozzle 314 when the valve 368 is in both the opened and closed positions (although such a relationship between the nozzle 314 and the valve 368 is not required). Locating the diffuser 305 in this manner can provide improved fluid flow and dispensing results while minimizing the necessary length of the nozzle 314. In other embodiments, the diffuser 305 can extend along any portion of the nozzle 314, such as along the entire nozzle 314, along an upstream portion of the nozzle 314, a middle portion of the nozzle 314, a downstream portion of the nozzle 314, an upstream half of the nozzle 314, a downstream half of the nozzle 314, or along any other fraction of the nozzle's length and at any location along the nozzle 314.

Non-refrigerated beer, beer that is warmed by exposure to room temperatures, and beer that is otherwise warmed as it stagnates in the nozzle assembly 340 is more likely to experience breakout than refrigerated beer. Also, it is often undesirable to dispense comestible fluid at room temperatures. Therefore, in some embodiments of the present invention, at least a portion of the valve 368, nozzle 314, and/or the valve rod 372 can be made of a thermally insulated material, such as plastic, rubber, thermally insulated polymers or composites, and the like to minimize and/or prevent heat transfer to the beer in the nozzle 314. Also, any portion (or all) of the nozzle 314 can be provided with a thermal jacket or other insulative structure in order to help maintain a desired temperature within the nozzle 314. By way of example only, an evacuated chamber can at least partially surround any portion of the nozzle 314. As another example, the nozzle 314 can be at least partially surrounded by one or more insulative layers.

In some embodiments, the amount of beer that is exposed to the temperature of the nozzle's environment can be reduced by reducing the fluid-holding capacity within the internal space 380. For example, in some embodiments, the valve 368 occupies at least half of the volume of the internal space 380, thereby reducing the volume of beer that is stored in the nozzle assembly 340 between beer dispenses.

The valve 368 is positioned in the nozzle 314 for telescoping movement along the axis A between a closed position (shown in FIG. 17), in which at least a portion of the valve 368 sealingly engages the internal walls 301 of the nozzle 314, and an opened position (shown in FIG. 17A), in which the valve 368 is spaced a distance from the internal walls 301 of the nozzle 314 to facilitate fluid flow between the internal walls 301 and the valve 368 (i.e., out of the nozzle assembly 340). In some embodiments, when the valve 368 is in the closed position, the valve 368 seals the dispensing outlet 370 at the periphery of the valve 368 and, when the valve 368 is in the opened position, the outer periphery of the valve 368 is moved away from the internal walls 301 of the nozzle 314 (e.g., out of the nozzle 314 through the dispensing outlet 370). In other embodiments, the valve 368 seals the internal chamber 380 at another point along the internal walls 301 of the nozzle 314 upstream from the dispensing outlet 370 (e.g. at a point along the diffuser 305, against an internal step of the nozzle 314, or against another feature of the nozzle 314). In some embodiments of the present invention, the valve 368 is moveable through a range of opened positions, thereby providing for different opening sizes between the valve 368 and the nozzle 314 and a corresponding range of flow rates from the dispensing outlet 370.

Figure 19A:
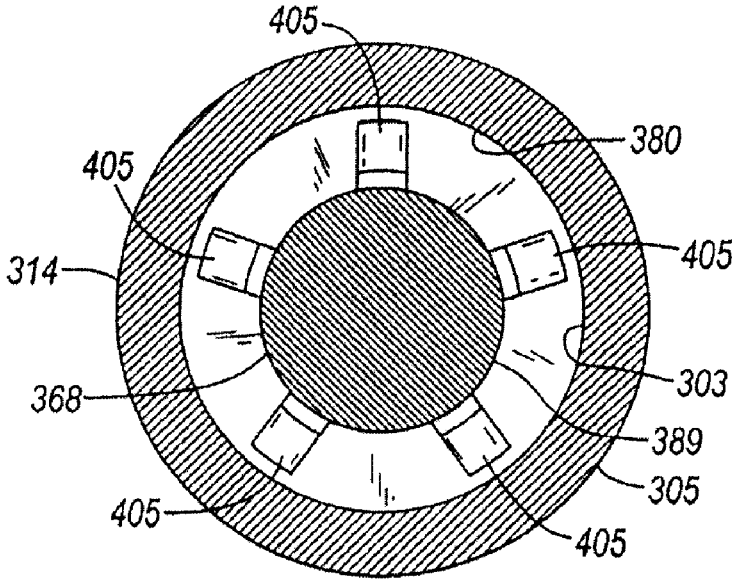
FIG. 19A is a cross sectional view of the nozzle assembly shown in FIG. 17 taken along the line 19A-19A'.
Figure 19B:
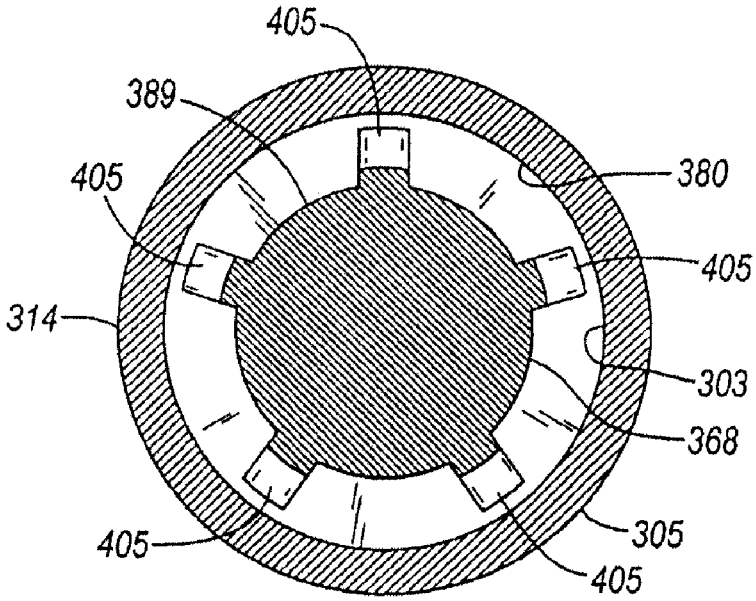
FIG. 19B is a cross sectional view of the nozzle assembly shown in FIG. 17 taken along the line 19B-19B'.

In the illustrated embodiment, the valve 368 is a plunger-type valve and has a generally frusto-conical shape that is symmetrical or substantially symmetrical about the axis A. Accordingly, the valve 368 has generally round cross sectional shapes of varying sizes (as shown in FIGS. 19A and 19B) at different points along the length of the valve 368. However, in other embodiments (not shown), the cross sectional shape of the valve 368 at any point along the valve 368 can be any other shape desired, including without limitation round, square, rectangular, triangular, oval, and irregular shapes, and the like. In addition, the valve 368 need not necessarily have a symmetrical cross sectional shape (whether about a plane or an axis) as shown in the figures, and can have a cross sectional shape that varies in any manner along the length of the valve 368.

The type and shape of the valve used in the nozzle assembly 340 of the present invention can be at least partially dependent upon the shape of the dispensing outlet 370, and vice versa. For example, in the illustrated embodiment, the valve 368 has a substantially round cross sectional shape, and at least a portion of the nozzle 314 (e.g., that portion of the nozzle 314 at the dispensing outlet 370) has a correspondingly shaped round cross section. As described above, in other embodiments (not shown), the valve 368 can have a number of different cross sectional shapes (e.g., round, square, rectangular, triangular, oval, irregular, and the like). Accordingly, in such other embodiments, at least a portion of the nozzle 314 (e.g., the dispensing outlet 370 in FIGS. 17 and 17A) can have a corresponding cross sectional shape.

With reference to FIGS. 17, 17A, 18, 19A, and 19B, an outer wall 389 of the valve 368 diverges radially outwardly from a first end 385 toward a second end 387, and defines an increasing cross sectional area of the valve 368 with increasing proximity to the second end 387 (referencing valve cross-sections taken substantially normal to the axis A of the nozzle assembly 340). In the illustrated embodiment of FIGS. 17-19B, the outer wall 389 of the valve 368 diverges gradually, in a manner similar to the gradual divergence of the previously-described internal walls 303 of the diffuser 305.

Figure 18:
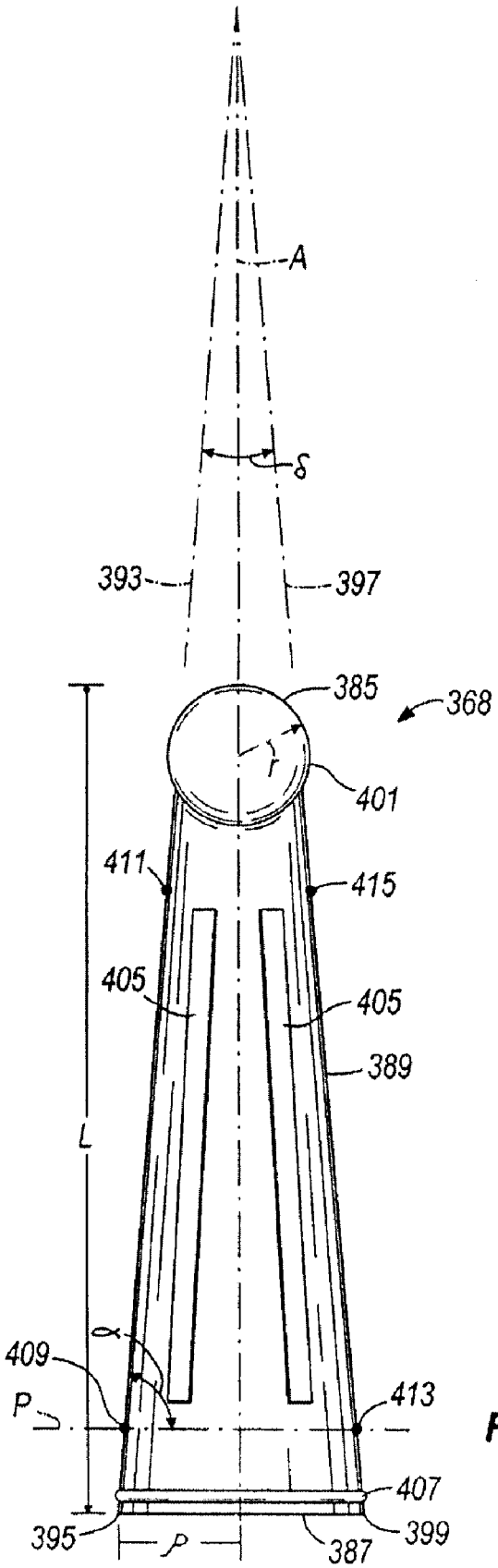
FIG. 18 is an enlarged elevational view of a valve of the nozzle assembly shown in FIG. 17 taken through the center of the valve.

As shown in FIG. 18, the second end 387 of the valve 368 has a width ρ measured between the axis A and a point 395 located on the outer perimeter of the second end 387 of the valve 368. First and second points 409, 411 are located along the outer wall 389 of the valve 368 and are spaced from the axis A by distances of 0.8ρ and 0.2ρ, respectively. A first imaginary line 393 extends through the first and second points 409, 411 toward the first end 385 of the valve 368. Third and fourth points 413, 415 are also located along the outer wall 389 of the valve 368 and are spaced from the axis A by distances of 0.8ρ and 0.2ρ, respectively. A second imaginary line 397 extends through the third and fourth points 413, 415 toward the first end 385 of the valve 368 and intersects the first imaginary line 393. The first and second imaginary lines 393, 397 are parallel or substantially parallel to the outer wall 389 of the valve 368. However, it should be understood that in some embodiments of the present invention (including the embodiment shown in FIG. 18), at least a portion of the outer wall 389 is shaped and includes concave or convex portions.

As shown in FIG. 18, the first imaginary line 393 and an imaginary plane P extending through the valve 368 and the first point 409 and intersecting the axis A at an angle of about 90 degrees define a first angle α. Together, the first and second imaginary lines 393, 397 define a second angle δ. In some embodiments, a first angle α that is at least about 60 degrees and is less than about 90 degrees provides good performance results. However, in other embodiments, a first angle α that is at least about 75 degrees and is less than about 90 degrees provides good performance results. In still other embodiments, a first angle α that is at least about 80 degrees and is less than about 90 degrees provides good performance results.

Also, in some embodiments, a second angle δ that is greater than 0 degrees and that is no greater than about 60 degrees provides good performance results. However, in other embodiments, a second angle δ that is greater than 0 degrees and is no greater than about 30 degrees provides good performance results. In still other embodiments, a second angle δ that is greater than 0 degrees and is no greater than about 20 degrees provides good performance results.

Also, in some embodiments of the present invention, the angles α, δ are selected so that the shape of the valve 368 is similar to the shape of the internal walls 303 of the diffuser 305. In these embodiments, the valve 368 and the shape of the internal walls 303 of the diffuser 305 are selected to maintain (or at least be favorable to) laminar flow of beer flowing through the nozzle assembly 340, and to prevent or reduce turbulence in the nozzle assembly 340. As mentioned above, in some embodiments of the present invention, the inner walls 303 of the diffuser 305 and the axis A can define an angle η of up to 15 degrees. Similarly, in some embodiments, one half of the second angle δ between the first and second imaginary lines 393, 397 can be as large as 30 degrees. In other embodiments, the angle ηbetween the inner walls 303 of the diffuser 305 and the axis A can be greater than half of the angle δ between the first and second imaginary lines 393, 397. In other embodiments, the angle η between the inner walls 303 of the diffuser 305 and the axis A can be about the same as the angle δ between the first and second imaginary lines 393, 397. In still other embodiments, the angle η between the inner walls 303 of the diffuser 305 and the axis A can be less than half of the angle δ between the first and second imaginary lines 393, 397. As explained in detail below, the corresponding shape of the internal walls 303 of the diffuser 305 and the shape of the valve 368 help prevent beer from breaking out or exploding as the pressure of the beer is reduced prior to dispense.

In some embodiments, the ratio of the length of the valve 368 to the length of the nozzle 314 at least partially defines the dispense characteristics of the nozzle assembly 340. For example, a relatively elongated valve 368 and its relationship with the length of the nozzle 314 can impact dispensing performance. In some embodiments, the length L of the valve 368 between the first and second ends 385, 387 can be approximately equal to half of the length L' of the fluid flow path between the inlet 371 and the outlet 370 of the nozzle 314. In these and other embodiments, the length L of the valve 368 is equal to at least half of the length L" of the diffuser 305 between the diffuser inlet and the diffuser outlet.

The gradual divergence of the outer wall 389 of the valve 368 is not necessarily constant along the entire length L of the valve 368. Rather, the first and second imaginary lines 393, 397 are straight lines while the outer surface 389 of the valve 368 between the first and second ends 385, 387 can have any shape desired and can be shaped. Changes in the cross sectional shape of the outer wall 389 of the valve 368 can be located on the valve 368 to correspond to corresponding changes in the cross sectional shape of the internal walls 303 of the diffuser 305, and can be selected to alter the volume and pressure of fluid flowing through the internal space 380. Accordingly, the first and second imaginary lines 393, 397 represent the mean or median cross sectional shape of the outer wall 389, and do not preclude changes in the cross sectional shape along the outer surface of the valve 368.

With reference to FIG. 18, the valve 368 has a width or radius p defined between the outer perimeter of the valve 368 (i.e., at point 395) and the axis A. As mentioned above, the valve 368 can have any cross sectional shape including square, rectangular, triangular, oval, irregular, and the like. Accordingly, in some embodiments (e.g., embodiments in which the valve has a square cross sectional shape), the term "width" refers to the distance measured along the plane P between the axis A and a point 395 located on the outer perimeter of the valve 368 at the second end 387 of the valve 368 and/or at a peripheral sealing surface of the valve 368 (in some embodiments, these two locations need not necessarily coincide). As also mentioned above, in some embodiments, the valve 368 has a generally elongated frusto-conical shape and includes a gradually outwardly sloping outer wall 389.

In some embodiments, the ratio of the length L of the valve 368 to the width ρ of the valve 368 at least partially defines the dispense characteristics of the nozzle assembly 340. For example, a relatively elongated valve 368 and its relationship with the width ρ of the valve 368 can impact dispensing performance. In some embodiments, the length L of the valve 368 is equal to or greater than 2ρ.

As mentioned above, in some embodiments of the present invention, the shape of the valve 368 can be at least partially defined by the angles α, δ described earlier. These angles α, δ can be selected so that the cross sectional shape of the outer wall 389 of the valve 368 along the length of the valve 368 generally corresponds to the cross sectional shape of the internal walls 303 of the diffuser 305 along the length of the diffuser 305. Accordingly, it should be understood that the internal walls 303 of the diffuser 305 represent the average or median slope of the internal walls 303 of the diffuser 305 or the internal walls 301 of the nozzle 314, respectively, and does not preclude the existence of changes in the cross sectional shape of the internal walls 305 of the diffuser 305 and the internal walls 301 of the nozzle 314 along the length of the diffuser 305 and the nozzle 314 respectively.

In the illustrated embodiment, the first end 385 of the valve 368 includes a nose portion 401 that is generally rounded. Although a more pointed nose at the upstream end of the valve 368 can instead be employed, a rounded nose portion 401 can reduce turbulence in the beer flowing past the valve 368. The nose portion 401 can be defined by a rounded end of a generally cone-shaped valve 368. However, in some embodiments the nose portion 401 is enlarged with respect to the adjacent portion of the valve 368, thereby defining a bulbous end of the valve 368 (such as that best shown in FIG. 18) joined to the rest of the valve 368 by a thinner neck portion.

As mentioned above, beer from a fluid source enters the nozzle assembly 340 through the output line 338 via the inlet 371. Beer can enter the internal chamber 380 of the nozzle assembly 340 at an angle ϵ of less than 90 degrees with respect to the axis A of the nozzle 314. As also explained above, the angle ϵ at which beer enters the nozzle 314 can affect the character and quality of the beer dispensed from the nozzle 314. Foaming can occur if beer is forced to abruptly change direction. Moreover, undesirable turbulence can be created if beer is forced to abruptly change direction.

Some embodiments of the nozzle assembly 340 can include one or more ribs 405 which have been found to help minimize and/or prevent turbulence in the beer flow, maintain the character and quality of the beer, and/or prevent breakout. In the illustrated embodiment of FIGS. 17-19B, a number of ribs 405 extend along a portion of the outer wall 389 of the valve 368. In some embodiments (not shown), the ribs 405 can extend along the outer wall 389 of the valve 368 and follow the shape of the outer wall 389. In these and other embodiments, the ribs 405 can extend along the outer wall 389 of the valve 368 in a direction generally parallel to the first and second imaginary lines 393, 397. Also, in some embodiments (not shown), the ribs 405 can follow a curvilinear or scroll path around at least a portion of the outer perimeter of the valve 368.

In addition to or as an alternative to ribs 405 on the valve 368 as just described, some embodiments of the present invention employ ribs 405 extending along at least a portion of the internal walls 301 of the nozzle 314. In these embodiments, the ribs 405 can help control the flow of beer through the nozzle 314 and around the valve 368, and can prevent the formation of turbulence in the beer flow by gradually transitioning the beer flow toward a generally axial flow direction (i.e., generally parallel to the axis A toward the dispensing outlet 370).

In some embodiments of the present invention, the valve 368 can be provided with a gasket 407 to form an improved seal with the nozzle 314 in a closed position of the valve 368. The gasket 407 can be located at the portion of the valve 368 functioning to seal the nozzle 314, such as at the second end 387 of the valve 368 in the illustrated embodiment of FIGS. 17-19B. In addition, the gasket 407 can provide an improved seal with the internal walls 301 of the nozzle 314 and can prevent unintended beer dispense (i.e., leaking or dripping) when the valve 368 is in a closed position. In some embodiments, the gasket 407 can be an O-ring made of any suitable resilient material such as rubber, urethane, or other elastomeric material. If desired, the gasket 407 can be retained in a groove extending circumferentially around a portion of the valve 368 or in the internal walls 301 of the nozzle 314. In other embodiments (not shown), one or more fasteners can retain the gasket 407 upon the valve 368 or on the nozzle 314.

To actuate the valve 368, a valve rod 372 is attached to or otherwise extends from the first end 385 of the valve 368 and extends through the nozzle 314 to a manual actuator (such as the actuator 374 shown in FIGS. 17 and 17A by way of example only) or a powered actuator for moving the valve 368 between the opened and closed positions. The valve rod 372 can extend to the valve 368 in any manner and from any direction permitting the valve 368 to be driven between its opened and closed positions. By way of example only, the valve rod 772 in FIGS. 17 and 17A extends through the nozzle 714 along the axis A, and is secured against rotation. In other embodiments, the actuator 374 can be located in other positions relative to the valve 368 (rather than "above" as just described) and can be attached (either directly or indirectly through one or more interconnected elements) to the valve rod 372. For example, in some embodiments, the actuator 374 or a portion of the actuator 374 (e.g., the valve rod 372) can be oriented to extend outwardly from the nozzle assembly 340 at an angle of about 90 with respect to the axis A.

The valve 368 can be moved between the opened and closed positions in any number of manners, such as by a manually operated handle, by a pneumatic or hydraulic actuator, by an electromagnetic solenoid, by a rack and pinion assembly driven in any conventional manner, by a stepper motor, and the like. In still other embodiments (not shown), the actuator 374 call include other automated and non-automated elements for moving and positioning the valve 368 between the opened and closed positions. For example, in some embodiments, the actuator 374 can include a motor (e.g., a stepper motor) and one or more gears driven by the motor to drive the valve (e.g., by driving a valve rod 372), by a belt or chain similarly driven, by a linear motor mounted directly to the end of the valve rod 372, and the like. In addition, any other valve driving device discussed above with reference to the earlier-described nozzle assemblies 40, 140 can also be used.

In the illustrated embodiment of FIGS. 17 and 17A, the actuator 374 is controllable by a user or system controller to move the valve 368 through a range of open and/or closed positions.

The valve rod 372 can maintain the valve 368 in a desired position in the internal chamber 380, can guide the valve 368 during movement between opened and closed positions, and/or can center the valve 368 with respect to the nozzle 314. In some embodiments (not shown), the valve 368 can be maintained in a desired position and one or more conventional valve guiding elements, such as one or more arms, bosses, spokes, cams, gears, and the like extending into the internal chamber 380 (e.g., from the first end 365 of the nozzle 314), can be employed to guide movement of the valve 368 and/or maintain the valve 368 in one or more desired positions (i.e., opened and closed positions).

In the illustrated embodiment of FIGS. 17 and 17A, the actuator 374 includes a handle 420 or other manually operated element or device. Although any suitable connection between the handle 420 and the valve rod 372 can be employed, the actuator 374 shown in FIGS. 17 and 17A, includes an intermediate arm 414 attached at a first end to the valve rod 372 and attached at an opposite end to the handle 420. In other embodiments (not shown), the intermediate arm 414 can be a forked portion of the handle 420, an apertured end of the handle 420, an end of the handle 420 pivotably attached to the valve rod 372 in any manner (e.g., by a pin, a hinge, and any other pivotable connection). With reference to the illustrated embodiment, the intermediate arm 414 and the handle 420 are pivotable about pivot points 416, 418, respectively. When a user pivots the handle 420 downwardly (i.e., in the direction of arrow 422 in FIG. 17), the handle 420 pivots about the pivot point 418, causing the intermediate arm 414 to pivot about the pivot point 416 and causing the valve rod 372 to move upwardly along the axis A. In alternate embodiments, other valve driving devices, such as the valve driving devices discussed above with reference to the earlier-described nozzle assemblies 40, 140, can be employed to drivably connect a handle 420 or other manually operated element or device to the valve rod 372 or to the valve 368 in any other manner.

The nozzle assembly 340 shown in FIGS. 17 and 17A can be adapted for connection to a dispensing rack in much the same manner as the nozzle assemblies 40, 140, 240 described above. Also, like the previously described nozzle assemblies 40, 140, 240, the nozzle assembly 340 can be employed in a handheld dispensing gun form. In general, the structural and operational differences between the rack-type nozzle assembly 40 and the dispensing gun nozzle assembly 140 described above are substantially similar to the structural and operational differences between the rack-type nozzle assembly 340 described and illustrated herein and a corresponding nozzle assembly 340 employed in a dispensing gun.

In some embodiments of the present invention, beer in the nozzle assembly 340 is at a pressure substantially equal to the storage pressure of beer in kegs ("rack pressure"). This pressure can be maintained at substantially all times the valve 368 is closed or during any portion of such time, and is generally too large for proper beer dispense from the nozzle assembly 340. If the beer is rapidly transferred from rack pressure to atmospheric pressure, the beer can quickly release gases (experience "carbonation breakout"), causing undesirable foaming and generally destroying the beer. As such, some embodiments of the nozzle assembly 340 operate to at least temporarily and gradually reduce the pressure of the beer in the nozzle 314 prior to opening the valve 368. Such embodiments of the nozzle assembly 340 reduce the pressure of the beer from an elevated rack pressure to a desired dispense pressure based upon the desired dispense characteristics (i.e., the amount of beer head desired) and the type and characteristics of beer being dispensed.

In operation, a user inserts at least a portion of the nozzle 314 into a vessel or container (e.g., a glass, a mug, a pitcher, and the like). The operator then operates the actuator 374 to move the valve 368 downwardly along the axis A, thereby moving the valve 368 from a closed position toward an opened position. Alternatively, in embodiments having a powered actuator, the user activates the powered actuator to move the valve 368 downwardly along the axis A. Upon being opened, the valve 368 permits beer to move through the nozzle 314 from the inlet 371 toward the dispensing outlet 370. In some embodiments, beer enters the nozzle 314 at an elevated pressure. In such embodiments beer entering the nozzle 314 through the fluid inlet 371 can enter the nozzle 314 at or near rack pressure, and travels from the output line 338 into the internal chamber 380 at an angle $\epsilon$ toward the dispensing outlet 370.

In some embodiments, movement of the valve 368 along the axis A increases the volume of the internal chamber 380, thereby lowering the pressure in the internal chamber 380. The sloped internal walls 303 of the diffuser 305 and the sloped outer wall 389 of the valve 368 provide a gradual increase in volume for the beer, thereby providing a gradual and corresponding decrease in beer pressure as the beer flows around the valve 368 and out the dispensing outlet 370. Such a gradual pressure reduction can prevent breakout of the beer, can enable faster beer dispense, and can permit better dispense control. By the time the valve 368 reaches the opened position, the pressure within at least a portion of the internal chamber 380 has been lowered to a desired dispensing pressure. In some embodiments, movement of the valve 368 along the axis A increases the volume of the internal chamber 380 and temporarily lowers the pressure at the dispensing outlet 370, after which time the pressure at the dispensing outlet 370 can gradually increase and can return to a point at or near rack pressure. In still other embodiments, movement of the valve 368 along the axis A increases the volume of the internal chamber 380 and decreases the pressure of the beer effectively and rapidly enough to allow a user to "top off" a previously dispensed beer without causing breakout.

It has been found that carbonated fluids are most likely to experience breakout when fluid flow is restricted or passes through a bottleneck, and when fluid flow is initiated or abruptly interrupted. In applications in which powered actuators are used to control the nozzle assembly 340, the actuators can rapidly move the valve 368 between opened and closed positions to minimize the amount of time the fluid passes through a relatively small restriction (i.e., while the valve 368 is being opened or closed), thereby reducing or preventing breakout.

In embodiments of the present invention in which movement of the valve 368 along the axis A increases the volume of the internal chamber 380 and provides a gradual and corresponding pressure decrease, such as the embodiment shown in FIGS. 17-19B, the sloped internal walls 303 of the diffuser 305 and the sloped outer wall 389 of the valve 368 facilitate relatively slow actuation of the valve 368 while still producing a sufficient pressure drop to generate proper dispense. In such embodiments, the relatively slow actuation of the valve 368 enables the nozzle assembly 340 to be employed with a manual actuator, such as the actuator 374 of the illustrated embodiment. In these embodiments, highly precise control and coordination of movement of the valve 368 along the axis A is not required to prevent breakout and to ensure proper dispense. Accordingly, in such embodiments, a powered actuator is not required to ensure proper dispense. Additionally, in such embodiments, the relatively slow actuation of the valve 368 enables the nozzle assembly 340 to be used in applications (such as in stadiums, arenas, large bars or restaurants, and the like) in which the beer is pumped along substantial distances at an elevated pressure from storage tanks to the nozzle assembly 340 while still ensuring proper dispense and preventing fluid breakout.

In some embodiments of the present invention (such as the illustrated embodiment of FIGS. 17-19B), the cross sectional area of the interior space 380 between the imaginary lines 393, 397 (i.e., the outer surface 389) of the valve 368 and the interior walls 303 of the diffuser 305 increases between the diffuser inlet and the diffuser outlet. As shown in FIGS. 19A and 19B, the cross sectional area of the interior space 380 taken along plane 19A-19A' is approximately equal to the cross sectional area of the interior space 380 minus the cross sectional area of the valve 369 taken along plane 19A-19A', and the cross sectional area of the interior space 380 taken along the plane 19B-19B' is approximately equal to the cross sectional area of the interior space minus the cross sectional area of the valve 368 taken along plane 19B-19B'. Thus, as the interior walls 303 of the diffuser 305 and the outer wall 389 of the valve 368 diverge outwardly from the axis A, the volume of the interior space 380 available for fluid flow increases. In some embodiments (such as the illustrated embodiment of FIGS. 17-19B), the volume of the interior space 380 available for fluid flow increases gradually at a substantially constant rate along the length of the axis A between the diffuser inlet and the diffuser outlet. In addition and as mentioned above, the walls 303 of the diffuser 305 can have any cross sectional shape and can diverge in any manner (rapidly diverging walls, more gradually diverging walls, stepped walls, and the like). Similarly, the valve 368 can have any cross sectional shape, and the outer wall 389 of the valve 368 can diverge in any manner (rapidly diverging walls, more gradually diverging walls, stepped walls, and the like), and need not necessarily have a constant cross sectional shape along its length between the first and second ends 385, 387. Accordingly, in other embodiments of the present invention, the volume of the interior space 380 available for fluid flow can increase at a non-constant rate, or can increase in stages.

Due to the sloped sides of the valve 368 and, in some embodiments, the correspondingly sloped internal walls 303 of the diffuser 305, the beer exits the dispensing outlet 370 at an angle with respect to the axis A. Depending at least in part upon the positional relationship of the valve 368 and the nozzle 314 when the valve 368 is in an opened position, in some embodiments the sloped sides of the valve 368 can direct beer exiting the nozzle assembly 340 radially outwardly and axially downwardly. However, it should be noted that in other embodiments of the present invention, such as embodiments with differently shaped valves 368, the beer does not flow radially out of the dispensing outlet 370. Rather, in these embodiments, the beer can instead flow from the dispensing outlet 370 in a downward stream, a fan, or any other flow shape desired. In addition, the sloped internal walls 303 of the diffuser 305 and the sloped outer wall 389 of the valve 368 can provide a gradual change in the flow path of the beer through the nozzle 314, which prevents (or at least reduces) the formation of turbulence in the beer as the beer is dispensed.

In embodiments of the present invention in which the valve 368 and/or the internal walls 301 of the internal chamber 380 have ribs 405 as described above, the ribs 405 can gradually change the flow direction of the beer flowing through the nozzle 314. As described above, beer can enter the internal chamber 380 at an angle $\epsilon$. As the beer contacts the ribs 405, the ribs 405 can direct the beer axially along the outer wall 389 of the valve 368 and the internal walls 301 of the nozzle 314 toward the dispensing outlet 370 in order to prevent the beer from swirling radially around the valve 368.

After an initial amount of beer is dispensed into a vessel, in some embodiments at least a portion of the nozzle 314 can be kept beneath the surface of the beer in the vessel. In this manner, additional beer dispensed into the vessel is dispensed to the vessel with less foaming and with less loss of carbonation. When the user finishes dispensing beer into the vessel, the user moves the valve 368 from the opened position to the closed position and can move the vessel away from the nozzle 314. In some embodiments, the sloped inner wall 303 of the diffuser 305 and/or the sloped outer wall 389 of the valve 368 prevent and/or minimize the formation of a water hammer effect when the valve 368 is moved to the closed position, thereby preventing the formation of pressure spikes through the nozzle assembly 340 and preventing and/or minimizing breakout when the valve 368 is moved toward the closed position.

Figure 20:
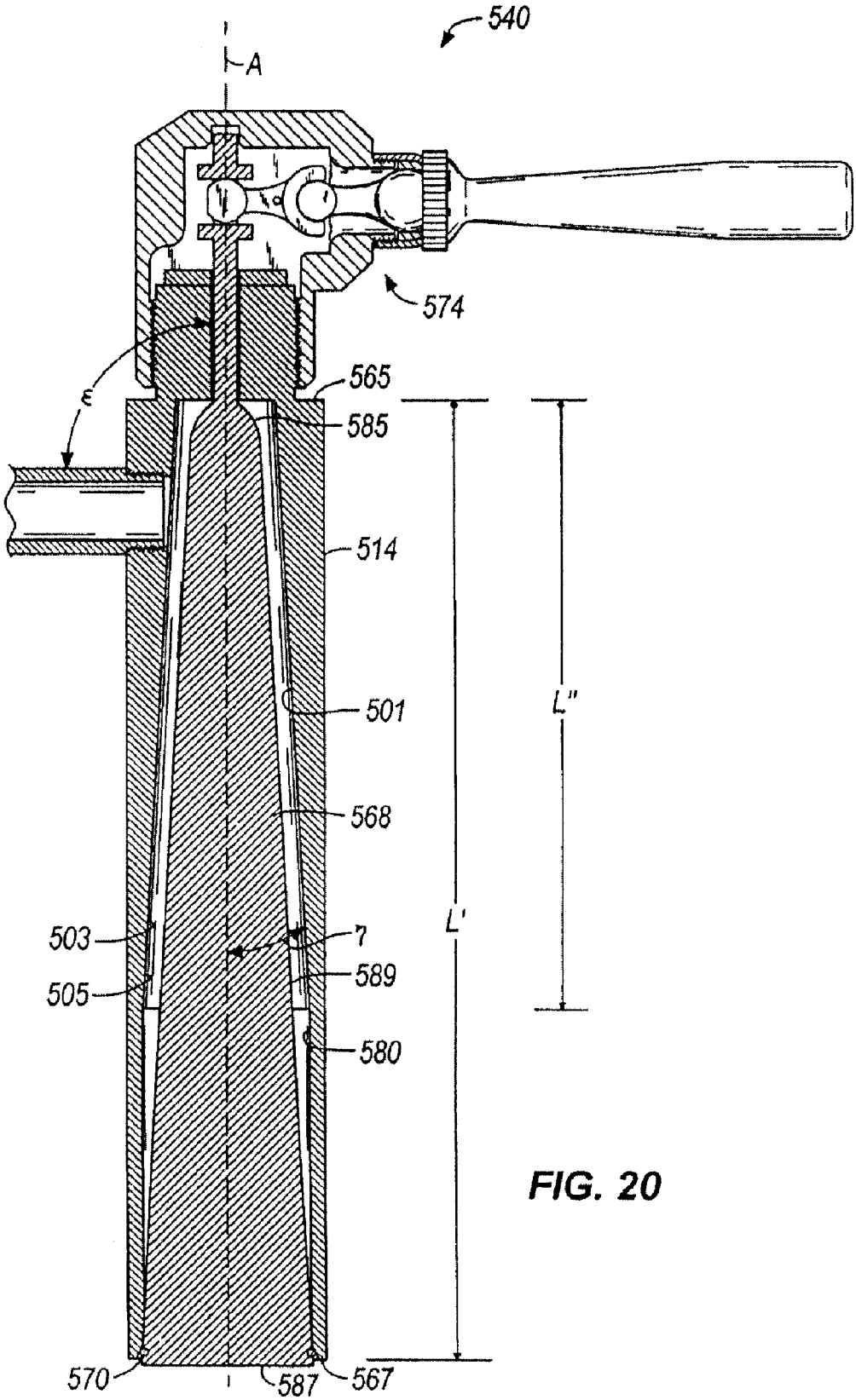
FIG. 20 is an elevational cross section view of a nozzle assembly associated with a third embodiment of the present invention.
Figure 20A:
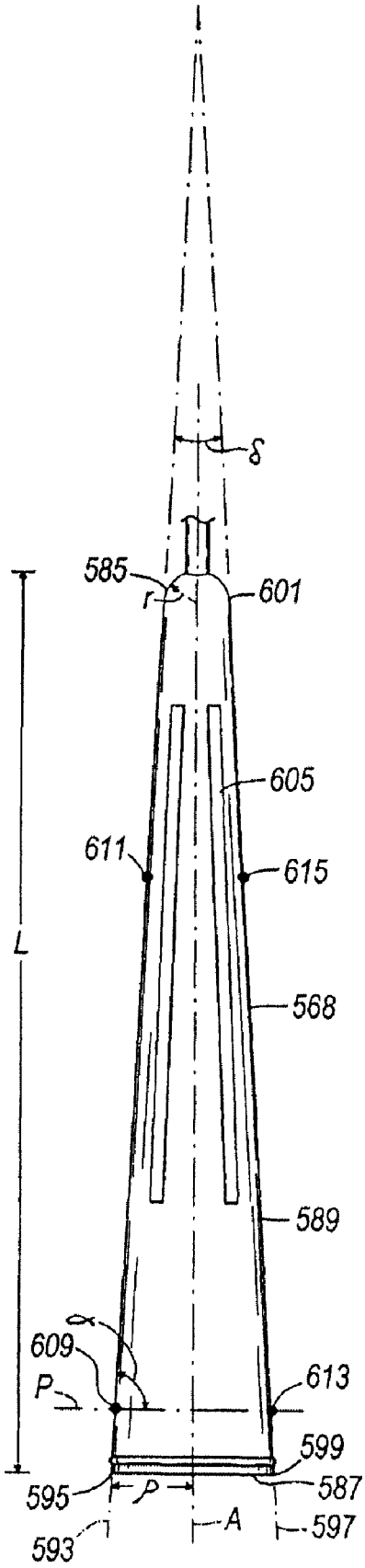
FIG. 20A is an enlarged elevational view of a valve of the nozzle assembly shown in FIG. 19 taken through the center of the valve.

FIGS. 20 and 20A illustrate yet another embodiment of a nozzle assembly according to the present invention. The nozzle assembly illustrated in FIGS. 20 and 20A, is similar in many ways to the illustrated embodiments of FIGS. 1-19B described above. Accordingly, with the exception of mutually inconsistent features and elements between the embodiment of FIGS. 20 and 20A and the embodiments of FIGS. 1-19B, reference is hereby made to the description above accompanying the embodiments of FIGS. 1-19B for a more complete description of the features and elements (and the alternatives to the features and elements) of the embodiment of FIGS. 20 and 20A. Features and elements in the embodiment of FIGS. 20 and 20A corresponding to features and elements in the embodiments of FIGS. 1-19B are numbered in the 500 and 600 series.

The nozzle assembly 540 includes a nozzle 514 having a first end 565, a second end 567, internal walls 501, and a reservoir or internal chamber 580 through which fluid flows to a dispensing outlet 570. The nozzle 514 has a generally tubular shape and includes a diffuser 505 extending between the first and second ends 565, 567. In the embodiment illustrated in FIGS. 20 and 20A, the diffuser 505 extends along approximately two-thirds of the length of the nozzle 514. In such embodiments, the nozzle assembly 540 of the present invention can have a length that is sufficient to accommodate the valve 568 while still being relatively short (compared to nozzle assemblies in which the valve 568 occupies less than the length of the nozzle 514). In other embodiments, such a result can still be achieved by employing a valve 568 that extends along less than the entire length of the internal chamber 580. For example, good flow performance and relatively compact size can be achieved in embodiments in which the valve 568 extends along at least 70% of the length of the internal chamber 580. In other embodiments, good flow performance can be achieved in embodiments in which the valve 568 extends along at least 80% of the length of the internal chamber 580.

With continued reference to the illustrated nozzle assembly 540 of FIGS. 20 and 20A, the internal walls 503 of the diffuser 505 extend outwardly away from the axis A, and define an increasing cross sectional area of the internal chamber 580 with increased proximity to the dispensing outlet 570 of the nozzle 514 along at least a portion of the length of the internal chamber 580. The diffuser 505 in the embodiment of FIG. 20 has a generally frusto-conical shape. The cross sectional area of the diffuser entrance is therefore smaller than the cross sectional area of the diffuser exit. In the illustrated embodiment of FIG. 20, the internal walls 503 of the diffuser 505 diverge gradually outwardly from the axis A. However, the internal walls 503 can diverge at any other rate or combinations of rates as desired, all of which result in an increasing internal chamber cross sectional area of the diffuser 505.

In some embodiments of the present invention, the internal walls 503 of the diffuser 505 diverge outwardly at an angle $\eta$ with respect to the axis A. As mentioned above, the diffuser walls 503 can be shaped in a number of different manners and need not necessarily have a constant cross sectional shape. This angle $\eta$ can take any of the values described above with reference to the illustrated embodiments of FIGS. 17, 17A, 18, 19A, and 19B.

With continued reference to the illustrated embodiment of FIGS. 20 and 20A, when the valve 568 is in the closed position, the first end 585 of the valve 568 is adjacent to the first end 565 of the nozzle 514, and the outer periphery of the second end 587 of the valve 568 is in sealing engagement with the internal walls 503 of the diffuser 505, thereby preventing fluid flow out of the nozzle assembly 540 through the dispensing outlet 570. When the valve 568 is in the opened position in this embodiment, the first end 585 of the valve 568 is spaced a distance from the first end 565 of the nozzle 514 and the second end 587 of the valve 568 extends outwardly through the dispensing outlet 570. In other embodiments, the valve 568 can remain partially or fully recessed within the nozzle 514 in the open position of the valve 568 (in which case the internal walls 503 of the nozzle 514 adjacent to the open valve 568 can be shaped and dimensioned to permit fluid flow past the open valve 568). Also, when the valve 568 is in the opened position, the fluid flow path extends along all or a substantial portion of the length of the valve 568.

Similar to the valve 368 described above with reference to FIGS. 17-19B, an outer wall 589 of the valve 568 diverges radially outwardly from the first end 585 toward the second end 587 and defines an increasing cross sectional area of the valve 568 with increasing proximity to the second end 587 (referencing valve cross-sections taken substantially normal to the axis A of the nozzle assembly 540). In the illustrated embodiment of FIGS. 20 and 20A, the outer wall 589 of the valve 568 diverges gradually, in a manner similar to the gradual divergence of the previously described internal walls 503 of the diffuser 505.

As shown in FIG. 20A, the second end 587 of the valve 568 has a width $\rho$ measured between the axis A and a point 595 located on the outer perimeter of the second end 587 of the valve 567. First and second points 609, 611 are located along the outer wall 589 of the valve 568 and are spaced from the axis A by distances of $0.8\rho$ and $0.2\rho$, respectively. A first imaginary line 593 extends through the first and second points 609, 611 toward the first end 585 of the valve 568. Third and fourth points 613, 615 are also located along the outer wall 589 of the valve 589 and are spaced from the axis A by distances of $0.8\rho$ and $0.2\rho$, respectively. A second imaginary line 597 extends through the third and fourth points 613, 615 toward the first end 585 of the valve 568 and intersects the first imaginary line 593. The first and second imaginary lines 593, 597 are parallel or substantially parallel to the outer wall 589 of the valve 568. However, it should be understood that in some embodiments of the present invention (including the embodiment shown in FIGS. 20 and 20A), at least a portion of the outer wall 589 is shaped and includes concave or convex portions. Accordingly and as mentioned above, the first and second imaginary lines 593, 597 represent the mean or median cross sectional shape of the outer wall 589, and do not preclude changes in the cross sectional shape of the valve 568.

As shown in FIG. 20A, the first imaginary line 593 and an imaginary plane 1' extending through the valve 568 and the first point 609 and intersecting the axis A at an angle of about 90 degrees define a first angle $\delta$. Together, the first and second imaginary lines 593, 597 define a second angle $\delta$. In various embodiments of the present invention, the valve 568 can have a number of different configurations. Accordingly the first and second angles $\alpha$, $\delta$ can have a number of different values, as described in greater detail above with respect to the embodiment of FIGS. 17-19B. The possible values of these angles $\alpha$, $\delta$ described above with reference to FIGS. 17-19B apply equally to the embodiment of FIGS. 21 and 21A.

Also, in some embodiments of the present invention, the angles $\alpha$, $\delta$ are selected so that the shape of the outer wall 589 of the valve 568 is similar to the shape of the internal walls 503 of the diffuser 505. In these embodiments, the valve 568 and the shape of the internal walls 503 of the diffuser 505 are selected to maintain (or at least be favorable to) laminar flow of beer flowing through the nozzle assembly 540, and to prevent or reduce turbulence in the nozzle assembly 540. In some embodiments, the angle $\eta$ between the inner walls 503 of the diffuser 505 and the axis A can be greater than half of the angle $\delta$ between the first and second imaginary lines 593, 597. In other embodiments, the angle $\eta$ between the inner walls 503 of the diffuser 505 and the axis A can be equal to half of the angle δ between the first and second imaginary lines 593, 597. In still other embodiments, the angle η between the inner walls 503 of the diffuser 505 and the axis A can be less than half of the angle δ between the first and second imaginary lines 593, 597. As explained in detail below, the corresponding shape of the internal walls 503 of the diffuser 505 and the shape of the valve 568 help prevent beer from breaking out or exploding as the pressure of the beer is reduced prior to dispense.

In some embodiments, the ratio of the length of the valve 568 to the length of the nozzle 514 at least partially defines the dispense characteristics of the nozzle assembly 540. For example, a relatively elongated valve 568 and its relationship with, the length of the nozzle 514 can impact dispensing performance. The possible relationships of the length of the valve 568 to that of the flow path through the nozzle 514 and to the length of the diffuser is described in greater detail with respect to the embodiment of FIGS. 17-19B above.

As mentioned above, in some embodiments of the present invention, the shape of the valve 568 can be at least partially defined by the angles α, δ described earlier. These angles α, δ can be selected so that the cross sectional shape of the outer wall 589 of the valve 568 along the length of the valve 568 generally corresponds to the cross sectional shape of the internal walls 503 of the diffuser 505 along the length of the diffuser 505. Accordingly, it should be understood that the internal walls 503 of the diffuser 505 represent the mean or median slope of the internal walls 503 of the diffuser 505 or the internal walls 501 of the nozzle 514, respectively, and does not preclude the existence of changes in the cross sectional shape of the internal walls 505 of the diffuser 505 and the internal walls 501 of the nozzle 514 along the length of the diffuser 505 and the nozzle 514 respectively.

With reference to FIG. 20A, the valve 568 has a width or radius p defined between the outer perimeter of the valve 568 (i.e., at point 595) and the axis A. As mentioned above, the valve 568 can have any cross sectional shape including square, rectangular, triangular, oval, irregular, and the like. Accordingly, in some embodiments (e.g., embodiments in which the valve has a square cross sectional shape), the term "width" refers to the distance measured along the plane P between the axis A and a point 595 located on the outer perimeter of the valve 568 at the second end 587 of the valve 568 and/or at a peripheral sealing surface of the valve 568 (in some embodiments, these two locations need not necessarily coincide). As also mentioned above, in some embodiments, the valve 568 has a generally elongated frusto-conical shape and includes a gradually outwardly sloping outer wall 589. In some embodiments, the ratio of the length L of the valve 568 to the width ρ of the valve 568 at least partially defines the dispense characteristics of the nozzle assembly 540. For example, a relatively elongated valve 568 and its relationship with the width ρ of the valve 568 can impact dispensing performance. In some embodiments, the length L of the valve 568 is equal to at least 2ρ.

Like the valve 368 in the embodiment of FIGS. 17-19B, the first end 585 of the valve 568 illustrated in FIGS. 20 and 20A is generally rounded to gradually divert beer flow outwardly around the valve 568 toward the internal walls 503 of the diffuser 505, thereby reducing or preventing the formation of turbulence in beer moving through the nozzle assembly 540.

In operation, a user operates the actuator 574 to move the valve 568 along the axis A from the closed position toward the opened position. Although a manual actuator is shown in FIG. 20, in other embodiments of the present invention other actuators (including powered and manually actuated devices described above with respect to the previously described embodiments) can also be used. Upon movement of the valve 568, beer enters the nozzle assembly 540 through the output line 538, and can be at or near rack pressure prior to opening of the valve 568. After the valve 568 is opened, beer enters the internal chamber 580 at an angle ϵ described in greater detail above. As the beer contacts the leading or first end of the valve 568, the rounded outer first end 585 of the valve 568 gradually directs the beer outwardly around the valve 568 and toward the internal walls 503 of the diffuser 505. Additionally, in embodiments of the valve 568 having ribs 605 (described above), the ribs 605 can transition beer flow toward a generally axial flow path (i.e., generally parallel to the axis A and outwardly toward the dispensing outlet 570). As shown in FIG. 20A, ribs 605 can extend along a portion of the length of the valve 568, or alternatively, can extend along the length of the valve 568 between the first and second ends 585, 587.

With continued reference to the illustrated embodiment of FIGS. 20 and 20A, movement of the valve 568 along the axis A toward the opened position increases the volume of the internal chamber 580, thereby at least temporarily lowering the pressure in the internal chamber 580 and reducing pressure of the beer from an elevated pressure (e.g., rack pressure in some embodiments) toward a reduced dispense pressure. The gradual reduction in pressure is facilitated by the sloped internal walls 503 of the diffuser 505 and the sloped outer wall 589 of the valve 568, which together provide a gradual increase in the volume of the internal chamber 580 upon opening the valve 568, thereby allowing a gradual and corresponding decrease in beer pressure as the beer flows toward the dispensing outlet 570. In this manner, this embodiment reduces the likelihood of gas breakout.

After the user has dispensed an amount of beer into a vessel, the operator can move the actuator toward a closed position, causing the valve 568 to move along the axis A toward the closed position to seal the dispensing outlet 570 and stop the dispense of beer. In some embodiments, the nozzle assembly 540 can be actuated manually (i.e., by a manual lever or other actuator) or by a powered actuator as described above while still enabling rapid and controlled dispense.

Figure 21:
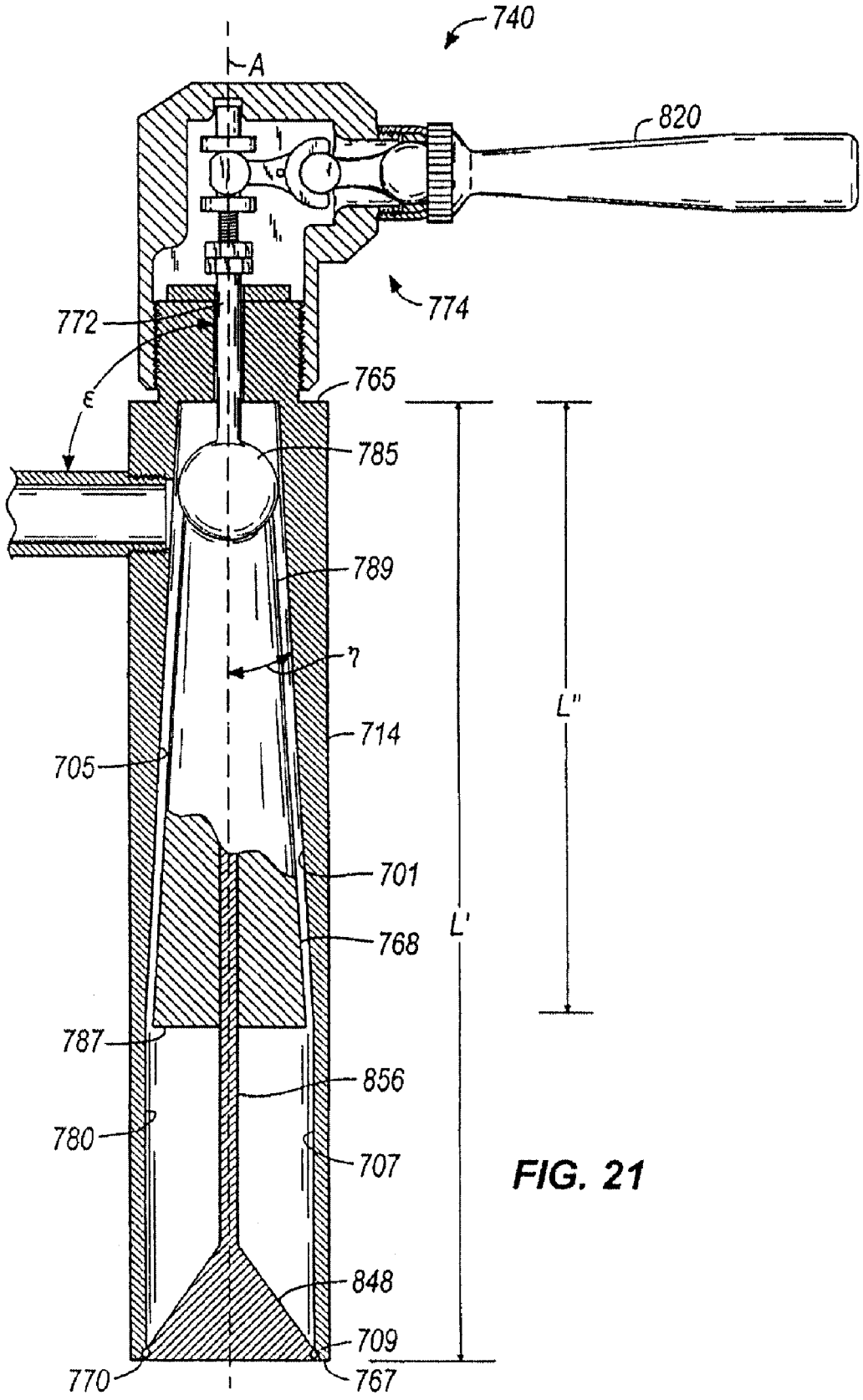
FIG. 21 is an elevational cross section view of a nozzle assembly associated with a fourth embodiment of the present invention.
Figure 21A:
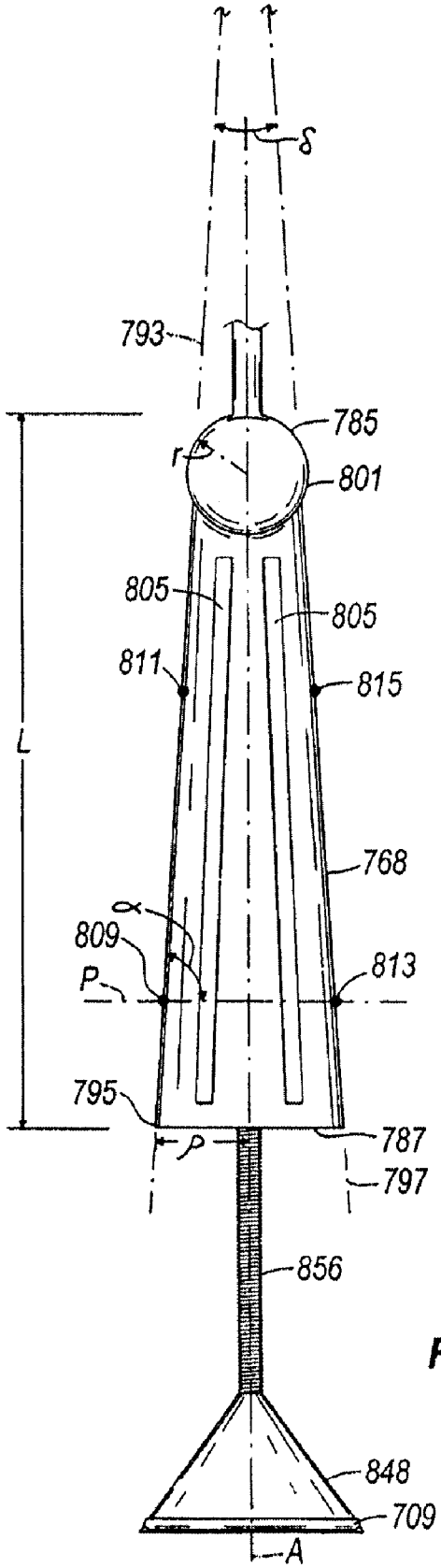
FIG. 21A is an enlarged elevational view of a valve of the nozzle assembly shown in FIG. 20 taken through the center of the valve.

FIGS. 21 and 21A illustrate yet another embodiment of a nozzle assembly according to the present invention. The nozzle assembly 740 in FIGS. 21 and 21A is similar in many ways to the illustrated embodiments of FIGS. 1-20A described above. Accordingly, with the exception of mutually inconsistent features and elements between the embodiment of FIGS. 21 and 21A and the embodiments of FIGS. 1-20A, reference is hereby made to the description above accompanying the embodiments of FIGS. 1-20A for a more complete description of the features and elements (and the alternatives to the features and elements) of the embodiment of FIGS. 21 and 21A. Features and elements in the embodiment of FIGS. 21 and 21A corresponding to features and elements in the embodiments of FIGS. 1-20A are numbered in the 700 and 800 series.

The nozzle assembly 740 includes a nozzle 714 having a first end 765, a second end 767, internal walls 701, and a reservoir or internal chamber 780 defined at least in part by the internal walls 701. As explained in greater detail below, the nozzle 714 and the dispensing outlet 770 located at the second end 767 of the nozzle 714 are shaped to permit movement of first and second valves 768, 848 in telescoping relationship with respect to the nozzle 714. In the illustrated embodiment, the nozzle 714, the first and second valves 768, 848, and the dispensing outlet 770 have round cross-sectional shapes permitting the valves 768, 848 to move in telescoping relationship within the nozzle 714. The nozzle 768 and valves 768, 848 can have any cross-sectional shape described above (referring to cross-sections taken substantially perpendicular to the axis A) in connection with the earlier embodiments of FIGS. 1-20A.

The nozzle 714 of the illustrated embodiment of FIGS. 20 and 20A is generally tubular in shape and includes a diffuser 705 having an increasing cross sectional area between an entrance and an exit of the diffuser 705. The cross sectional area of the diffuser inlet is therefore smaller than the cross sectional area of the diffuser exit. The diffuser 705 can define any portion or all of the internal chamber 780, and can be located at any point along the length of the internal chamber 780 and nozzle 714.

As shown in FIGS. 21 and 21A, at least a portion of the internal walls 701 is sloped or angled outwardly away from the axis A to define a diffuser 705 of the nozzle assembly 740. The internal walls 703 of the diffuser 705 are generally frusto-conical and elongated in shape, and diverge outwardly from the axis A toward the dispensing outlet 770. In some embodiments, the internal walls 703 define an increasing cross sectional area of the internal chamber 780 with increased proximity to the dispensing outlet 770 along at least a portion of the length of the diffuser 705. In such embodiments, the cross sectional area of the upper end of the diffuser 705 is therefore smaller than the cross sectional area of the diffuser exit.

In the illustrated embodiment, the internal walls 703 of the diffuser 705 diverge gradually and at a substantially constant rate. However, the diffuser walls 703 can diverge at any other rate or combinations of rates as desired, all of which result in an increasing internal chamber cross sectional area of the diffuser 705.

In some embodiments of the present invention, the internal walls 703 of the diffuser 705 diverge outwardly at an angle $\eta$ with respect to the axis A. As mentioned above, the diffuser walls 703 can be shaped in a number of different manners and need not necessarily have a constant cross sectional shape. This angle $\eta$ can take any of the values described above with reference to the illustrated embodiments of FIGS. 17, 17A, 18, 19A, and 19B. As also explained above with respect to the previously described embodiments, the diffuser 705 does not need to define a linearly or gradually increasing internal chamber or cross sectional area. Instead, the cross sectional area in the diffuser 705 can increase non-linearly, in a graduated or staged manner, or in any other manner desired.

As with the earlier-described embodiments of the present invention, the diffuser 705 can define all or part of the internal chamber 780 and can be located at any point therealong. In the illustrated embodiment of FIGS. 21 and 21A, the diffuser 705 is located a distance upstream of the dispensing outlet 770. Locating the diffuser 705 in this manner can provide improved fluid flow and dispensing results. With reference to FIG. 21, the portion of the internal chamber 780 between the diffuser 705 and the dispensing outlet 770 can have a substantially round and constant cross sectional area. In other embodiments, this downstream portion 707 of the internal chamber 780 can take any shape and can define a varying shape and/or cross-sectional area along its length (in the same manner as described above with reference to the embodiments of FIGS. 1-20B).

In the illustrated embodiment of FIGS. 21 and 21A, the first valve 768 is a plunger-type valve and provides a seal against the internal walls 701 of the nozzle 714. The valve 768 is moveable axially through the internal chamber 780 through a range of positions. In the illustrated embodiment of FIGS. 21 and 21A, the first valve 768 is moveable between a first or opened position and a second or closed position and a range of opened positions between the first and second positions, thereby providing for different flow rates. In other embodiments however, the first valve 768 is moveable axially through the internal chamber 780 but does not sealingly engage the internal walls 701 of the nozzle 714, and consequently, does not prevent fluid flow through the nozzle 714 between opposite sides of the first valve 768.

With continued reference to the embodiment illustrated in FIGS. 21 and 21A, the first valve 768 has a generally frusto-conical shape and has generally round cross sectional shapes of varying sizes at different points along the length of the first valve 768. The outer wall 789 of the first valve 768 diverges outwardly from a first end 785 toward a second end 787 and defines an increasing cross sectional area of the first valve 768 with increasing proximity to the second end 787.

As shown in FIG. 21A, the second end 787 of the first valve 768 has a width $\rho$ measured between the axis A and a first point 795 located on the outer perimeter of the second end 587 of the first valve 768. First and second points 809, 811 are located along the outer wall 789 of the first valve 768 and are spaced from the axis A by distances of $0.8\rho$ and $0.2\rho$, respectively. A first imaginary line 793 extends through the first and second points 809, 811 toward the first end 785 of the first valve 768. Third and fourth points 813, 815 are also located along the outer wall 789 of the valve 768 and are spaced from the axis A by distances of $0.8\rho$ and $0.2\rho$, respectively. A second imaginary line 797 extends through the third and fourth points 413, 415 toward the first end 785 of the valve 768 and intersects the first imaginary line 793. The first and second imaginary lines 793, 797 are parallel or substantially parallel to the outer wall 789 of the first valve 768. However, it should be understood that in some embodiments of the present invention (including the embodiment shown in FIG. 21A), at least a portion of the outer wall 789 is shaped and includes concave or convex portions. Accordingly and as mentioned above, the first and second imaginary lines 793, 797 represent the mean or median shape of the outer wall 789, and do not preclude changes in the cross sectional shape located along the outer surface of the valve 768.

As shown in FIG. 21A, the first imaginary line 793 and an imaginary plane P extending through the first valve 768 and the first point 809 and intersecting the axis A at an angle of about 90 degrees define a first angle $\alpha$. Together, the first and second imaginary lines 593, 597 define a second angle $\delta$. In various embodiments of the present invention, the first valve 768 can have a number of different configurations. Accordingly the first and second angles $\alpha$, $\delta$ can have a number of different values, as described in greater detail above with respect to the embodiment of FIGS. 17-19B. The possible values of these angles $\alpha$, $\delta$ described above with reference to FIGS. 17-19B apply equally to the embodiment of FIGS. 21 and 21A. As mentioned above, the diffuser walls 703 can be shaped in a number of different manners and need not necessarily have a constant cross sectional shape.

With continued reference to the illustrated embodiment of FIGS. 21 and 21A, in some embodiments of the present invention, the angles $\alpha$, $\delta$ are selected so that the shape of the first valve 768 is similar to the shape of the internal walls 703 of the diffuser 705. In these embodiments, the valve 768 and the shape of the internal walls 703 of the diffuser 705 are selected to maintain (or at least be favorable to) laminar flow of beer flowing through the nozzle assembly 740, and to prevent or reduce turbulence in the nozzle assembly 740. In some embodiments, the angle $\eta$ between the inner walls 703 of the diffuser 705 and the axis A can be greater than half of the angle $\delta$ between the first and second imaginary lines 793, 797. In still other embodiments, the angle ti between the inner walls 703 of the diffuser 705 and the axis A can be equal to half of the angle δ between the first and second imaginary lines 793, 797. In other embodiments, the angle η between the inner walls 703 of the diffuser 705 and the axis A can be less than half of the angle δ between the first and second imaginary lines 793, 797. As explained in detail below, the corresponding shape of the internal walls 703 of the diffuser 705 and the shape of the valve 768 help prevent beer from breaking out or exploding as the pressure of the beer is reduced prior to dispense.

In some embodiments, the ratio of the length of the first valve 768 to the length of the nozzle 714 at least partially defines the dispense characteristics of the nozzle assembly 740. For example, a relatively elongated valve 768 and its relationship with the length of the nozzle 714 can impact dispensing performance. The possible relationships of the length of the valve 768 to that of the flow path through the nozzle 714 and to the length of the diffuser 705 is described in greater detail with respect to the embodiment of FIGS. 17-19B above.

The gradual divergence of the outer wall 789 of the first valve 768 is not necessarily constant along the entire length L of the first valve 768. Rather, the first and second imaginary lines 793, 797 are straight lines while the outer surface 789 of the valve 768 between the first and second ends 785, 787 can have any shape desired and can be shaped. Changes in the cross sectional shape of the outer wall 789 of the valve 768 can be located on the valve 768 to correspond to corresponding changes in the cross sectional shape of the internal walls 703 of the diffuser 705, and can be selected to alter the volume and pressure of fluid flowing through the internal space 780. Accordingly, the first and second imaginary lines 793, 797 represent the average or median cross sectional shape of the outer wall 789 and do not preclude changes in the cross sectional shape of the valve 768.

With reference to FIG. 21A, the valve 768 has a width or radius p defined between the outer perimeter of the valve 768 (i.e., at point 795) and the axis A. As mentioned above, the valve 768 can have any cross sectional shape including square, rectangular, triangular, oval, irregular, and the like. Accordingly, in some embodiments (e.g., embodiments in which the valve has a square cross sectional shape), the term "width" refers to the distance measured along the plane P between the axis A and a point 795 located on the outer perimeter of the valve 768 at the second end 787 of the first valve 768 and/or at a peripheral sealing surface of the first valve 768 (in some embodiments, these two locations need not necessarily coincide). As also mentioned above, in some embodiments, the valve 768 has a generally elongated frustoconical shape and includes a gradually outwardly sloping outer wall 789. In some embodiments, the length L of the first valve 768 is equal to at least 2ρ.

Also in the illustrated embodiment of FIGS. 21 and 21A, the first end 785 of the first valve 768 can include a nose portion 801 with a rounded outer surface (described in greater detail above with reference to the embodiment of FIGS. 17-19B). This nose portion can gradually transition the flow of beer around the first valve 768, minimizing or preventing the formation of turbulence in beer through the nozzle assembly 740.

To further reduce or prevent the formation of turbulence in the flow of beer through the nozzle assembly 740, the first valve 768 and/or the internal walls 703 of the nozzle 714 can include ribs 805 extending along a portion or all of the outer wall 789 and internal walls 703, respectively. If employed, such ribs 805 can take any form described above with reference to the embodiment of FIGS. 17-20A. The first valve 768 can be driven or operated by any actuator described above and can be connected thereto in any manner also described above.

In the illustrated embodiment, the second valve 848 is a plunger-type valve having a generally conical shape. Any other valve shape can also be used (including without limitation a substantially flat plate, a spherical member, a cylindrical plug, a valve shape according to any of the valve embodiments described above, and the like). The second valve 848 need not necessarily be symmetrical (i.e., about a plane or an axis) as shown in FIGS. 21 and 21A.

With continued reference to illustrated embodiment of FIGS. 21 and 21A, the second valve 848 is moveable in telescoping relationship in the nozzle 714 between opened and closed positions. In some embodiments, movement of the second valve 848 is generally limited to movement through the downstream portion 707 of the internal chamber 780 (e.g., in that portion of the nozzle 714 downstream of the diffuser 705), rather than along any portion of the diffuser 705. However, in other embodiments, at least part of the movement of the second valve 848 can be within the diffuser 705. In either case, the second valve 848 can be moveable between a closed position in which at least a portion of the periphery of the second valve 848 sealingly engages the internal walls 701 or an end surface of the nozzle 714, and an opened position in which at least a portion of the second valve 848 extends outwardly through the dispensing outlet 770 or otherwise has a clearance from the nozzle 714 permitting fluid flow past the second valve 848.

Although not required to practice the present invention, the second valve 848 and/or the dispensing outlet 770 can include a gasket 709 for sealing the nozzle 714 when the second valve 848 is in the closed position. Reference is made to the earlier-described embodiments for further details regarding the gasket 709 and its manner of connection and operation.

In the illustrated embodiment of FIGS. 21 and 21A, a second valve rod 856 is shown connected to the second valve 848 for connection to the actuator 774. In some embodiments, the second valve 848 can be connected to the first valve 768 by a second valve rod or by a common valve rod shared by the first and second valves 768, 848. In still other embodiments, a single valve rod or other element can rigidly connect the second valve 848 to the first valve 768.

In some embodiments, such as the illustrated embodiment of FIGS. 21 and 21A, a first valve rod 772 includes a substantially hollow interior and the second valve rod 856 extends through the hollow portion of the first valve rod 772 between the second valve 848 and the actuator 774. The second valve rod 856 can be pivotably attached to the handle 820 for movement with the handle 820 between opened and closed positions in any of the manners described above with reference to the connection between the handle 820 and the first valve rod 772. In this manner, a user can move the first and second valves 768, 848 together between respective opened and closed positions with a common movement of the handle 820. In other embodiments, the second valve rod 856 can extend past the first valve rod 772 to another handle or other manual or powered actuator for connection thereto. In this manner, the relative positions of the first and second valves 768, 848 can be adjusted and/or the valves 768, 848 can be independently actuated. In these embodiments, a user can adjust the relative positions of the first and second valves 768, 848 to allow for different fluids having different fluid properties (i.e., different break out points, different Reynolds numbers, etc.).

In still other embodiments, the valve rod 856 can include a threaded portion and can be threaded into the hollow interior of the first valve rod 772 or into a threaded aperture in the first valve 768. In this manner, a user can rotate the second valve rod 856 to adjust the relative positions of the first and second valves 768, 848. Alternatively or in addition, the valve rod 856 can be threaded into and out of a threaded aperture in the second valve 848 for the same purpose.

To operate the nozzle assembly 740 illustrated in FIGS. 21 and 21A, a user places a vessel under the dispensing outlet 770 and actuates the handle 820 (for example, in a downward direction using the actuator and connection illustrated in FIG. 21). The actuation of the handle 820 causes the first and second valve rods 772, 856 to move the first and second valves 768, 848 downwardly along the axis A from respective closed positions toward respective opened positions. Beer then enters the internal chamber 780 through the inlet 771 and flows downwardly through the diffuser 705.

With continued reference to the embodiment of FIGS. 21 and 21A, beer enters the nozzle 714 from the output line 738 at an angle $\epsilon$. In embodiments of the present invention having ribs 805, the ribs 805 can alter the flow of beer from the output line 738 toward a generally axial path along the internal walls 701 of the nozzle 714 and along the outer wall 789 of the first valve 768, thereby reducing or preventing the formation of turbulence in the beer flow.

As discussed above, in some embodiments beer enters the nozzle assembly 740 at an elevated pressure (i.e., rack pressure). Movement of the first valve 768 along the axis A toward the opened position increases the volume of the internal chamber 780 upstream of the first valve 768, thereby at least temporarily lowering the pressure in the internal chamber 780 upstream of the first valve 768. The sloped internal walls 703 of the diffuser 705 and the sloped outer wall 789 of the first valve 768 provide a gradual increase in volume for the beer, thereby allowing a gradual and corresponding decrease in beer pressure as the beer flows around the first valve 768. The beer then moves through the downstream portion 707 of the internal chamber 780 before being dispensed from the nozzle assembly 740 through the dispense outlet 770.

After the user dispenses a desired volume of beer, the user can move the handle 820 upwardly to move the first and second valves 768, 848 toward the closed positions, thereby sealing the dispensing outlet 770 and stopping the dispense of beer.

Figure 22:
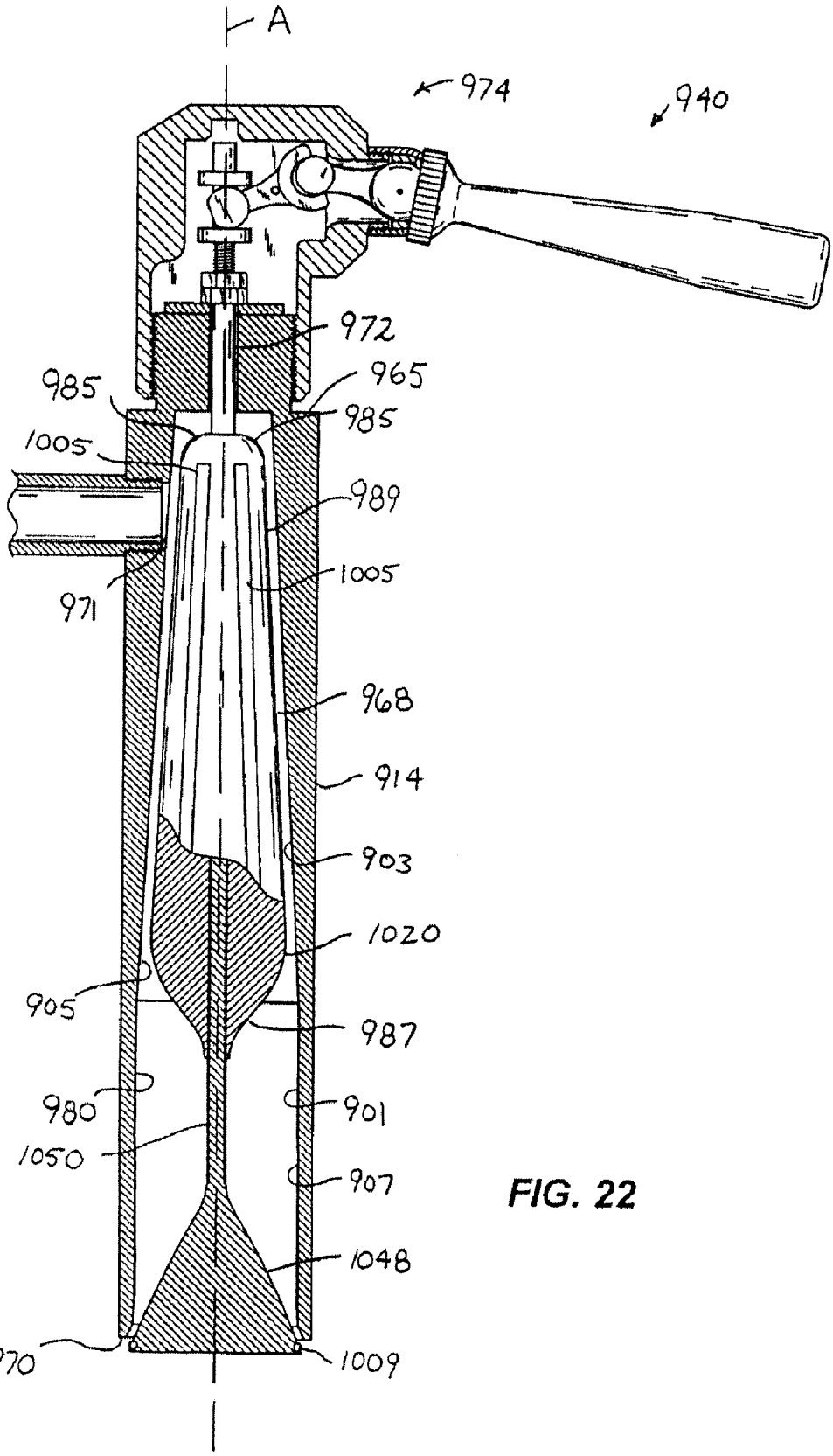
FIG. 22 is an elevational cross section view of a nozzle assembly associated with a fifth embodiment of the present invention.

FIG. 22 illustrates yet another embodiment of a nozzle assembly according to the present invention. The nozzle assembly 940 in FIG. 22 is similar in many ways to the illustrated embodiments of FIGS. 1-21A described above. Accordingly, with the exception of mutually inconsistent features and elements between the embodiment of FIG. 22 and the embodiments of FIGS. 1-21A, reference is hereby made to the description above accompanying the embodiments of FIGS. 1-21A for a more complete description of the features and elements (and the alternatives to the features and elements) of the embodiment of FIG. 22. Features and elements in the embodiment of FIG. 22 corresponding to features and elements in the embodiments of FIGS. 1-20A are numbered in the 900 and 1000 series.

The nozzle assembly 940 includes a nozzle 914 having a first end 965, a second end 967, internal walls 901, and a reservoir or internal chamber 980 defined at least in part by the internal walls 901. The nozzle 914 and the dispensing outlet 970 located at the second end 967 of the nozzle 914 are shaped to permit movement of first and second valves 968, 1048 in telescoping relationship with respect to the nozzle 914.

In the illustrated exemplary embodiment of FIG. 22, the first valve 968 has a generally frusto-conical shape and has generally round cross sectional shapes of varying sizes at different points along the length of the first valve 968. The outer wall 989 of the first valve 968 diverges outwardly from a first end 985 of the valve 968 toward a lower portion 1020, and then diverges inwardly toward a second end 987 of the valve 968. Thus, the outer wall 989 defines a generally increasing cross sectional area of the first valve 968 between the first end 985 and the lower portion 1020 which, in the illustrated embodiment has a maximum or greatest cross sectional area, and then defines a generally decreasing cross sectional area of the first valve 968 between the lower portion 1020 and the second end 987. The gradually decreasing cross sectional area of the first valve 968 at the second end of the first valve 968 can provide for improved control of beer flow passing the first valve 968, such as a greater control over flow eddies, vortices, and the like, and can help maintain laminar flow along the nozzle 914. In conjunction with the shape of the second valve 1048, the first second end 987 of the first valve 968 can partially define an hourglass-shaped portion of the internal chamber 980 through which beer flows toward the second valve 1048. In other words, the second end 987 of the first valve 968 can be tapered toward the second valve 1048, thereby providing a gradual transition from a larger diameter to a smaller diameter of the first valve 968. In some embodiments, this transition can be defined at least in part by substantially straight walls of the first valve 968 at the second end 987 thereof, although in other embodiments (such as that shown in FIG. 22), this transition can be defined at least in part by convex and/or concave surfaces of the first valve 968 extending toward the second valve 1048. Although reference is made herein to a valve 968 having a changing cross sectional area between the first and second ends 985, 987, in some embodiments of the present invention (see FIG. 23), the valve 968 can have a substantially constant cross sectional shape along at least a portion of its length between the first and second ends 985, 987.

In some embodiments, such as the illustrated exemplary embodiment of FIG. 22, the outer wall 989 of the first valve 968 can be shaped to correspond to the inner walls 901 of the nozzle 914, and can be shaped to correspond to the inner walls 903 of the diffuser 905, if desired. In such embodiments, the outer wall 989 or a portion of the outer wall 989 of the first valve 968 can converge inwardly and diverges outwardly from the axis A at locations corresponding to similarly-shaped inwardly converging and outwardly diverging portions of the inner walls 901 of the diffuser 905 and/or the inner walls 901 of other portions of the nozzle 914. Also, in such embodiments, portions of the outer wall 989 of the first valve 968 are substantially parallel to corresponding portions of the inner walls 901 of the nozzle 914 and/or the inner walls 903 of the diffuser 905. For example, in some embodiments the first valve 968 has substantially straight walls along at least a part of the length of the first valve 968. In such cases, the straight walls can be parallel to adjacent inner walls 903 of the diffuser 905.

With continued reference to the embodiment illustrated in FIG. 22, the first valve 968 is moveable axially through the internal chamber 980 through a range of opened positions providing for different flow rates. In the illustrated embodiment of FIG. 22, the outer wall 989 is spaced a distance from the internal wall 901 and does not sealingly engage the internal wall 901 of the nozzle 914, and consequently, does not prevent fluid flow through the nozzle 914 between opposite ends of the first valve 968. Accordingly, as used herein and in the claims, the term "valve" is not limited to a member or element that operates to seal and/or prevent fluid flow along a flow path or through a chamber, passage, conduit, or space.

To reduce or prevent the formation of turbulence in the flow of beer through the nozzle assembly 940, the first valve 968 and/or the internal walls 903 of the nozzle 914 can include ribs 1005 extending along a portion or all of the outer wall 989 and internal walls 903, respectively. If employed, such ribs 1005 can take any form described above with reference to the embodiment of FIGS. 17-20A.

In the illustrated exemplary embodiment of FIG. 22, the second valve 1048 has a generally conical shape. Any other valve shape can also be used (including without limitation a substantially flat plate, a spherical member, a cylindrical plug, a valve shape according to any of the valve embodiments described above, and the like). The second valve 1048 need not necessarily be symmetrical (i.e., about a plane or an axis) as shown in FIG. 22.

With continued reference to illustrated exemplary embodiment of FIG. 22, the second valve 1048 is moveable in telescoping relationship in the nozzle 914 between a closed position in which at least a portion of the periphery of the second valve 1048 sealingly engages the internal walls 901 or an end surface of the nozzle 914, and an opened position in which at least a portion of the second valve 1048 extends outwardly through the dispensing outlet 970 or otherwise has a clearance from the nozzle 914 permitting fluid flow past the second valve 1048.

Although not required to practice the present invention, the second valve 1048 and/or the dispensing outlet 970 can include a gasket 1009 for sealing the nozzle 914 when the second valve 1048 is in the closed position. Reference is made to the earlier-described embodiments for further details regarding the gasket 1009 and its manner of connection and operation.

The first and second valves 968, 1048 can be driven or operated by any actuator described above and can be connected thereto in any manner also described above. For example, in the illustrated embodiment of FIG. 22, the nozzle assembly 940 includes an actuator 974 having a first valve rod 972 connected to or integral with the first valve 968. Another rod 1050 that is connected to or integral with the second valve 1048 is threaded into an aperture in the first valve 968. Alternatively, the second rod 1050 can be integral with the first valve 968 or can be permanently or releasably connected to the first valve 968 in any manner. Any actuator can be connected to the valves 968, 1050, such as the actuators described above (e.g. manually operated actuators, pneumatic or hydraulic actuators, and actuators having electromagnetic solenoids, stepper motors, rack and pinion assemblies, or belt and chain drives).

To operate the nozzle assembly 940 illustrated in FIG. 22, a user places a vessel under the dispensing outlet 970 and actuates the actuator 974, causing the first and second valve rods 972, 1056 to move the first and second valves 968, 1048 downwardly along the axis A. Beer then enters the internal chamber 980 through the inlet 971 and flows downwardly through the diffuser 905. As discussed above, in some embodiments beer enters the nozzle assembly 940 at an elevated pressure (i.e., rack pressure). Movement of the first valve 968 along the axis A increases the volume of the internal chamber 980 upstream of the first valve 968, thereby at least temporarily lowering the pressure in the internal chamber 980 upstream of the first valve 968. The sloped internal walls 903 of the diffuser 905 and the sloped outer wall 989 of the first valve 968 provide a gradual increase in volume for the beer, thereby allowing a gradual and corresponding decrease in beer pressure as the beer flows around the first valve 968. The beer then moves through the downstream portion 907 of the internal chamber 980 before being dispensed from the nozzle assembly 940 through the dispense outlet 970.

After the user dispenses a desired volume of beer, the user can move the first and second valves 968, 1048 upwardly along the axis A and can move the second valve 1048 toward the closed position, thereby sealing the dispensing outlet 970 and stopping the dispense of beer.

Figure 23:
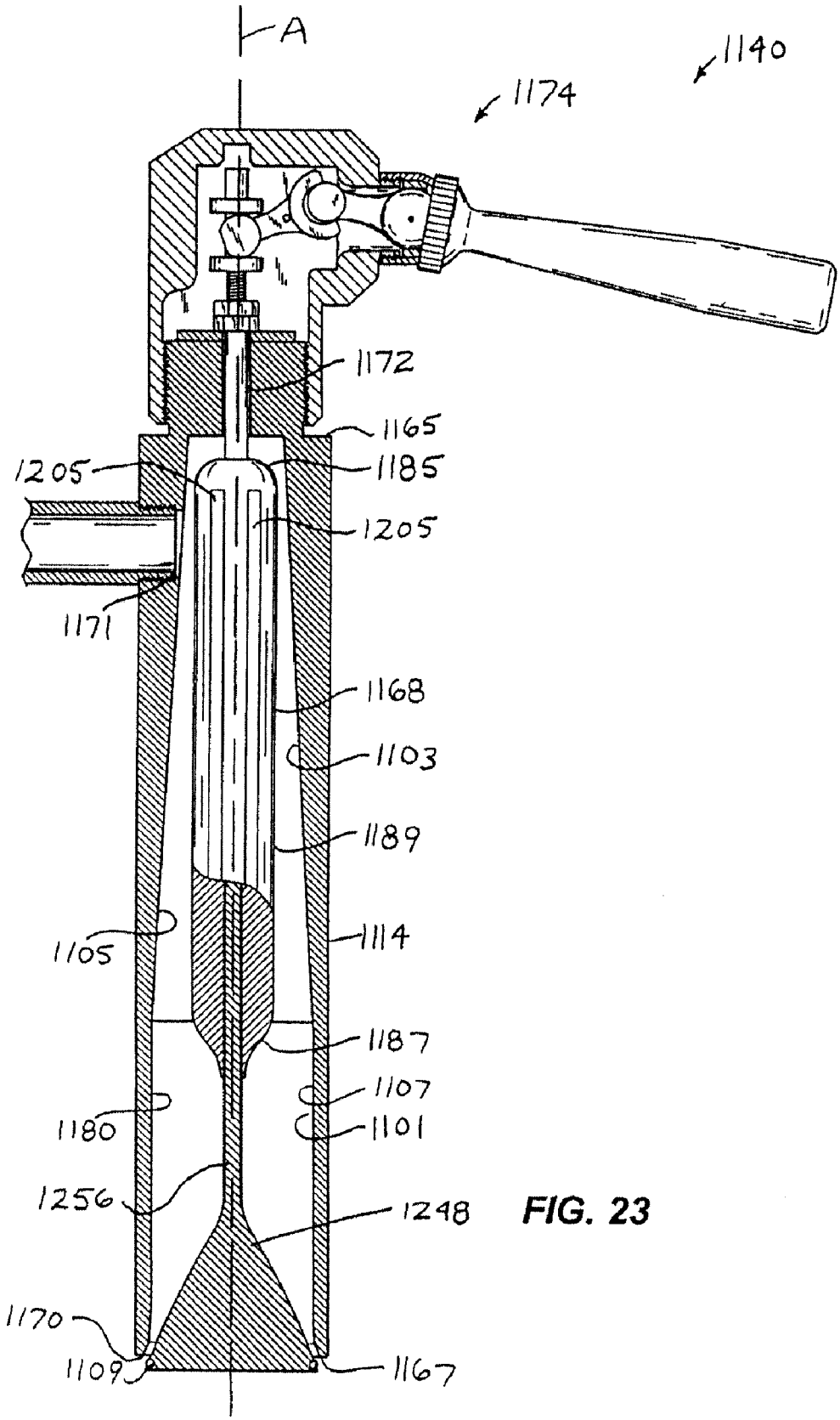
FIG. 23 is an elevational cross section view of a nozzle assembly associated with a sixth embodiment of the present invention.

FIG. 23 illustrates still another embodiment of a nozzle assembly according to the present invention. The nozzle assembly 1140 in FIG. 23 is similar in many ways to the illustrated embodiments of FIGS. 1-22 described above. Accordingly, with the exception of mutually inconsistent features and elements between the embodiment of FIG. 23 and the embodiments of FIGS. 1-22, reference is hereby made to the description above accompanying the embodiments of FIGS. 1-22 for a more complete description of the features and elements (and the alternatives to the features and elements) of the embodiment of FIG. 23. Features and elements in the embodiment of FIG. 23 corresponding to features and elements in the embodiments of FIGS. 1-22 are numbered in the 1100 and 1200 series.

The nozzle assembly 1140 includes a nozzle 1114 having a first end 1165, a second end 1167, internal walls 1101, and a reservoir or internal chamber 1180 defined at least in part by the internal walls 1101. The nozzle 1114 and the dispensing outlet 1170 located at the second end 1167 of the nozzle 1114 are shaped to permit movement of first and second valves 1168, 1248 in telescoping relationship with respect to the nozzle 1114.

In the illustrated exemplary embodiment of FIG. 23, the first valve 1168 has a generally cylindrical shape with a substantially constant cross sectional shape along substantially the entire length of the first valve 1168 between rounded first and second ends 1185, 1187. Although reference is made herein to a valve 1168 having a substantially constant cross sectional area between the first and second ends 1185, 1187, in some embodiments of the present invention, the first valve 1168 can have a changing cross sectional shape along at least a portion of its length between the first and second ends 1185, 1187.

With continued reference to the exemplary embodiment illustrated in FIG. 23, the first valve 1168 is moveable axially through the internal chamber 1180 through a range of opened positions providing for different flow rates. In the illustrated embodiment of FIG. 23, the outer wall 1189 is spaced a distance from the internal wall 1101 and does not sealingly engage the internal wall 1101 of the nozzle 1114, and consequently, does not prevent fluid flow through the nozzle 1114 between opposite ends of the first valve 1168.

To reduce or prevent the formation of turbulence in the flow of beer through the nozzle assembly 1140, the first valve 1168 and/or the internal walls 1103 of the nozzle 1114 can include ribs 1205 extending along a portion or all of the outer wall 1189 and internal walls 1103, respectively. If employed, such ribs 1205 can take any form described above with reference to the embodiment of FIGS. 17-20A.

In the illustrated embodiment of FIG. 23, the second valve 1248 has a generally conical shape. Any other valve shape can also be used (including without limitation a substantially flat plate, a spherical member, a cylindrical plug, a valve shape according to any of the valve embodiments described above, and the like). The second valve 1248 need not necessarily be symmetrical (i.e., about a plane or an axis) as shown in FIG. 23.

With continued reference to illustrated embodiment of FIG. 23, the second valve 1248 is moveable in telescoping relationship in the nozzle 1114 between a closed position in which at least a portion of the periphery of the second valve 1248 sealingly engages the internal walls 1101 or an end surface of the nozzle 1114, and an opened position in which at least a portion of the second valve 1248 extends outwardly through the dispensing outlet 1170 or otherwise has a clearance from the nozzle 1114 permitting fluid flow past the second valve 1248. Although not required to practice the present invention, the second valve 1148 and/or the dispensing outlet 1170 can include a gasket 1109 for sealing the nozzle 1114 when the second valve 1248 is in the closed position.

The first and second valves 1168, 1248 can be driven or operated by any actuator described above and can be connected thereto in any manner also described above. For example, in the illustrated embodiment of FIG. 22, the nozzle assembly 1140 includes an actuator 1174 having a first valve rod 1172 connected to or integral with the first valve 1168. Another rod 1256 that is connected to or integral with the second valve 1248 is threaded into an aperture in the first valve 1168. Alternatively, the second rod 1256 can be integral with the first valve 1168 or can be permanently or releasably connected to the first valve 1168 in any manner. Any actuator can be connected to the valves 1168, 1250, such as the actuators described above (e.g. manually operated actuators, pneumatic or hydraulic actuators, and actuators having electromagnetic solenoids, stepper motors, rack and pinion assemblies, or belt and chain drives).

To operate the nozzle assembly 1140 illustrated in FIG. 23, a user places a vessel under the dispensing outlet 1170 and actuates the actuator 1174, causing the first and second valve rods 1172, 1256 to move the first and second valves 1168, 1248 downwardly along the axis A. Beer then enters the internal chamber 1180 through the inlet 1171 and flows downwardly through the diffuser 1105. As discussed above, in some embodiments beer enters the nozzle assembly 1140 at an elevated pressure (i.e. rack pressure). Movement of the first valve 1168 along the axis A increases the volume of the internal chamber 1180 upstream of the first valve 1168, thereby at least temporarily lowering the pressure in the internal chamber 1180 upstream of the first valve 1168. The sloped internal walls 1103 of the diffuser 1105 and the outer wall 1189 of the first valve 1168 provide a gradual increase in volume for the beer, thereby allowing a gradual and corresponding decrease in beer pressure as the beer flows around the first valve 1168. The beer then moves through the downstream portion 1107 of the internal chamber 1180 before being dispensed from the nozzle assembly 1140 through the dispense outlet 1170.

After the user dispenses a desired volume of beer, the user can move the first and second valves 1168, 1248 upwardly along the axis A and can move the second valve 1248 toward the closed position, thereby sealing the dispensing outlet 1170 and stopping the dispense of beer.

Figure 24:
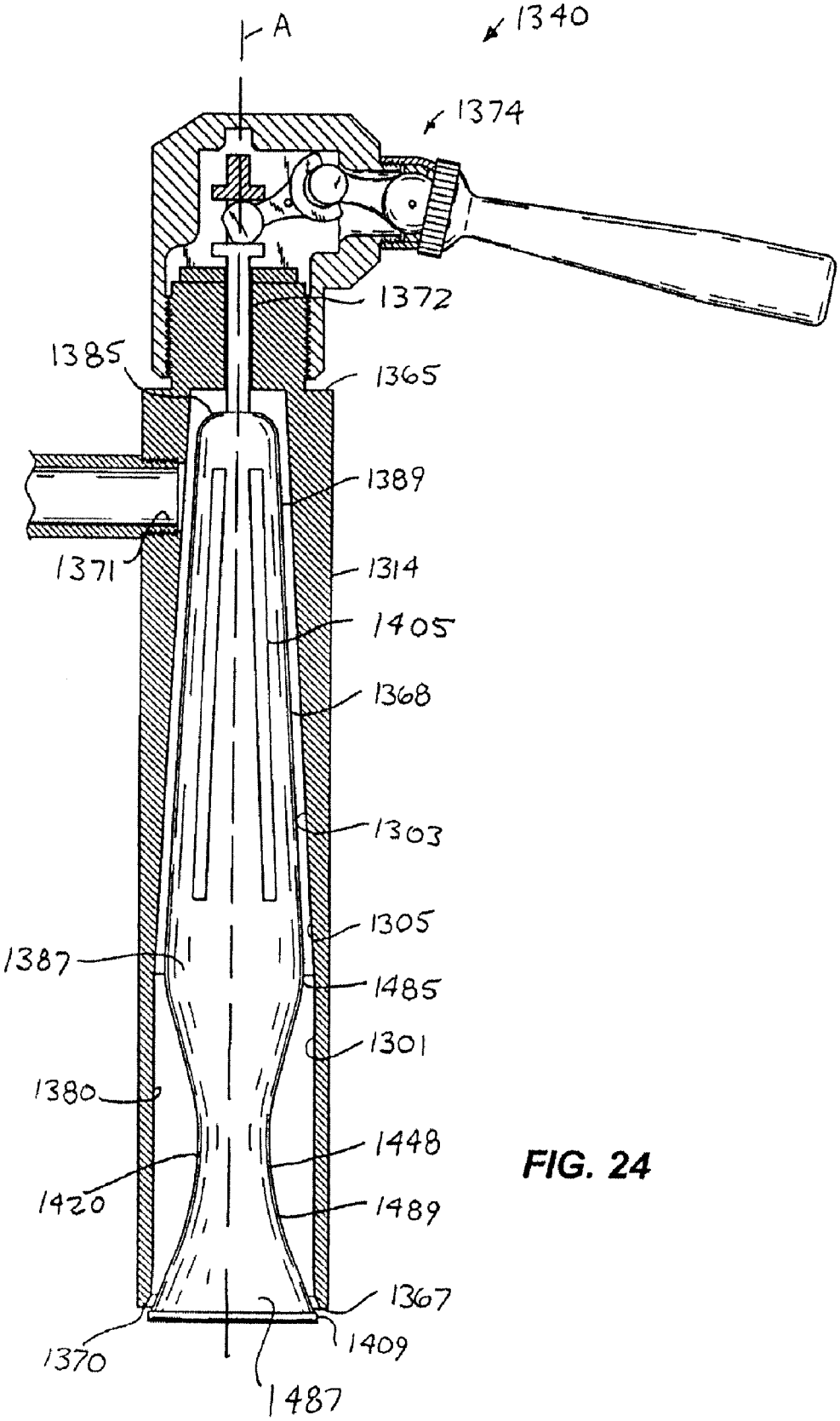
FIG. 24 is an elevational cross section view of a nozzle assembly associated with a seventh embodiment of the present invention.

FIG. 24 illustrates another embodiment of a nozzle assembly according to the present invention. The nozzle assembly 1340 in FIG. 24 is similar in many ways to the illustrated embodiments of FIGS. 1-23 described above. Accordingly, with the exception of mutually inconsistent features and elements between the embodiment of FIG. 24 and the embodiments of FIGS. 1-23, reference is hereby made to the description above accompanying the embodiments of FIGS. 1-23 for a more complete description of the features and elements (and the alternatives to the features and elements) of the embodiment of FIG. 24. Features and elements in the embodiment of FIG. 24 corresponding to features and elements in the embodiments of FIGS. 1-23 are numbered in the 1300 and 1400 series.

The nozzle assembly 1340 includes a nozzle 1314 having a first end 1365, a second end 1367, internal walls 1301, and a reservoir or internal chamber 1380 defined at least in part by the internal walls 1301. The nozzle 1314 and the dispensing outlet 1370 located at the second end 1367 of the nozzle 1314 are shaped to permit movement of first and second valves 1368, 1448 in telescoping relationship with respect to the nozzle 1314.

In the illustrated exemplary embodiment of FIG. 24, the first valve 1368 has a generally frusto-conical shape and has generally round cross sectional shapes of varying sizes at different points along the length of the first valve 1368. The outer wall 1389 of the first valve 1368 diverges outwardly from a first end 1385 toward a second end 1387 and defines an increasing cross sectional area of the first valve 1368. The outer wall 1389 of the first valve 1368 diverges outwardly from a first end 1385 toward a second end 1387 and defines an increasing cross sectional area of the first valve 1368 with increasing proximity to the second end 1387. In the illustrated embodiment of FIG. 24, the outer wall 1389 of the first valve 1368 is spaced a distance from the internal walls 1301 of the nozzle 1314, and does not sealingly engage the internal wall 1301 of the nozzle 1314. Therefore, the outer wall 1389 of the first valve 1368 does not prevent fluid flow through the nozzle 1314 between opposite ends of the first valve 1368.

To reduce or prevent the formation of turbulence in the flow of beer through the nozzle assembly 1340, the first valve 1368 and/or the internal walls 1303 of the nozzle 1314 can include ribs 1405 extending along a portion or all of the outer wall 1389 and internal walls 1303, respectively. If employed, such ribs 1405 can take any form described above with reference to the embodiment of FIGS. 17-20A.

In the illustrated exemplary embodiment of FIG. 24, the first and second valves 1468, 1448 together define a generally hourglass shape, and have generally round cross sectional shapes of varying sizes at different points along the length of the valves 1468, 1448. The first and second valves 1468, 1448 can be integral with one another to define an hourglass shape as just described. Alternatively, the first and second valves 1468, 1448 can be connected together in any manner (e.g., via a rod or other threaded portion of one valve 1468, 1448 threaded into an aperture in another valve 1448, 1468, by one or more conventional fasteners connecting the valves 1448, 1468, or in any other suitable manner).

With continued reference to the illustrated exemplary embodiment of FIG. 24, the outer wall 1489 of the first valve 1468 converges inwardly from a first end 1485 toward a reduced thickness portion 1420 adjacent the second valve 1448. Downstream of this location, the outer wall 1489 of the second valve 1448 diverges outwardly toward a second end 1487 of the second valve 1448.

Thus, the outer wall 1389 at the second end 1387 of the first valve 1368 defines a generally decreasing cross sectional area of the first valve 1368 with increasing proximity to the dispensing outlet 1370. A central portion 1420 between the first and second valves 1368, 1448 has a reduced cross sectional area compared to the second end 1387 of the first valve 1368 and the second end 1487 of the second valve 1448. The upstream end of the second valve defines a generally increasing cross sectional area of the second valve 1448 with increasing proximity to the dispensing outlet 1370. In the illustrated exemplary embodiment of FIG. 24, the hourglass shape defined along the axis by the first and second valves 1368, 1448 is symmetrical along the axis (i.e., in an upstream and downstream direction), although such symmetry is not required. In addition, the second valve 1448 need not necessarily be symmetrical about the axis as shown in FIG. 24. Any other valve shape can also be used (including without limitation a substantially flat plate, a spherical member, a cylindrical plug, a valve shape according to any of the valve embodiments described above, and the like).

With continued reference to the illustrated embodiment of FIG. 24, the hourglass shape defined by the first and second valves 1368, 1448 provides a gradual transition for beer flowing around the second end 1387 of the first valve 1368 and helps to prevent shearing of the beer as the beer flows around the second end 1387 of the first valve 1368. The hourglass shape of the second valve 1448 also maintains laminar flow of the beer through the nozzle 1314 and prevents the formation of turbulence in the beer. Reference is hereby made to the description of the illustrated embodiment of FIG. 22 for further description regarding the effects of an hourglass shape upon beer in the nozzle 1314.

With continued reference to the illustrated embodiment of FIG. 24, the first and second valves 1368, 1448 are moveable in telescoping relationship in the nozzle 1314 between a closed position in which at least a portion of the periphery of the second valve 1448 sealingly engages the internal walls 1301 or an end surface of the nozzle 1314, and an opened position in which at least a portion of the second valve 1448 extends outwardly through the dispensing outlet 1370 or otherwise has a clearance from the nozzle 1314 permitting fluid flow past the second valve 1448.

Although not required to practice the present invention, the second valve 1448 and/or the dispensing outlet 1370 can include a gasket 1409 for sealing the nozzle 1314 when the second valve 1448 is in the closed position. Reference is made to the earlier-described embodiments for further details regarding the gasket 1409 and its manner of connection and operation.

The first and second valves 1368, 1448 can be driven or operated by any actuator described above. For example, in the illustrated exemplary embodiment of FIG. 24, the nozzle assembly 1340 includes a manual actuator 1374 having a valve rod 1372 extending into the internal space 1380 and connected to the first end 1385 of the first valve 1368. In alternate embodiments of the present invention, other actuators, such as the actuators described above (e.g. manually operated actuators, pneumatic or hydraulic actuators, and actuators having electromagnetic solenoids, stepper motor, rack and pinion assemblies, or belt and chain drives) can also or alternately be used to move one or both of the first and second valves 1368, 1448 through the internal space 1380.

To operate the nozzle assembly 1340 illustrated in FIG. 24, a user places a vessel under the dispensing outlet 1370 and actuates the actuator 1374, causing the valve rod 1372 to move the first and second valves 1368, 1448 downwardly along the axis A. Beer then enters the internal chamber 1380 through the inlet 1371 and flows downwardly through the diffuser 1305. As discussed above, in some embodiments beer enters the nozzle assembly 1340 at an elevated pressure (i.e., rack pressure). Movement of the first valve 1368 along the axis A increases the volume of the internal chamber 1380 upstream of the first valve 1368, thereby at least temporarily lowering the pressure in the internal chamber 1380 upstream of the first valve 1368. The sloped internal walls 1303 of the diffuser 1305 and the sloped outer wall 1389 of the first valve 1368 provide a gradual increase in volume for the beer, thereby allowing a gradual and corresponding decrease in beer pressure as the beer flows around the first valve 1368. The beer then moves through the downstream portion 1307 of the internal chamber 1380 before being dispensed from the nozzle assembly 1340 through the dispense outlet 1370.

After the user dispenses a desired volume of beer, the user can move the first and second valves 1368, 1448 upwardly along the axis A and can move the second valve 1448 toward the closed position, thereby sealing the dispensing outlet 1370 and stopping the dispense of beer.

Figure 25:
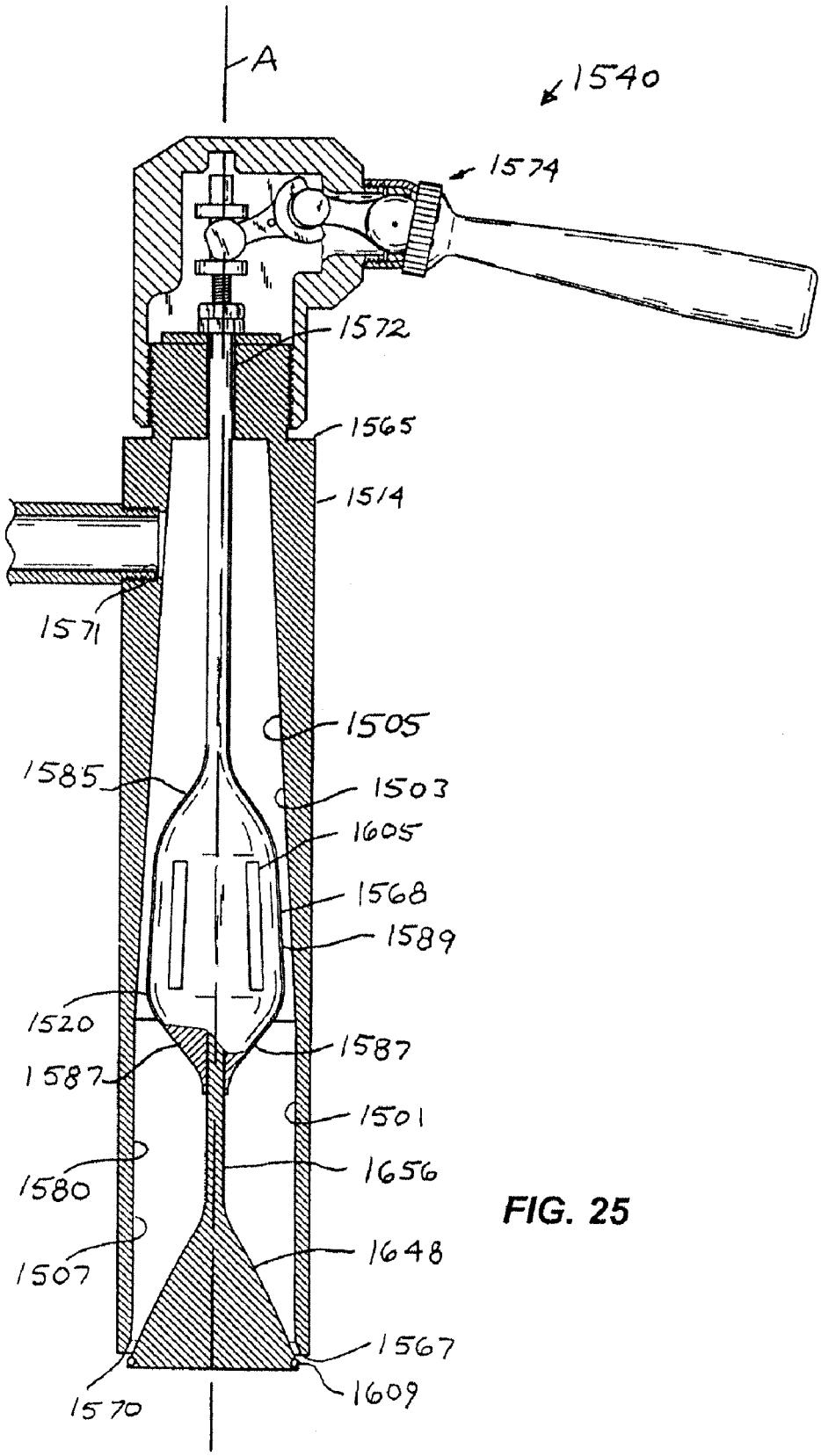
FIG. 25 is an elevational cross section view of a nozzle assembly associated with a eighth embodiment of the present invention.

FIG. 25 illustrates yet another embodiment of a nozzle assembly according to the present invention. The nozzle assembly 1540 in FIG. 25 is similar in many ways to the illustrated embodiments of FIGS. 1-24 described above. Accordingly, with the exception of mutually inconsistent features and elements between the embodiment of FIG. 25 and the embodiments of FIGS. 1-24, reference is hereby made to the description above accompanying the embodiments of FIGS. 1-24 for a more complete description of the features and elements (and the alternatives to the features and elements) of the embodiment of FIG. 25. Features and elements in the embodiment of FIG. 25 corresponding to features and elements in the embodiments of FIGS. 1-224 are numbered in the 1500 and 1600 series.

The nozzle assembly 1540 includes a nozzle 1514 having a first end 1565, a second end 1567, internal walls 1501, and a reservoir or internal chamber 1580 defined at least in part by the internal walls 1501. The nozzle 1514 and the dispensing outlet 1570 located at the second end 1567 of the nozzle 1514 are shaped to permit movement of first and second valves 1568, 1648 in telescoping relationship with respect to the nozzle 1514.

In the illustrated exemplary embodiment of FIG. 25, the first valve 1568 has a generally bulb-like shape having generally round cross sectional shapes of varying sizes at different points along the length of the first valve 1568. The outer wall 1589 of the first valve 1568 diverges outwardly from a first end 1585 toward a downstream portion 1520, which has a maximum cross sectional area, and defines an increasing cross sectional area of the first valve 1568 with increasing proximity to the downstream portion 1520. The outer wall 1589 then converges inwardly from the downstream portion 1520 toward the second end 1587 of the first valve 1568. In some embodiments, such as the illustrated exemplary embodiment of FIG. 25, the downstream portion 1520 is not equally spaced between the first and second ends 1585, 1587 of the first valve 1568.

In some embodiments, the length of the first valve 1568 between the first and second ends 1585, 1587 is greater than or equal to the median or mean width (or the diameter of the first valve 1568 in embodiments in which the first valve 1568 has a circular cross section) of the first valve 1568. Also, in some embodiments, the first valve 1568 has substantially straight walls running along at least a portion of the length of the first valve 1568, and has a mean width along this portion that is lesser than or equal to twice the length of the first valve 1568 along this portion. In other embodiments (not shown), the first valve 1568 can have a substantially spherical shape. In still other embodiments, the first valve 1568 can have a football shape with the central portion 1520 having a maximum width and a generally increasing cross sectional area between the first end 1585 and the downstream portion 1520 and a generally decreasing cross sectional area between the downstream portion 1520 and the second end 1587.

With continued reference to the embodiment illustrated in FIG. 25, the first valve 1568 is moveable axially through the internal chamber 1580 through a range of opened positions providing for different flow rates. In the illustrated exemplary embodiment of FIG. 25, the outer wall 1589 is spaced a distance from the internal wall 1501 and does not sealingly engage the internal wall 1501 of the nozzle 1514, and consequently, does not prevent fluid flow through the nozzle 1514 between opposite ends of the first valve 1568.

To reduce or prevent the formation of turbulence in the flow of beer through the nozzle assembly 1540, the first valve 1568 and/or the internal walls 1503 of the nozzle 1514 can include ribs 1605 extending along a portion or all of the outer wall 1589 and internal walls 1503, respectively. If employed, such ribs 1605 can take any form described above with reference to the embodiment of FIGS. 17-20A.

In the illustrated exemplary embodiment of FIG. 25, the second valve 1648 is has a generally conical shape. Any other valve shape can also be used (including without limitation a substantially flat plate, a spherical member, a cylindrical plug, a valve shape according to any of the valve embodiments described above, and the like). Also, the second valve 1648 need not necessarily be symmetrical (i.e., about a plane or an axis) as shown in FIG. 25.

With continued reference to illustrated embodiment of FIG. 25, the second valve 1648 is moveable in telescoping relationship in the nozzle 1514 between a closed position in which at least a portion of the periphery of the second valve 1648 sealingly engages the internal walls 1501 or an end surface of the nozzle 1514, and an opened position in which at least a portion of the second valve 1648 extends outwardly through the dispensing outlet 1570 or otherwise has a clearance from the nozzle 1514 permitting fluid flow past the second valve 1648. Although not required to practice the present invention, the second valve 1548 and/or the dispensing outlet 1570 can include a gasket 1609 for sealing the nozzle 1514 when the second valve 1648 is in the closed position.

The first and second valves 1568, 1648 can be driven or operated by any actuator described above and can be connected thereto in any manner also described above. For example, in the illustrated embodiment of FIG. 25, the nozzle assembly 1540 includes an actuator 1574 having a first valve rod 1572 connected to or integral with the first valve 1568. Another rod 1656 that is connected to or integral with the second valve 1648 is threaded into an aperture in the first valve 1568. Alternatively, the second rod 1656 can be integral with the first valve 1568 or can be permanently or releasably connected to the first valve 1568 in any manner. Any actuator can be connected to the valves 1568, 1648, such as the actuators described above (e.g. manually operated actuators, pneumatic or hydraulic actuators, and actuators having electromagnetic solenoids, stepper motors, rack and pinion assemblies, or belt and chain drives).

To operate the nozzle assembly 1540 illustrated in FIG. 25, a user places a vessel under the dispensing outlet 1570 and actuates the actuator 1574, causing the first and second valve rods 1572, 1656 to move the first and second valves 1568, 1648 downwardly along the axis A. Beer then enters the internal chamber 1580 through the inlet 1571 and flows downwardly through the diffuser 1505. As discussed above, in some embodiments beer enters the nozzle assembly 1540 at an elevated pressure (i.e., rack pressure). Movement of the first valve 1568 along the axis A increases the volume of the internal chamber 1580 upstream of the first valve 1568, thereby at least temporarily lowering the pressure in the internal chamber 1580 upstream of the first valve 1568. The sloped internal walls 1503 of the diffuser 1505 and the outer wall 1589 of the first valve 1568 provide a gradual increase in volume for the beer, thereby allowing a gradual and corresponding decrease in beer pressure as the beer flows around the first valve 1568. The beer then moves through the downstream portion 1507 of the internal chamber 1580 before being dispensed from the nozzle assembly 1540 through the dispense outlet 1570.

After the user dispenses a desired volume of beer, the user can move the first and second valves 1568, 1648 upwardly along the axis A and can move the second valve 1648 toward the closed position, thereby sealing the dispensing outlet 1570 and stopping the dispense of beer.

In the embodiments described above, the elongated valves 368, 568, 768, 968, 1168, 1368, and 1568 need not necessarily move to a closed position preventing fluid flow. In such cases, one or more up or downstream valves can perform this function.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims. For example, a number of the embodiments of the present invention described above and illustrated in the figures employs a plate heat exchanger 34, 44 to cool the comestible fluid flowing therethrough. A plate heat exchanger works well in the application of the present invention due to its relatively high efficiency and low cost. However, one having ordinary skill in the art will appreciate that many other types of heat exchangers can be used in place of the plate heat exchangers 34, 44, including without limitation shell and tube heat exchangers, tube in tube heat exchangers, heatpipes, and the like.

Also, a number of the embodiments of the present invention described above and illustrated in the figures has one or more kegs 22 stored in a refrigerated vending stand 10. It should be noted, however, that the present invention does not rely upon refrigeration of the source of comestible fluid to dispense cold comestible fluid. Because comestible fluid entering the nozzle assembly 40, 140, 240, 340, 540, 740 has been cooled by the associated heat exchanger 34, 44, the temperature of the comestible fluid upstream of the heat exchangers 34, 44 is relevant only to the amount of work required by the refrigeration system 48 supplying the heat exchangers 34, 44 with cold refrigerant. Therefore, the kegs 22 can be tapped and dispensed from the apparatus of the present invention at room temperature, if desired. Essentially, the present invention replaces the extremely inefficient conventional practice of keeping large volumes of comestible fluid cold for a relatively long period of time prior to dispense with the much more efficient process of quickly cooling comestible fluid immediately prior to dispense using relatively small and efficient heat exchangers 34, 44.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein.

Various features and advantages of the invention are set forth in the following claims.

The invention claimed is:

1. A nozzle assembly comprising:

a housing;

an internal chamber enclosed by the housing, the internal chamber having an inlet and an outlet, the inlet being in fluid communication with a fluid line, the internal chamber having a first end and a second end, the outlet disposed at the second end of the internal chamber, the internal chamber including a diffuser and a substantially straight terminal portion downstream of the diffuser, a cross section of the substantially straight terminal portion equal to a largest cross section of the diffuser;

a valve rod at least partly enclosed within the internal chamber; and a valve coupled to the valve rod, the valve at least partially positioned within the diffuser, the valve having a first end and a second end, the first end of the valve including a rounded nose portion having a larger cross section than a cross section of the valve downstream of the rounded nose portion and upstream of the second end, the second end of the valve having a larger cross section than the rounded nose portion, the second end of the valve extending outside the internal chamber in order to enable fluid to exit the internal chamber through the outlet.

2. The nozzle assembly of claim 1, wherein a perimeter of the valve is substantially smaller than a length of the valve.

3. The nozzle assembly of claim 1, wherein the internal chamber is axisymmetric.

4. The nozzle assembly of claim 1, wherein the valve is axisymmetric.

5. The nozzle assembly of claim 4, wherein the valve is substantially cone shaped.

6. The nozzle assembly of claim 1, and further comprising a gasket.

7. The nozzle assembly of claim 6, wherein the gasket is positioned adjacent to the second end of the valve.

8. The nozzle assembly of claim 1, wherein the substantially straight terminal portion has a chamfered end.

9. The nozzle assembly of claim 1, wherein the first end of the internal chamber extends beyond the inlet of the internal chamber.

10. The nozzle assembly of claim 1, and further comprising an entry fitting having a first end and a second end, the first end of the entry fitting being in fluid communication with the fluid line and the second end of the entry fitting being in fluid communication with the inlet of the internal chamber.

11. The nozzle assembly of claim 10, wherein the entry fitting is positioned at an angle with respect to the valve rod.

12. The nozzle assembly of claim 11, wherein the entry fitting connects to the internal chamber at a substantially right angle with respect to the valve rod.

13. The nozzle assembly of claim 10, wherein the entry fitting has a constant perimeter.

14. The nozzle assembly of claim 13, wherein the entry fitting has a circular cross section.

15. The nozzle assembly of claim 1, and further comprising at least one rib positioned on the valve.

16. The nozzle assembly of claim 15, wherein the at least one rib extends in a longitudinal direction.

17. The nozzle assembly of claim 15, wherein a height of the at least one rib is substantially constant in a longitudinal direction.

18. The nozzle assembly of claim 15, wherein the at least one rib is substantially parallel to an inside wall of the internal chamber.

19. The nozzle assembly of claim 1, wherein the valve rod is manually operated.

* * * * *